US009328553B2

(12) United States Patent
Colson et al.

(10) Patent No.: US 9,328,553 B2
(45) **Date of Patent: *May 3, 2016**

(54) RETRACTABLE SHADE WITH COLLAPSIBLE VANES

(71) Applicant: Hunter Douglas Inc., Pearl River, NY (US)

(72) Inventors: Wendell B. Colson, Weston, MA (US); Marjorie G. Harper, Littleton, CO (US); Daniel M. Fogarty, Framingham, MA (US); David P. Hartman, Framingham, MA (US); Ralph G. Jelic, Boulder, CO (US); Kristi K. Kopecky, Westminster, CO (US)

(73) Assignee: Hunter Douglas Inc., Pearl River, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/590,020

(22) Filed: Jan. 6, 2015

(65) Prior Publication Data

US 2015/0107786 A1 Apr. 23, 2015

Related U.S. Application Data

(60) Continuation of application No. 14/103,207, filed on Dec. 11, 2013, now Pat. No. 8,944,133, which is a (Continued)

(51) Int. Cl.
*E06B 9/08* (2006.01)
*E06B 9/264* (2006.01)
(Continued)

(52) U.S. Cl.
CPC . *E06B 9/264* (2013.01); *E06B 9/24* (2013.01); *E06B 9/262* (2013.01); *E06B 9/34* (2013.01);
(Continued)

(58) Field of Classification Search
CPC . E06B 9/262; E06B 9/264; E06B 2009/2452; E06B 2009/2627; E06B 2009/2429; E06B 9/24; E06B 9/60; E06B 9/58; E06B 9/42; E06B 9/40; E06B 9/34; E06B 2009/2441; E06B 2009/2625; E06B 2009/2622
USPC ..... 160/121.1, 120, 84.05, 300, 293.1, 302, 160/168.1 R, 330, 84.01, 89, 113, 176.1 R, 160/179, 237, 23.1, 291
See application file for complete search history.

(56) References Cited

U.S. PATENT DOCUMENTS 1,958,695 A 5/1934 Claus
2,267,869 A 12/1941 Loehr
(Continued)

FOREIGN PATENT DOCUMENTS

CN 264364 Y 10/2004
DE 3529418 C1 4/1987
(Continued)

OTHER PUBLICATIONS

Author Unknown, "Poliformas Plasticas—Resinas Poliester—Fibra de Vidrio", www.poliformasplasticas.com/mx/2011/innova_laminas.php (2010), 4 pages.

*Primary Examiner* — Blair M Johnson
(74) *Attorney, Agent, or Firm* — Dorsey & Whitney LLP

(57) ABSTRACT

A retractable cover for architectural openings having collapsible vanes includes a support structure in the form of a sheet of material, monofilaments, tapes, ribbons, cords, or the like, supporting an upper edge of a plurality of vertically spaced, horizontally extending vanes with the lower edges of the vanes in most embodiments of the invention being connected to operating elements adapted to raise the lower edges of each vane toward the upper edges to define openings or gaps between the vanes through which vision and light can pass in an open condition of the covering. Variations of the covering do not require movement of a lower edge of a vane relative to an upper edge but simply movement of some vanes relative to other vanes. The vanes can be made of materials having different flexibilities and where more rigid materials are used, creased fold lines can be established for desired operability.

22 Claims, 45 Drawing Sheets

Related U.S. Application Data continuation of application No. 13/443,535, filed on Apr. 10, 2012, now Pat. No. 8,607,838, which is a division of application No. 12/538,620, filed on Aug. 10, 2009, now Pat. No. 8,151,857, which is a division of application No. 10/567,619, filed as application No. PCT/US2004/027197 on Aug. 20, 2004, now Pat. No. 7,588,068.

(60) Provisional application No. 60/497,020, filed on Aug. 20, 2003.

(51) Int. Cl.

| | |
|---|---|
| ***E06B 9/262*** | (2006.01) |
| ***E06B 9/34*** | (2006.01) |
| ***E06B 9/40*** | (2006.01) |
| ***E06B 9/42*** | (2006.01) |
| ***E06B 9/58*** | (2006.01) |
| ***E06B 9/60*** | (2006.01) |
| *E06B 9/24* | (2006.01) |

(52) U.S. Cl.

CPC ... *E06B 9/40* (2013.01); *E06B 9/42* (2013.01); *E06B 9/58* (2013.01); *E06B 9/60* (2013.01); *E06B 2009/2429* (2013.01); *E06B 2009/2441* (2013.01); *E06B 2009/2622* (2013.01); *E06B 2009/2625* (2013.01); *E06B 2009/2627* (2013.01)

(56) References Cited

U.S. PATENT DOCUMENTS

| | | | |
|---|---|---|---|
| RE22,311 | E | 5/1943 | Roy |
| 2,350,200 | A | 5/1944 | Starr |
| 2,874,612 | A | 2/1959 | Luboshez |
| 3,190,086 | A | 6/1965 | Klein |
| 3,222,689 | A | 12/1965 | Efron et al. |
| D208,350 | S | 8/1967 | Cheris |
| 3,566,499 | A | 3/1971 | James |
| 4,282,919 | A | 8/1981 | Teno |
| 5,205,334 | A | 4/1993 | Judkins |
| 5,228,936 | A | 7/1993 | Goodhue |
| 5,231,708 | A | 8/1993 | Hansen |
| 5,313,999 | A | 5/1994 | Colson et al. |
| 5,355,555 | A | 10/1994 | Zarelius |
| 5,456,304 | A | 10/1995 | Colson et al. |
| 5,490,553 | A | 2/1996 | Colson et al. |
| 5,503,210 | A | 4/1996 | Colson et al. |
| 5,547,006 | A | 8/1996 | Auger |
| 5,558,925 | A | 9/1996 | Fritzman |
| 5,645,504 | A | 7/1997 | Westhoff |
| 5,649,583 | A | 7/1997 | Hsu |
| 5,680,981 | A | 10/1997 | Prince |
| 5,714,034 | A | 2/1998 | Goodhue |
| 5,733,632 | A | 3/1998 | Marusak |
| 5,787,951 | A | 8/1998 | Tonomura et al. |
| 5,855,235 | A | 1/1999 | Colson et al. |
| 5,897,731 | A | 4/1999 | Colson et al. |
| 5,918,655 | A | 7/1999 | Corey |
| 5,960,847 | A | 10/1999 | Crider et al. |
| 6,006,812 | A | 12/1999 | Corey |
| 6,112,797 | A | 9/2000 | Colson et al. |
| 6,223,802 | B1 | 5/2001 | Colson |
| D443,455 | S | 6/2001 | Hynniman |
| 6,289,964 | B1 | 9/2001 | Colson et al. |
| 6,345,486 | B1 | 2/2002 | Colson et al. |
| 6,354,353 | B1 | 3/2002 | Green |
| 6,484,786 | B1 | 11/2002 | Ruggles et al. |
| D468,950 | S | 1/2003 | Judkins |
| 6,572,725 | B2 | 6/2003 | Goodhue |
| 6,595,262 | B2 | 7/2003 | Chen |
| 6,688,373 | B2 | 2/2004 | Corey et al. |
| 6,740,389 | B2 | 5/2004 | Yu |
| 6,792,994 | B2 | 9/2004 | Lin |
| 6,932,138 | B2 | 8/2005 | Yu et al. |
| 6,978,821 | B2 | 12/2005 | Welfonder |
| D515,345 | S | 2/2006 | Herhold et al. |
| 7,111,659 | B2 | 9/2006 | Harper et al. |
| 7,117,917 | B2 | 10/2006 | Allsopp |
| 7,147,029 | B2 | 12/2006 | Kovach et al. |
| 7,191,816 | B2 | 3/2007 | Colson et al. |
| 7,207,370 | B2 | 4/2007 | Snyder et al. |
| 7,237,591 | B2 | 7/2007 | Snyder et al. |
| 7,311,131 | B2 | 12/2007 | Nien et al. |
| 7,337,822 | B2 | 3/2008 | Snyder et al. |
| D568,082 | S | 5/2008 | Bohlen |
| 7,500,505 | B2 | 3/2009 | Smith et al. |
| 7,549,455 | B2 | 6/2009 | Harper et al. |
| 7,578,334 | B2 | 8/2009 | Smith et al. |
| 7,588,068 | B2 | 9/2009 | Colson et al. |
| D605,885 | S | 12/2009 | Judkins |
| 7,637,301 | B2 | 12/2009 | Forst Randle |
| 7,730,931 | B2 | 6/2010 | Stern |
| D622,964 | S | 9/2010 | Colson |
| D623,419 | S | 9/2010 | Swiszcz et al. |
| D632,492 | S | 2/2011 | Colson et al. |
| D632,493 | S | 2/2011 | Colson et al. |
| D640,472 | S | 6/2011 | Colson et al. |
| D640,875 | S | 7/2011 | Colson et al. |
| 7,971,624 | B2 | 7/2011 | Harper et al. |
| 8,151,857 | B2 | 4/2012 | Colson et al. |
| 8,171,640 | B2 | 5/2012 | Colson et al. |
| 8,393,080 | B2 | 3/2013 | Ballard, Jr. et al. |
| 8,496,768 | B2 | 7/2013 | Holt et al. |
| 8,607,838 | B2 | 12/2013 | Colson et al. |
| 8,944,134 | B2 * | 2/2015 | Ballard, Jr. ..... E06B 9/266 160/121.1 |
| 2005/0087309 | A1 | 4/2005 | Nien et al. |
| 2007/0010147 | A1 | 1/2007 | Swiszcz |
| 2007/0074826 | A1 | 4/2007 | Jelic et al. |
| 2013/0139977 | A1 | 6/2013 | Ballard et al. |
| 2013/0306218 | A1 | 11/2013 | Holt et al. |
| 2014/0096915 | A1 | 4/2014 | Colson et al. |
| 2015/0176328 | A1 | 6/2015 | Ballard, Jr. et al. |
| 2015/0267467 | A1 | 9/2015 | Holt et al. |

FOREIGN PATENT DOCUMENTS

| | | | |
|---|---|---|---|
| EP | 0482794 | A1 | 4/1992 |
| EP | 0654577 | A1 | 5/1995 |
| EP | 1213435 | A2 | 6/2002 |
| EP | 1319792 | A1 | 6/2003 |
| GB | 1494842 | A | 12/1977 |
| JP | 1413040 | | 8/1939 |
| JP | 6-173549 | | 6/1994 |
| JP | 6173548 | | 6/1994 |
| JP | 6173549 | A | 6/1994 |
| JP | 6173558 | | 6/1994 |
| JP | 7039449 | A | 2/1995 |
| JP | 9-221969 | | 8/1997 |
| JP | 11050526 | | 2/1999 |
| JP | 2002506944 | A | 3/2002 |
| JP | 5226112 | B2 | 7/2013 |
| TW | 336889 | B | 7/1998 |
| TW | 549344 | | 8/2003 |
| WO | 85/02760 | A1 | 7/1985 |
| WO | 94/29559 | A1 | 12/1994 |
| WO | 2005019584 | A2 | 3/2005 |
| WO | 2005062875 | A2 | 7/2005 |
| WO | 2005081948 | A2 | 9/2005 |
| WO | 2006023751 | A2 | 3/2006 |
| WO | 2006098853 | A2 | 9/2006 |

* cited by examiner

RETRACTABLE SHADE WITH COLLAPSIBLE VANES

CROSS REFERENCE TO RELATED APPLICATIONS

The present application is a continuation of U.S. patent application Ser. No. 14/103,207 filed Dec. 11, 2013, which is a continuation of U.S. patent application Ser. No. 13/443,535 filed Apr. 10, 2012, now U.S. Pat. No. 8,607,838, which is a divisional of U.S. patent application Ser. No. 12/538,620 filed Aug. 10, 2009, now U.S. Pat. No. 8,151,857, which is a divisional of U.S. patent application Ser. No. 10/567,619 filed Feb. 8, 2006, now U.S. Pat. No. 7,588,068, which application is the Section 371 of PCT International patent application No. PCT/US2004/027197 filed Aug. 20, 2004, which claims the benefit under 35 U.S.C. §119(e) to U.S. provisional patent application No. 60/497,020 filed Aug. 20, 2003, which are all hereby incorporated by reference into the present application in their entireties.

BACKGROUND OF THE INVENTION

1. Field of the Invention

The present invention relates generally to panels which can be used in coverings for architectural openings and to an architectural opening utilizing such a panel. The panel includes a support structure having on its face a plurality of horizontally extending vertically spaced strips of material whose top edges are fixed to the support structure at predetermined locations along the height of the support structure and whose bottom edges are slidably related to the support structure. The bottom edges can be selectively drawn upwardly toward the fixed top edges so as to create gaps between the strips of material through which vision and light can pass.

The panel can be used in a covering for architectural openings that might include a roller at the top of the covering around which the panel can be wrapped when retracting the panel from an extended position across the architectural opening. The covering is also movable between an open position in which the lower edge of each strip of material is positioned adjacent to its upper edge and a closed position in which the upper and lower edges of each strip of material are maximally spaced.

2. Description of the Relevant Art

Coverings for architectural openings such as windows, doors, archways, and the like have assumed numerous forms for many years. Early forms of such coverings consisted primarily of fabric draped across the architectural opening and in many instances the fabric was not movable between extended and retracted positions relative to the opening.

Retractable coverings for architectural openings have evolved into many different forms which include roller shades in which a piece of flexible material can be extended from a wrapped condition on a roller to an extended position across the architectural opening and vice versa.

Another popular form of a retractable covering for an architectural opening is the Venetian Blind wherein a plurality of horizontally disposed slats are suspended on cord ladders such that the slats can be pivoted about their horizontal longitudinal axes between open and closed positions or the entire blind can be retracted by lifting the bottom-most slat thereby accumulating each of the slats disposed thereabove until a stack of the slats is disposed adjacent the top of the architectural opening.

Vertical blinds have also been developed which are similar to venetian blinds except the slats or vanes are disposed vertically and can be pivoted about longitudinal vertical axes to move the covering between open and closed positions. The slats or vanes can also be moved horizontally so as to be stacked adjacent one or both side edges of the architectural opening when the covering is retracted or extended across the opening with the slats or vanes uniformly spaced.

More recently, cellular shades have become very popular and come in many different varieties. In one popular cellular shade, horizontally disposed collapsible tubes of material are connected and vertically stacked to form a panel of such tubes. When the panel is fully extended, it covers the architectural opening but the panel can be retracted by lifting the lowermost cell thereby collapsing each cell thereabove until a relatively thin stack of cells are accumulated adjacent to the top of the opening.

Another popular cellular product utilizes a pair of spaced vertically extending sheets of translucent material, such as sheer fabric, having a plurality of horizontally disposed vanes extending therebetween. The vanes may be rigid or flexible and are adapted to pivot about longitudinal axes when the vertical sheets of material are shifted in opposite vertical directions. The entire panel of sheets and vanes can also be easily rolled about a roller to retract the covering.

Modifications of vertical blinds have also been recently developed wherein a plurality of vertically extending vanes are interconnected along one vertical edge with a sheet of fabric material, which might be sheer fabric, so the covering resembles a drapery product but the vanes, disposed behind the sheer fabric, are pivotable about longitudinal vertical axes to selectively block vision and light through the sheer. Of course, the vanes and attached fabric can also be accumulated at one or more sides of the architectural opening when retracting the covering from its extended position across the architectural opening.

The design of coverings for architectural openings can be seen to encompass a myriad of different forms with these forms being driven by both utilitarian and aesthetic factors. Many times one of these factors will dictate the other but various combinations of components are constantly being developed to satisfy the unquenching thirst of consumers for coverings for architectural openings in their dwellings or commercial space which satisfy both utilitarian and aesthetic desires.

It is to satisfy such desires that the present invention has been developed.

BRIEF SUMMARY OF THE INVENTION

The present invention concerns a covering for an architectural opening and a panel for use therein wherein the panel includes a support structure on which is mounted a plurality of adjacent horizontally extending vertically spaced vanes or strips of material. The spaced vanes can be moved between an extended flat closed position and a retracted open position wherein the vanes project away from the support structure and define spaces therebetween through which vision and light can pass.

The support structure can assume numerous forms including a sheet of flexible material which might, by way of example, be a sheer fabric. It could also be a plurality of vertically extending flexible elements that are disposed in spaced parallel relationship and in a common plane. While in the preferred form of the invention the vanes are horizontally disposed, those skilled in the art might also utilize the teachings of the invention in a covering wherein the vanes extended vertically.

The vanes can assume many different forms and can be made of various materials such as woven or nonwoven fabrics, vinyl materials or the like. They can also be flexible, semi-rigid or rigid materials having fold lines if necessary permitting them to move between open and closed positions. The vanes are typically strips of material extending horizontally across the vertical support structure with the strips having upper and lower edges. The upper edge of each strip is secured to the support structure at a vertically spaced location relative to the next adjacent vanes so the remainder of the strip depends from the upper edge thereby forming in aggregate a panel of material including a plurality of strips of material supported on the support structure. The lower edge of each strip is slidably connected to the support structure so it can be moved vertically toward and away from the upper edge of the strip. When the lower edge is moved toward the upper edge, the strip expands or balloons away from the support structure in an open condition of the panel or covering thereby permitting the passage of vision and light between the strips of material or vanes. When the lower edge of each strip of material or vane is allowed to drop, as by gravity or otherwise, into a maximally spaced position relative to its top edge, the strips of material lie flat in a substantially common plane with the support structure and preferably the strips of material overlap slightly to block vision and light through the panel or covering. In this closed position of the panel or covering, it can be easily rolled about a roller in a headrail of a covering incorporating the panel to move the covering between extended and retracted positions.

As mentioned, the strips of material can assume numerous forms and there may even be double layers of the strips of material so that closed cells are formed therebetween. The separate strips of material can be disposed on one or both sides of the support structure such that the support structure extends along one side edge of the cells or through the center of the cells.

The support structure, as mentioned previously, could be in the form of one or more sheets of material that would support the upper edge of each vane at a predetermined location along the height of the sheet or sheets of material. As an alternative, a plurality of flexible, vertically extending elongated lift elements could replace the sheet or sheets of material in which case the upper edge of each vane would be secured to the flexible lift elements at corresponding locations along their length. In addition to the sheet of material or lift elements, whichever the case may be, a plurality of flexible operating elements are also utilized which are fixedly connected to the lower edge of each vane but slide relative to the upper edge of each vane whereby the lower edges of the vanes can rise or fall thereby moving the vanes and the panel in which they are mounted between open and closed positions.

Other aspects, features, and details of the present invention can be more completely understood by reference to the following detailed description of the preferred embodiments, taken in conjunction with the drawings and from the appended claims.

DETAILED DESCRIPTION OF THE INVENTION

Figure 1:
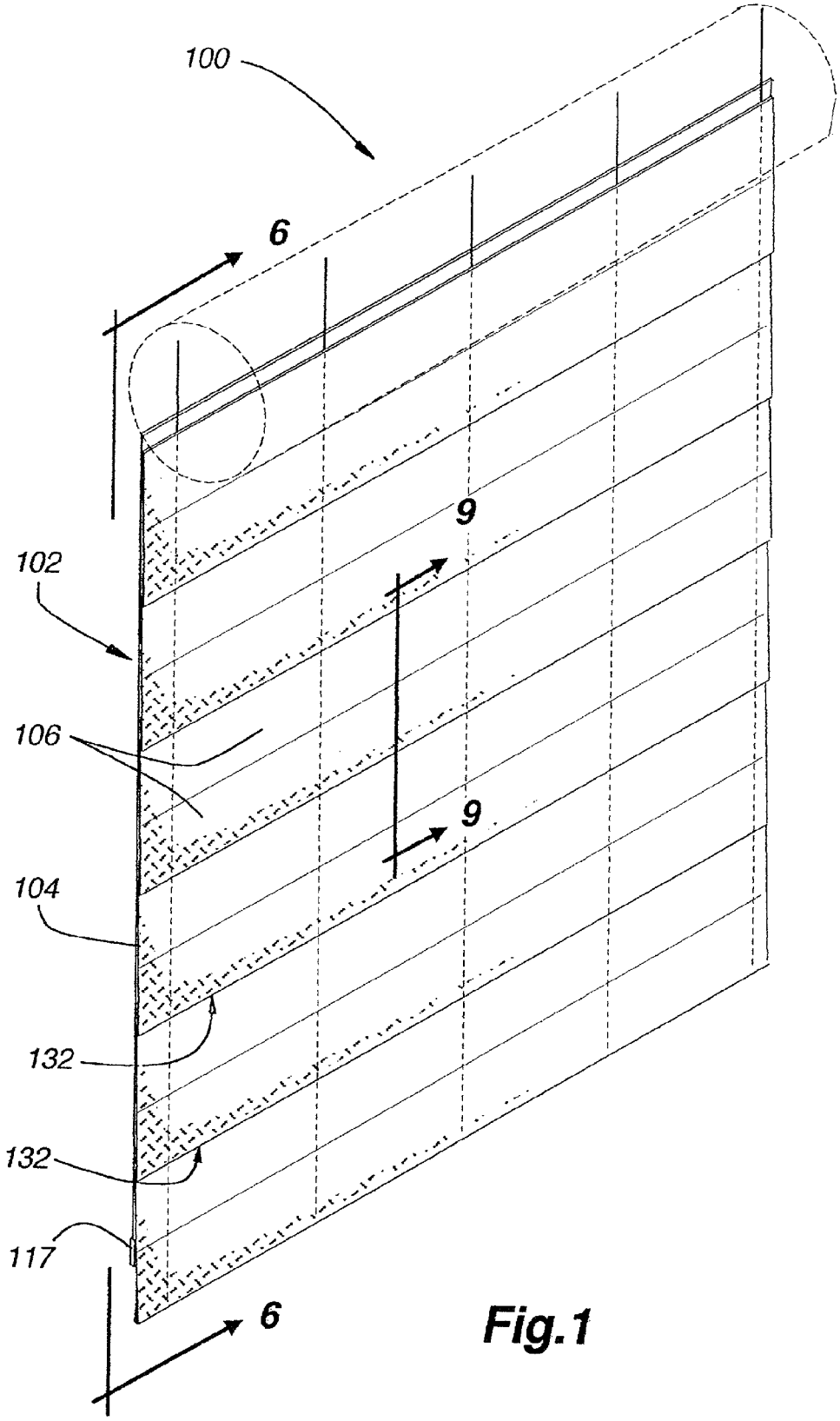
FIG. 1 is an isometric view of a first embodiment of a panel in accordance with the present invention for use in a covering for architectural openings with the panel in a closed but extended position.
Figure 2:
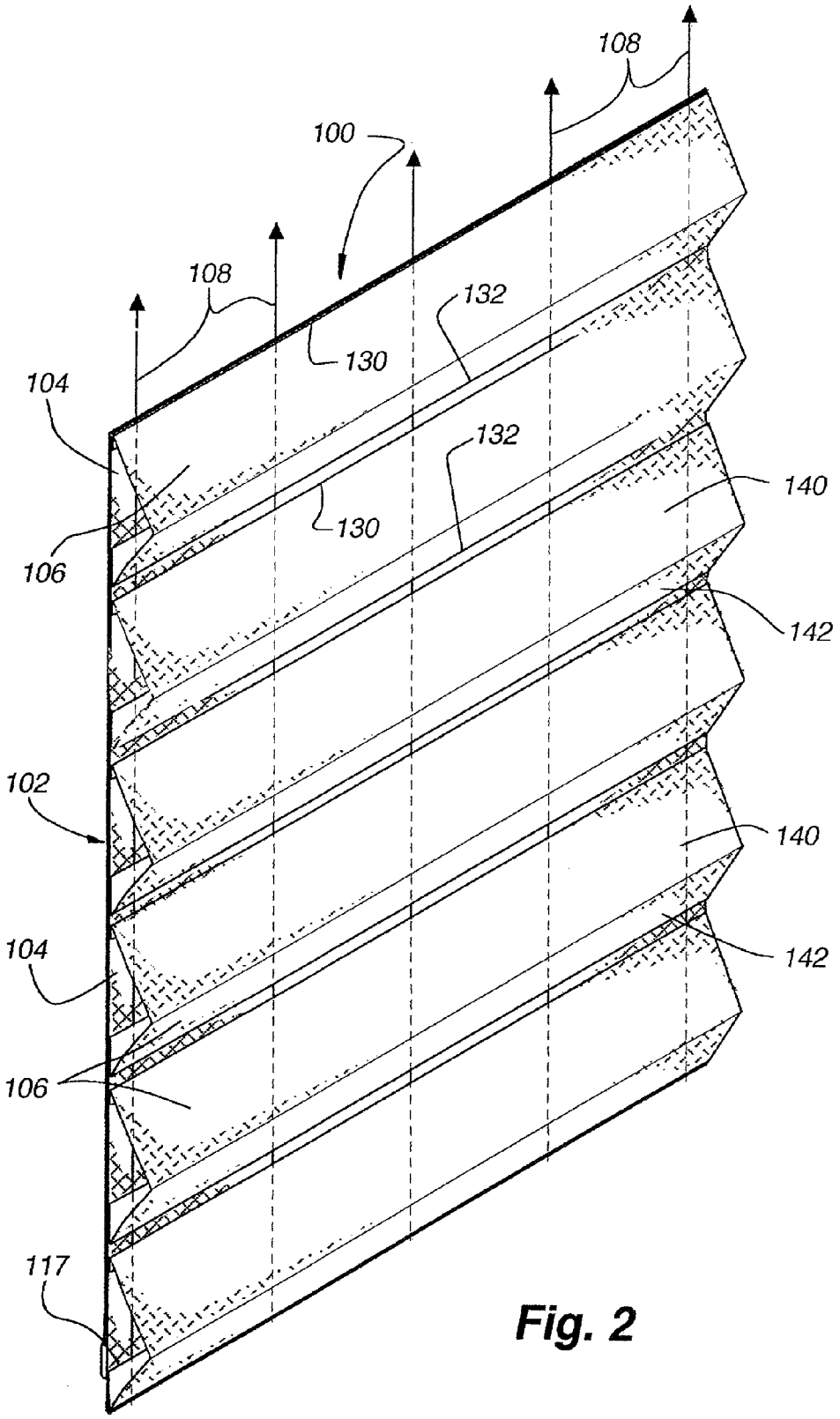
FIG. 2 is an isometric view of the panel shown in FIG. 1 with the covering in a fully extended position.
Figure 3:
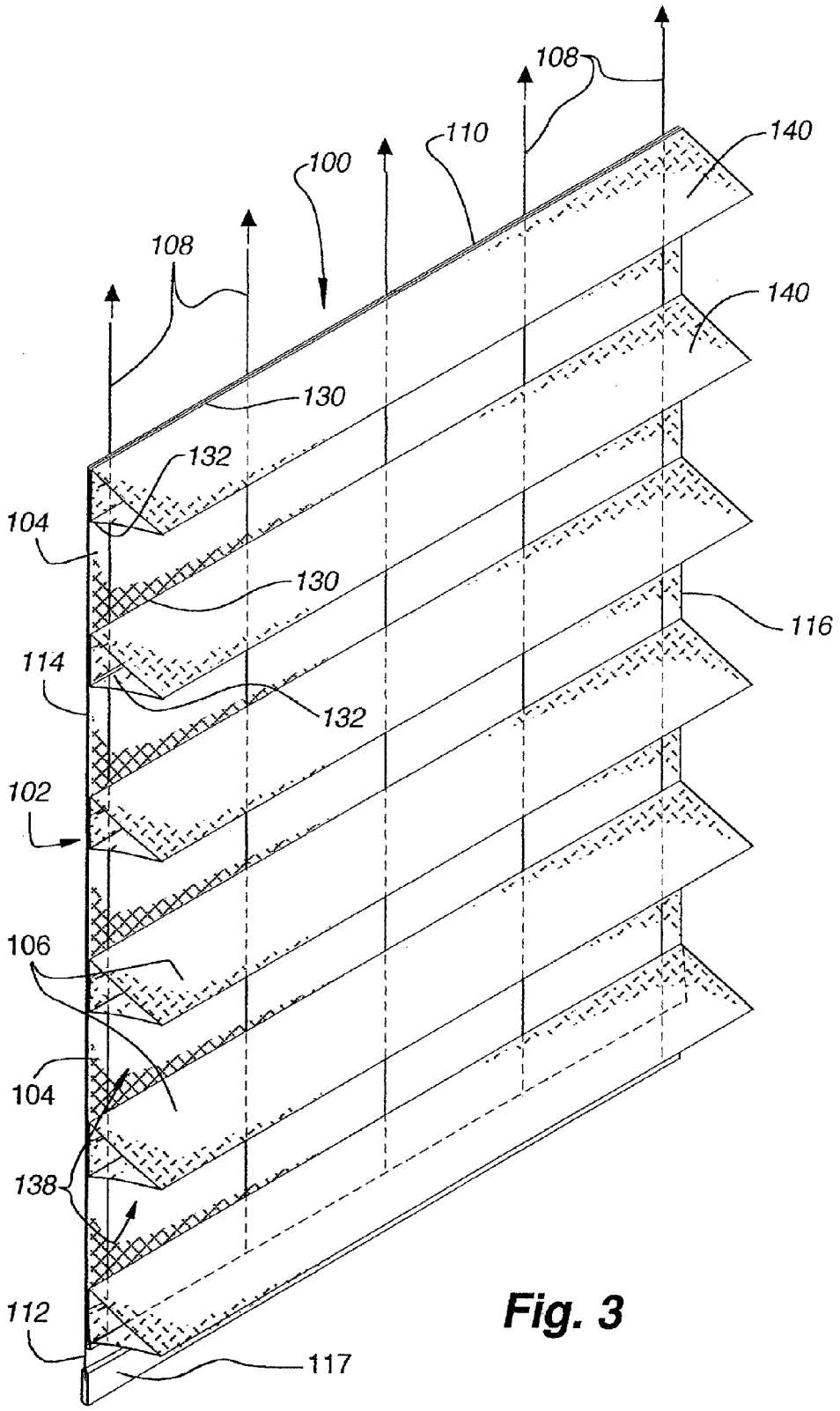
FIG. 3 is an isometric view of the panel of FIG. 1 in a fully opened and extended position.

A first embodiment 100 of a panel and covering for an architectural opening in accordance with the present invention is shown in FIGS. 1-16. The panel 102 for the covering can be seen to include a support structure 104, a plurality of vanes 106 connected to the support structure and operating elements 108 for moving the vanes between open and closed positions. The support structure in the first disclosed embodiment is in the form of a flexible sheet of sheer fabric even though a flexible sheet or sheets of other materials of various structures and transparencies could be used. The sheet is of rectangular configuration having a top 110 and bottom 112 edge and left 114 and right 116 side edges with a weighted bottom rail 117 being secured to the bottom edge 112. As probably seen best in FIGS. 5-8, the support sheet 104 is suspended along its top edge 110 from a generally cylindrical roller 118 disposed in a headrail 120 for the covering (FIGS.

4-6) with the roller being mounted for selective reversible rotative movement about a horizontal central axis in a conventional manner. The roller 118, headrail 120 and panel 102 comprise the covering 122 of the present invention.

The roller 118 is provided with first 124 and second 126 identical circumferentially spaced axially extending grooves which open through the periphery of the roller with the first groove supporting the top edge 110 of the support sheet 104. The top edge of the support sheet may be hemmed so a rod can be inserted through the hem and longitudinally into the groove where it is retained by a pair of lips defined in the periphery of the roller where the groove opens through the periphery. The lips are spaced a smaller distance apart than the diameter of the rod so that the rod and the hemmed top edge 110 of the support sheet are confined within the groove 124.

The plurality of elongated vanes or sheets of material 106 are horizontally suspended from a front face of the support sheet 104 at vertically spaced locations. Each vane is of rectangular configuration and is made of a semi-rigid material having a crease line 128 substantially along a longitudinal centerline of the vane material. Each vane has a top edge 130 and a bottom edge 132 parallel with the crease line with the top edge having a rectangular inwardly downturned tab 134 formed therealong that is secured to the support sheet in a manner to be described hereafter. The bottom edge 132 of each vane has a rectangular inwardly upturned tab 136 and is slidably related to the support sheet as will also be made more clear hereafter. The exposed or front face of each vane, between the tabs 134 and 136, has a width such that each vane overlaps the adjacent underlying vane when the covering is in the closed position of FIGS. 1, 5, 6, and 9-13. In the closed position, each vane can be seen to be substantially flat and parallel with the support sheet 104.

The panel 102 and covering 122 further include the plurality of flexible, vertically extending operating elements 108 which are horizontally spaced across the width of the panel with the upper ends of the operating elements being secured to the roller 118 in the second groove 126. This attachment is made by tying the upper ends of each flexible operating element to a rod that is inserted in the second groove. Each flexible operating element hangs vertically the entire height of the panel and is secured at spaced locations along its length to the bottom or lower edge 132 of each vane so that if the operating elements are lifted, the lower edge of each vane is lifted synchronously toward the top or upper edge 130 so as to define a gap or open space 138 (FIG. 3) between vanes through which vision and light are permitted. As will be appreciated, since each vane is made of a semi-rigid material and has a crease or fold line along its longitudinal center, movement of the bottom edge 132 toward the top edge 130 causes the vane to fold or expand forwardly as seen for example in FIGS. 2 and 3 defining upper 140 and lower 142 rectangular pivotally connected segments of the vane. The vane in cross section passes from being planar in the closed position of FIG. 1 to triangular in the open position of FIGS. 2 and 3. The flexible operating elements 108 as shown are monofilaments but can assume other various forms including but not limited to strips of fabric or other material, cords of synthetic or natural fibers or the like. The vanes 106 themselves can also be made of any suitable material including but not limited to woven or nonwoven fabrics, vinyls, or other such materials.

Figure 14:
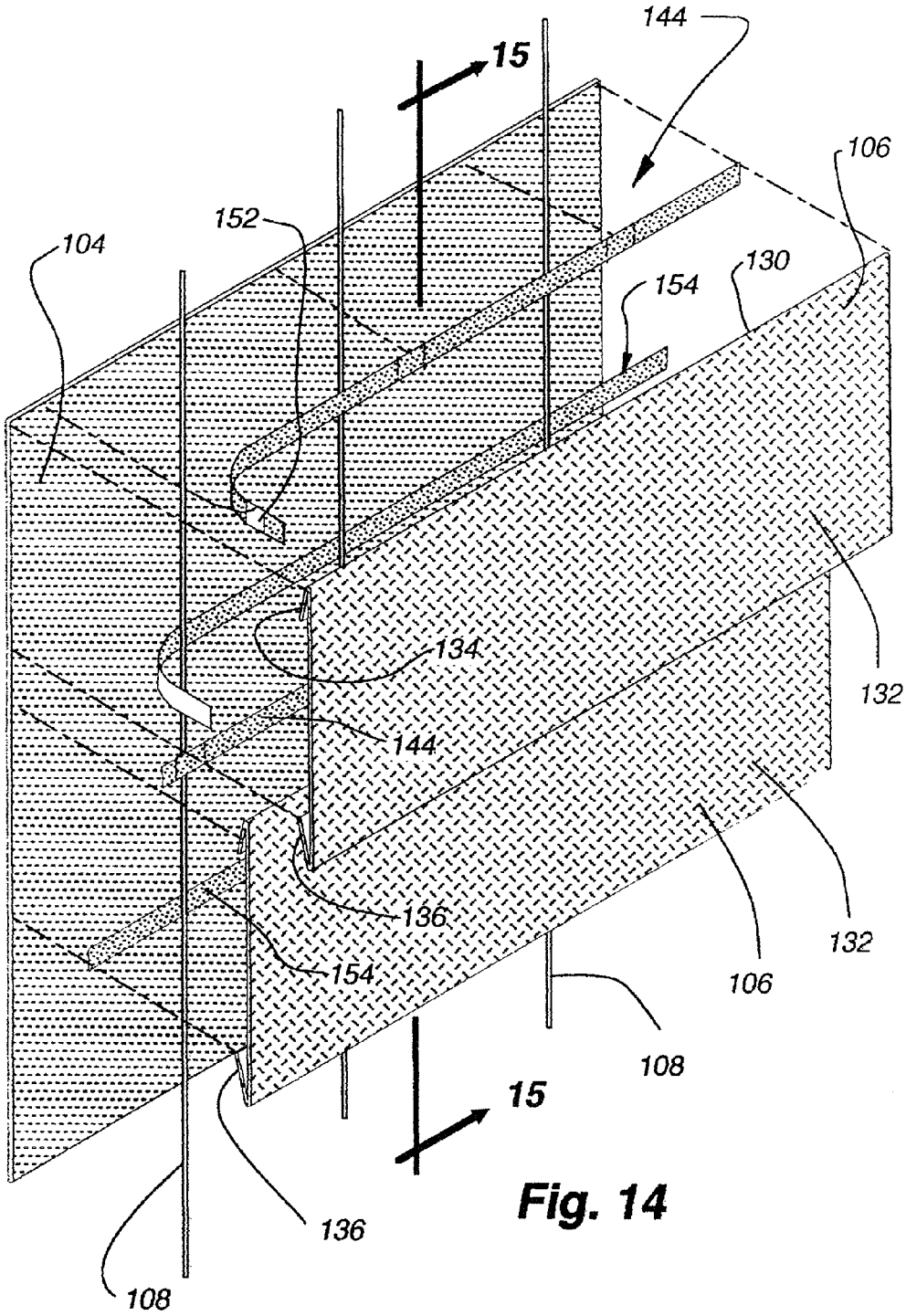
FIG. 14 is a fragmentary exploded isometric showing the various component parts of a portion of the panel of FIG. 1.
Figure 16:
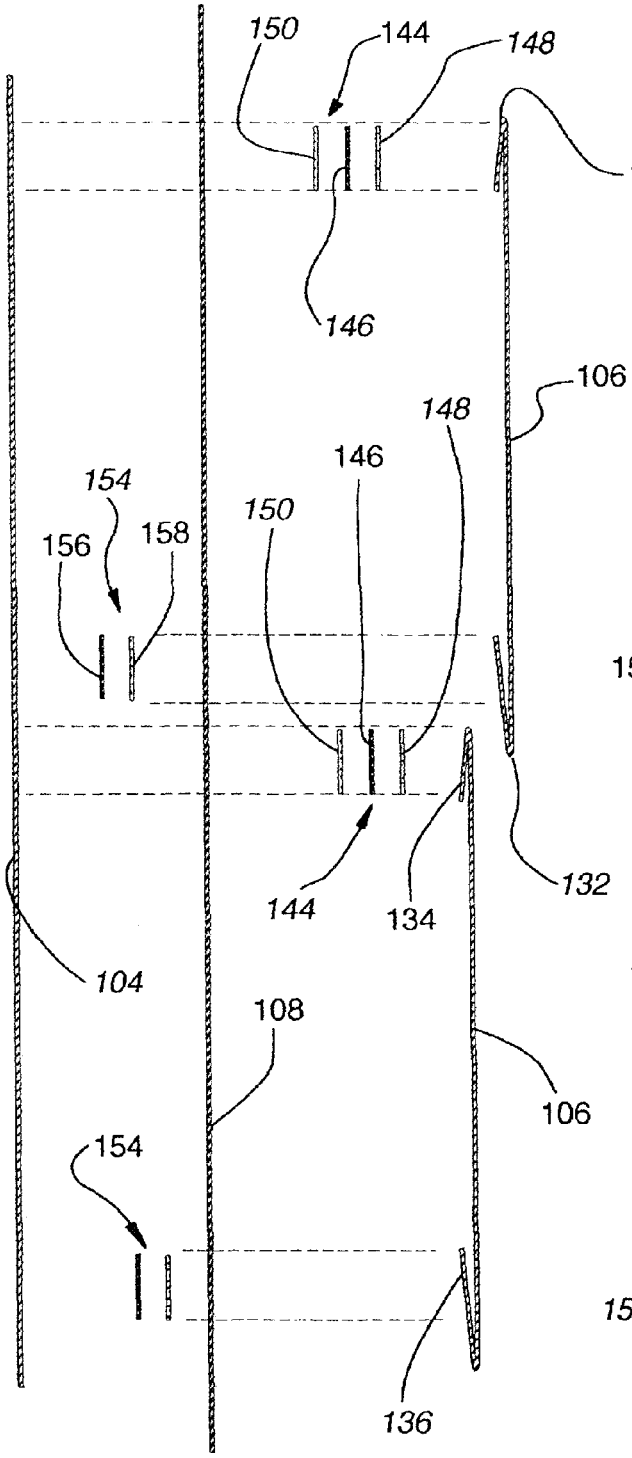
FIG. 16 is a view similar to FIG. 15 with the component parts further exploded.
Figure 15:
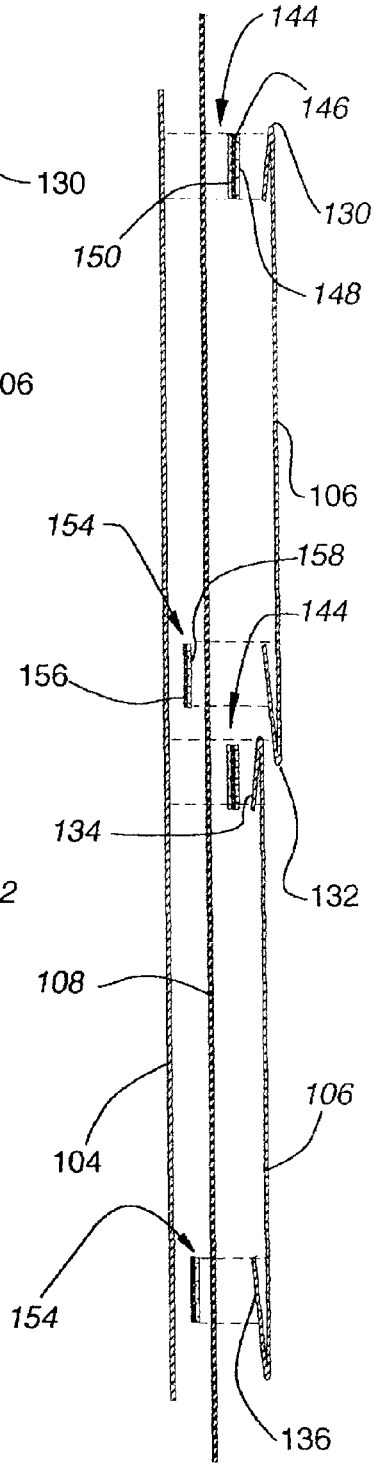
FIG. 15 is a section taken along line 15-15 of FIG. 14.

The top edge 130 of each vane is connected to the support sheet 104 in a manner probably best illustrated in FIGS. 14-16. An attachment strip 144 is utilized to connect the tab 134 along the top edge of each vane to the support sheet with the attachment strip extending the full width of the panel 102 or covering 122 and having a height that is substantially commensurate with the height of the tab 134. The attachment strip has a core or base material 146 of the full dimension of the attachment strip 144 and has double-faced adhesive strips on the front and back face thereof. On the front face of the base material 146, there is a continuous strip 148 of double-faced adhesive which is adhered to the base material along its entire length and also to the rear face of the tab 134 at the top of the associated vane along its entire length. On the back face of the base material 146, however, there are a plurality of longitudinally aligned double-faced adhesive strips 150 that are secured to the back face of the base material at intervals so as to define gaps or spaces 152 therebetween where there is no adhesive. The adhesive strips on the back face of the base material are secured to the front face of the support sheet 104 in a manner such that the operating elements 108 extend slidably past the interrupted line of connection between the top edge of a vane and the support sheet by extending through an associated gap or space 152.

The lower edge 132 of each vane is connected to each operating element 108 with an attachment strip 154 that also has a core or base material 156 extending the full width of the panel 102 and a height that is slightly smaller than the height of the associated tab 136 on the lower edge of the vane. The base material 156 has a continuous strip 158 of double-faced adhesive on its front face and is secured to the tab 136 on the bottom edge of the vane while adhesively trapping the operating elements 108 therebetween. In this manner, it will be appreciated that the operating elements are secured at spaced locations to the tabs 136 along the lower edge of each vane but slidably pass through the interrupted line of attachment of the top edge 130 of each vane to the support sheet 104. This system for attachment of the vanes to the support sheet and operating elements is probably best seen in FIGS. 12, 13, 15, and 16.

Figure 10:
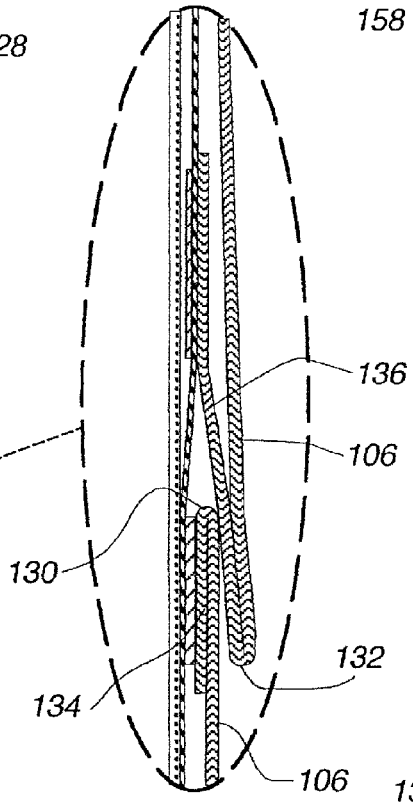
FIG. 10 is an enlarged view of the portion of the panel encircled in FIG. 9.
Figure 11:
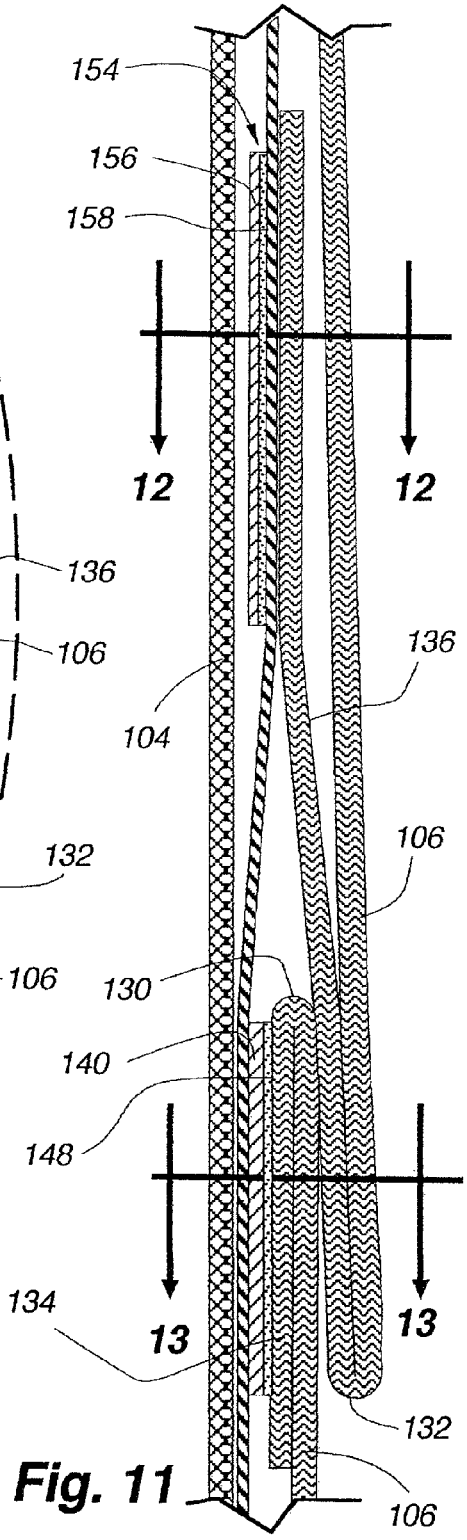
FIG. 11 is a further enlarged fragmentary section of the same area illustrated in FIG. 10.
Figure 12:
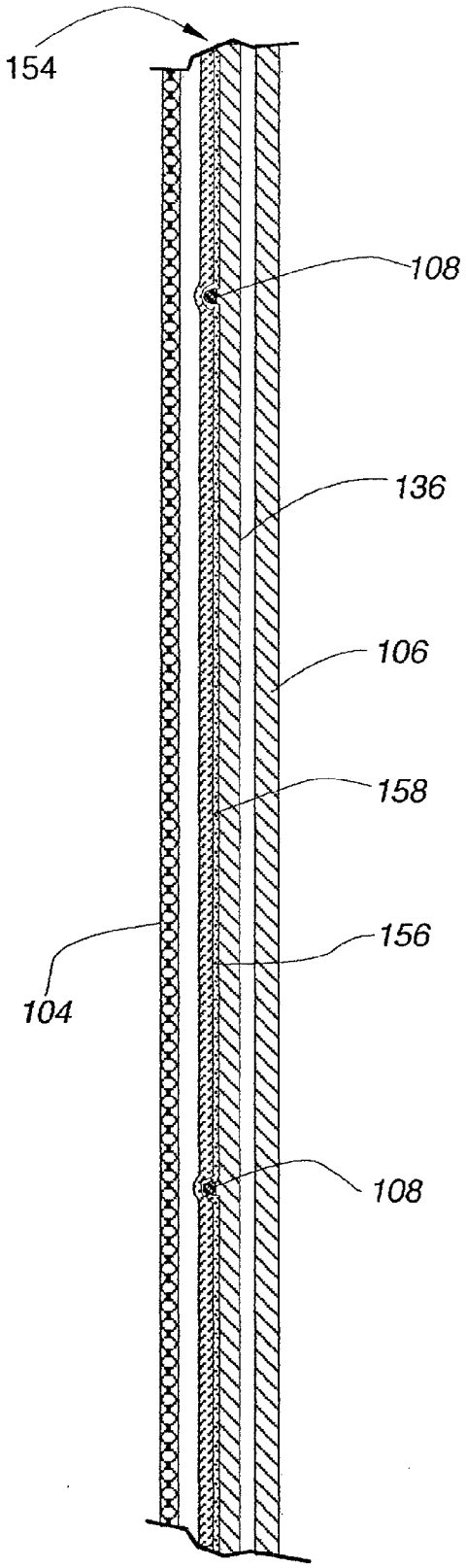
FIG. 12 is a fragmentary section taken along line 12-12 of FIG. 11.
Figure 13:
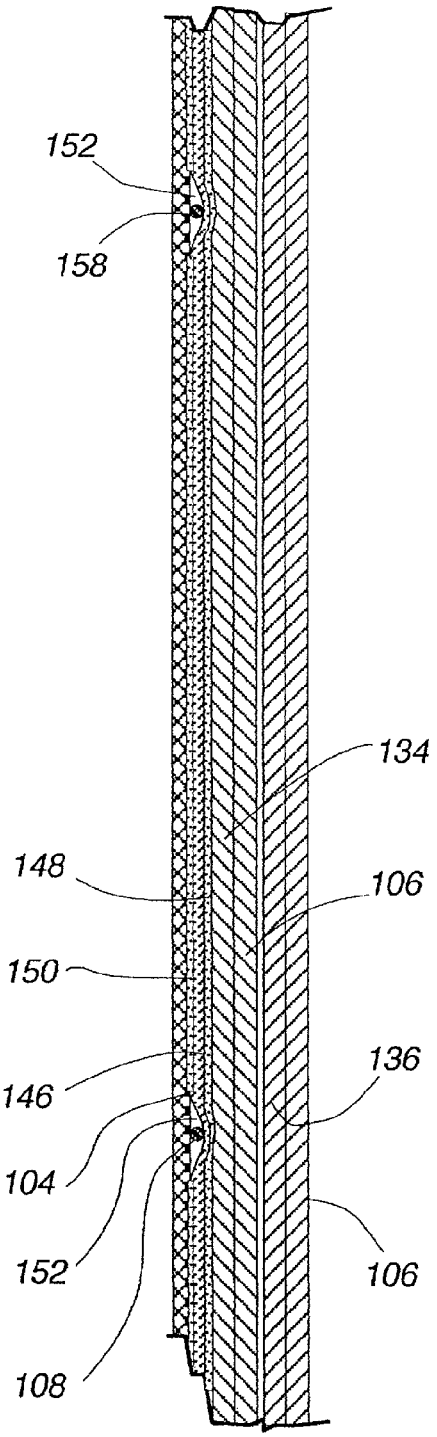
FIG. 13 is a fragmentary section taken along line 13-13 of FIG. 11.

As is probably best appreciated by reference to FIGS. 10 and 11, the tab 134 at the top of each vane 106 has a slightly smaller height than the tab 136 at the lower edge of each vane and the tab at the lower edge of each vane in the closed position of the panel, overlaps the top edge of the immediately underlying vane. In this manner, when the panel 102 is in the closed position of FIGS. 1 and 9-11, vision and light through the panel is completely blocked.

Figure 4:
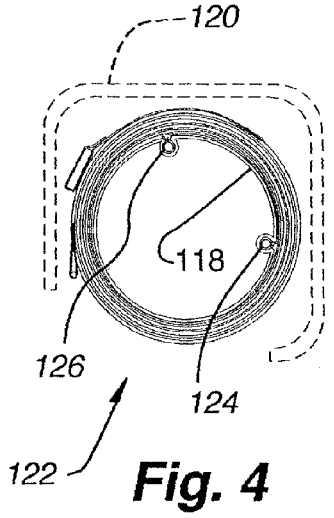
FIG. 4 is a vertical section taken through a roller having the panel of the present invention wrapped therearound in a fully retracted position.
Figure 6:
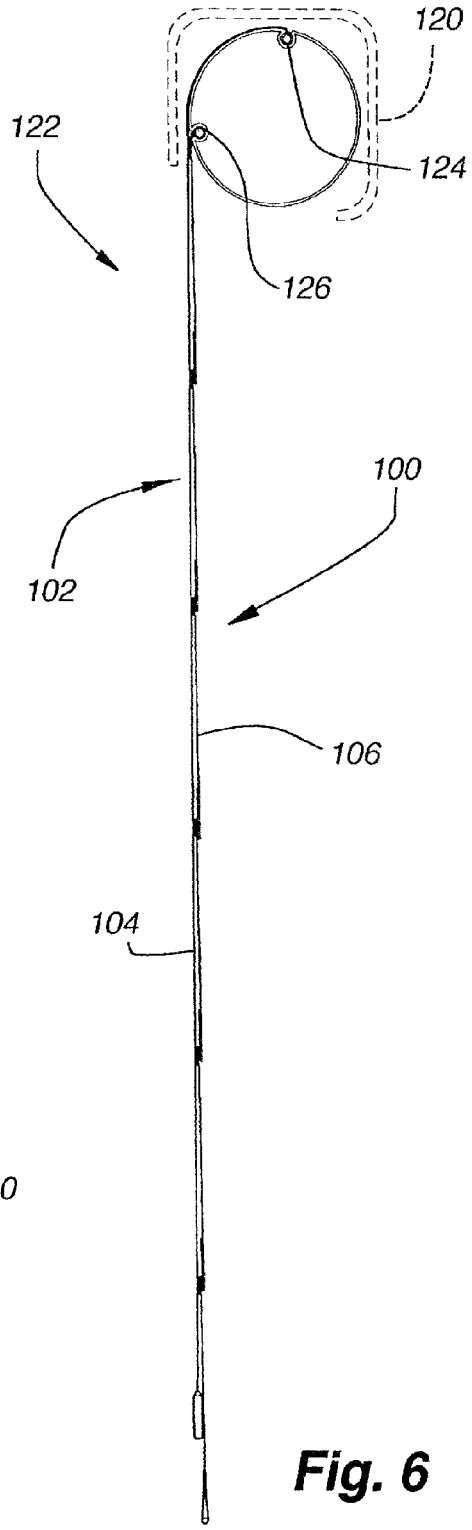
FIG. 6 is a view taken along line 6-6 of FIG. 1 showing the panel fully extended but closed.
Figure 5:
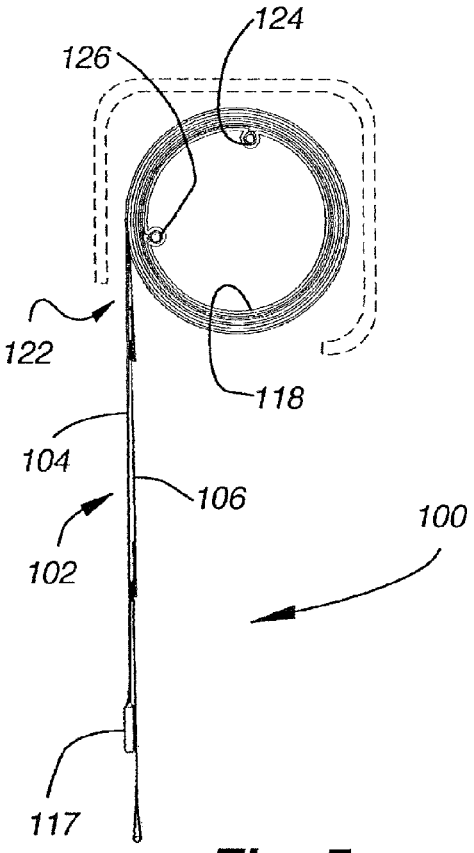
FIG. 5 is a vertical section similar to FIG. 4 with the panel partially extended from the roller.
Figure 7:
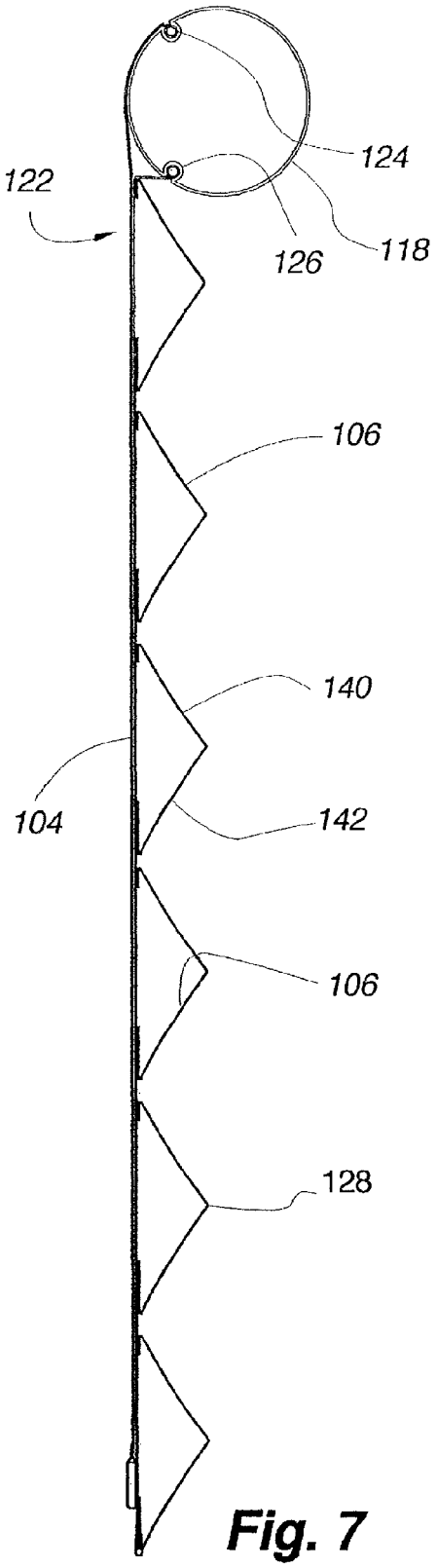
FIG. 7 is a side elevational view of the panel as shown in FIG. 2.

The operation of the panel 102 and covering 122 is probably best illustrated in FIGS. 4-8. In FIG. 4, the panel is shown fully retracted and completely wrapped around the roller 118 with the lower edge of the panel being positioned along the back side of the roller. As the roller is rotated in a counterclockwise direction, as viewed in FIGS. 4-8, the panel, in its closed position, drops by gravity with each vane 106 being substantially flat and overlapping the next adjacent lower vane. The panel remains in this flat closed orientation until the covering reaches the nearly fully extended position of FIG. 6 at which point the attachment groove 124 of the support sheet 104 to the roller is at the top of the roller and the attachment groove 126 of the operating elements 108 is at the rear of the roller. Further counterclockwise rotational movement of the roller to the position of FIG. 7 shows the operating elements being pulled upwardly relative to the support sheet by the forward movement of the second groove 126 in which the operating elements are anchored and as the operating elements are lifted relative to the support sheet, they simultaneously lift the lower edge 132 of each vane causing the vane to fold or buckle outwardly with the lower edge of each vane being separated from the upper edge 134 of the next adjacent lower vane. Continued counterclockwise rotation of the roller to the position of FIG. 8, which is the limit of its counter-clockwise rotation causes the second groove 126 to be disposed near the front of the roller having lifted the bottom edge of each vane as far as it will be lifted so the panel and covering are in their fully opened positions and with the gaps 138 between vanes maximized. In the fully opened position, the vanes 106 are seen to be shaped like an isosceles triangle in cross section.

Figure 8:
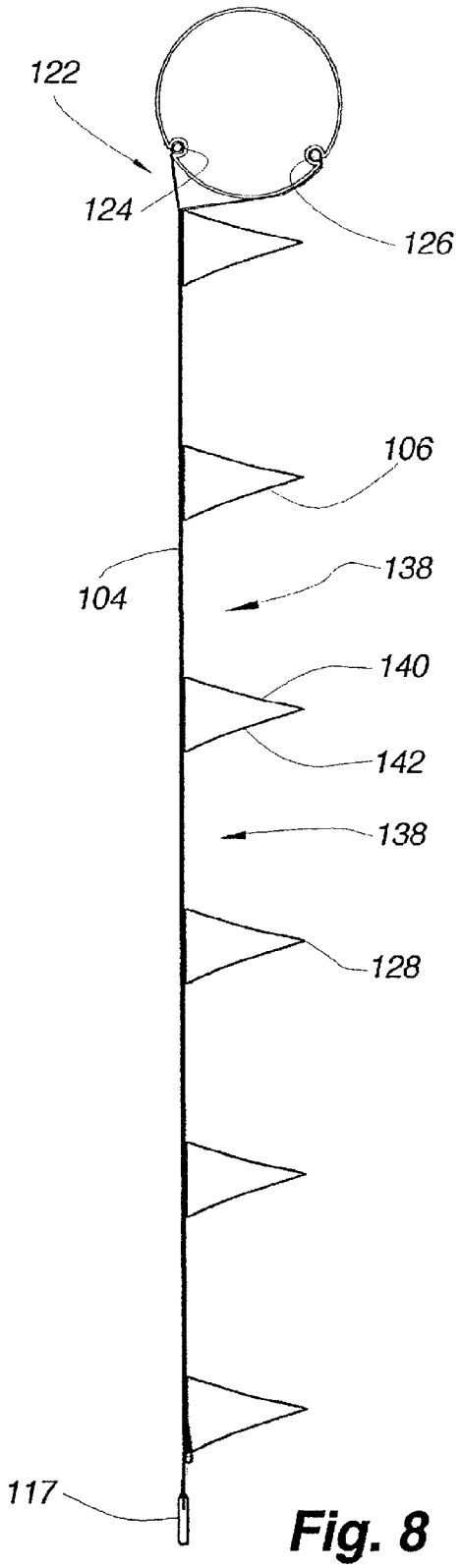
FIG. 8 is a side elevational view of the panel as shown in FIG. 3.
Figure 9:
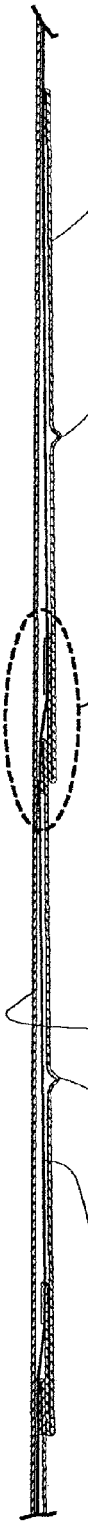
FIG. 9 is an enlarged fragmentary section taken along line 9-9 of FIG. 1.

In a reverse rotation of the roller 118, i.e. in a clockwise direction from the position of FIG. 8, the second groove 126 will initially move to the position of FIG. 7 allowing the lower edge 132 of each vane to drop by gravity to the position of FIG. 6 where the vanes are entirely closed and in a substantially coplanar relationship with the support sheet 104. Continued clockwise rotation causes the panel in its closed condition to be wrapped around the roller until it again assumes the retracted position of FIG. 4.

It will be appreciated from the above that the covering 122 can be fully retracted, as illustrated in FIG. 4, or lowered with the vanes in their fully closed position to any desired degree until the panel is fully extended as shown in FIG. 6, but with the vanes 106 closed. Further rotation of the roller 118 causes the vanes themselves to open defining the gaps 138 therebetween through which vision and light is allowed through the panel. As will be appreciated, the vanes can only be opened when the panel 102 is fully extended even though with the vanes closed, the degree of extension of the panel across the architectural opening can be to any desired degree.

Figures 17, 18, 19:
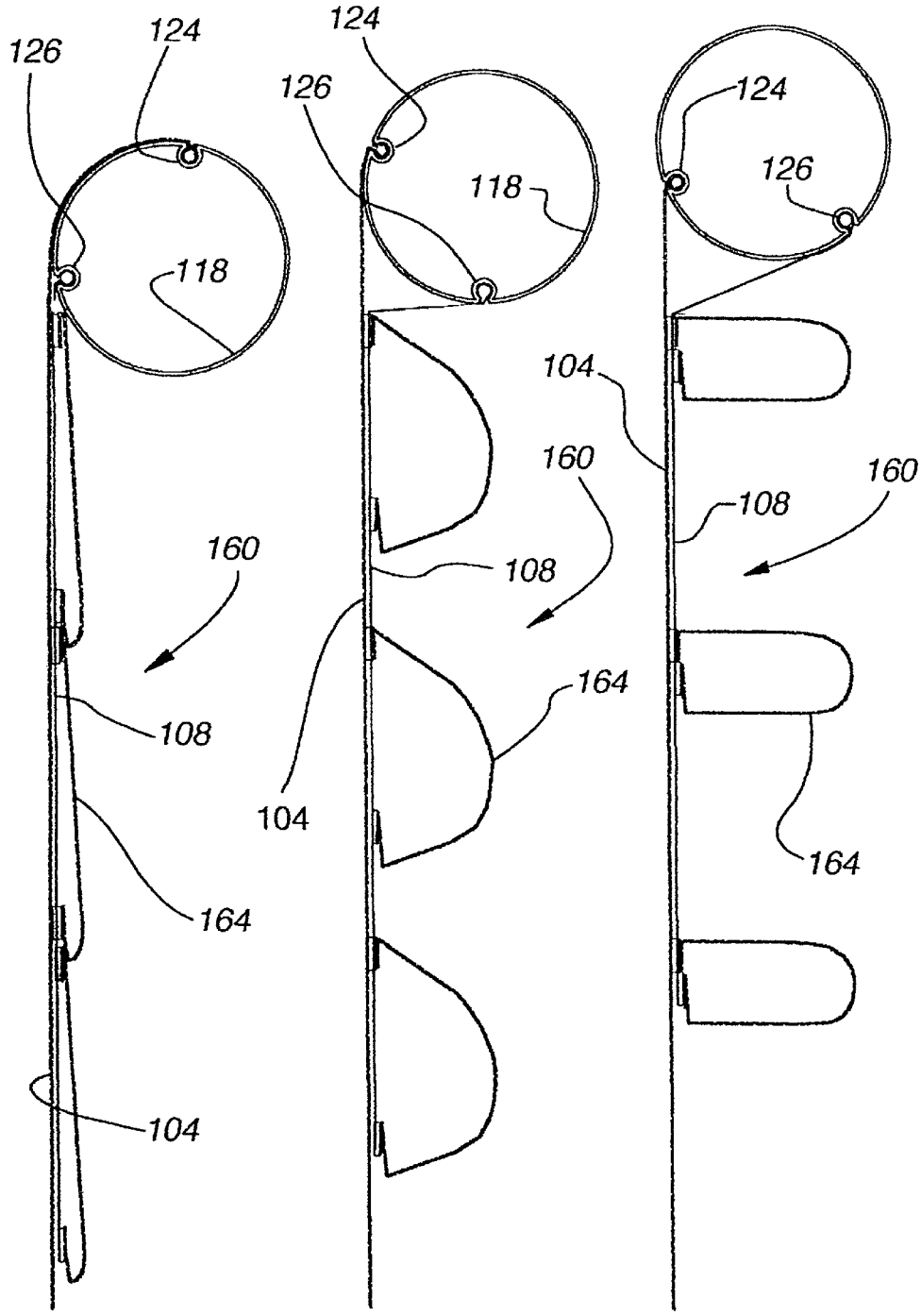
FIG. 17 is a side elevational view of a second embodiment of a covering in accordance with the present invention in a closed but extended position.
FIG. 18 is a side elevation of the embodiment shown in FIG. 17 with the vanes partially opened.
FIG. 19 is a vertical section similar to FIGS. 17 and 18 with the vanes fully opened.

A second embodiment 160 of the invention is illustrated in FIGS. 17-19 where again a covering includes a roller 118 to which the support sheet 104 is connected as well as the operating elements 108 in the same manner as in the first-described embodiment. In this embodiment, however, vanes or strips of material 164 while still made of a somewhat semi-rigid material, do not have a fold or crease line so when the vanes are moved from the closed position of FIG. 17, wherein they droop but are in closely spaced relationship with the support sheet, toward an open position, they expand forwardly in a substantially symmetric manner through the partially opened position of FIG. 18 to a fully opened position of FIG. 19. It will be seen that due to the nature of the semi-rigid material from which the vanes are made, they will project or extend substantially horizontally away from the support sheet.

Figure 20:
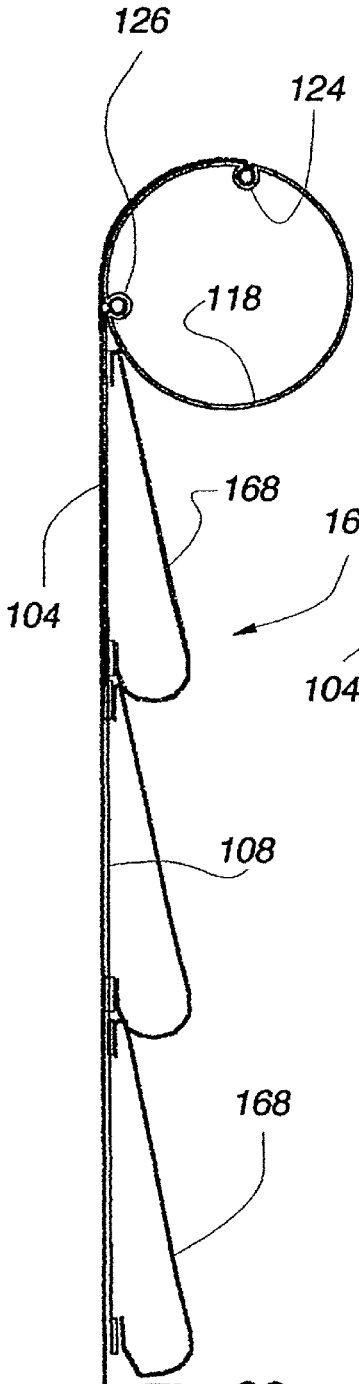
FIG. 20 is a side elevation of a third embodiment of the covering of the present invention with the vanes in a closed position.
Figure 21:
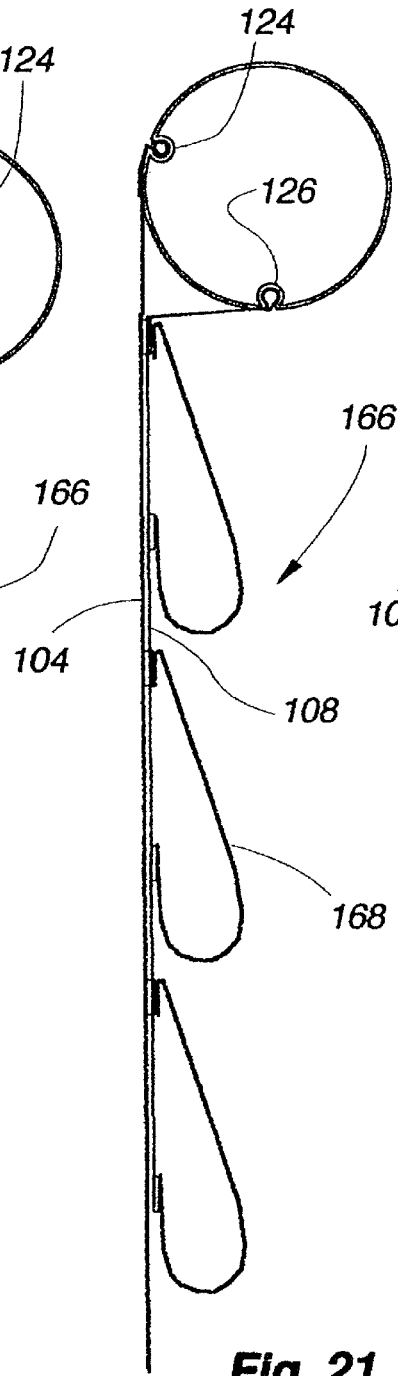
FIG. 21 is a side elevation similar to FIG. 20 with the vanes in a partially opened position.
Figure 22:
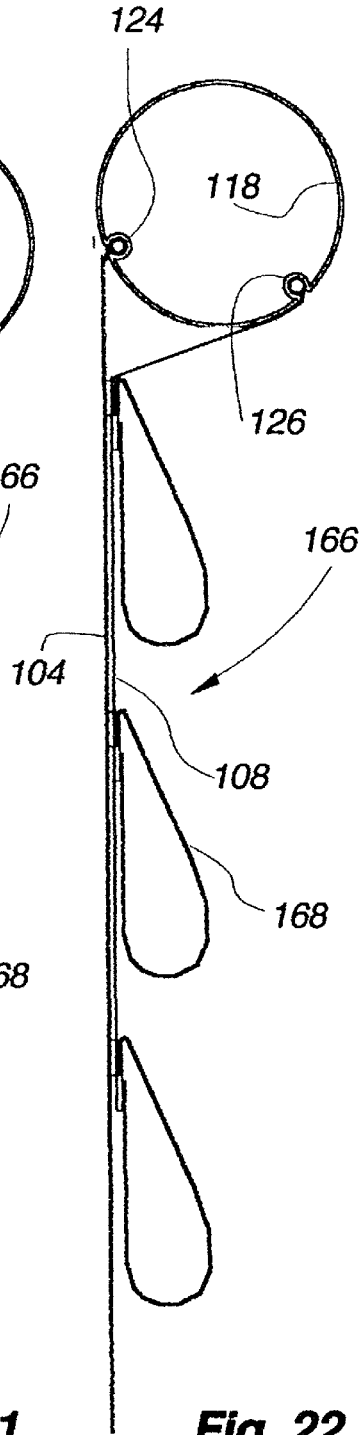
FIG. 22 is a side elevation of the panel of FIGS. 20 and 21 with the vanes in a fully opened position.

A third embodiment 166 of the present invention is illustrated in FIGS. 20-22 and it will there be seen that a roller 118 is again provided with two attachment grooves 124 and 126 and with the support sheet 104 attached to one groove 124 and the operating elements 108 to the second groove 126. Vanes or strips of material 168 are again connected to the support sheet and operating elements in the same manner as in the first and second embodiments, but the vane material is not as rigid. Rather, the vane material is a somewhat flexible material so as to droop downwardly regardless of whether or not the vanes are closed or open. In the closed position illustrated in FIG. 20, the lowermost extent of each vane overlaps the uppermost extent of the next adjacent lower vane, but as the vanes are partially opened, the lower edge of each vane is lifted to some degree so a gap 138 is established between the vanes. When the lower edge of each vane is fully lifted as shown in FIG. 22, the gap between vanes is larger than in the partially opened position of FIG. 21 but the spacing is not as great as for example in the first and second-described embodiments.

Figure 23:
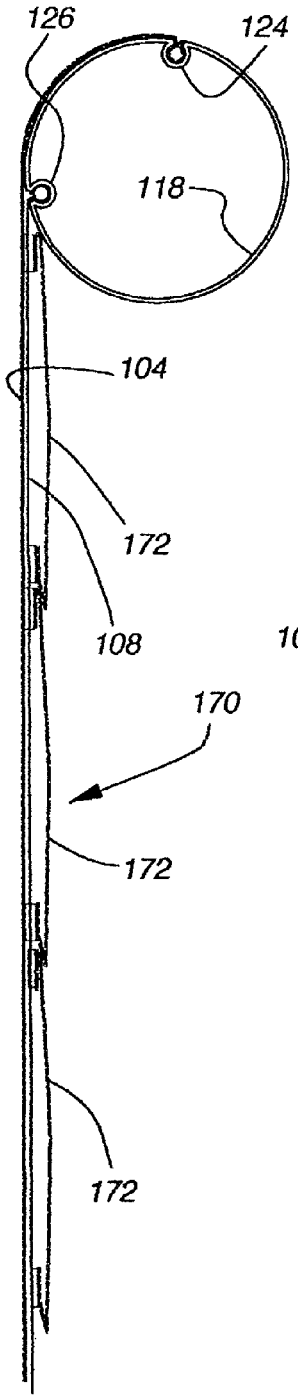
FIG. 23 is a side elevation of a fourth embodiment of the present invention with the vanes in a fully closed position.
Figure 24:
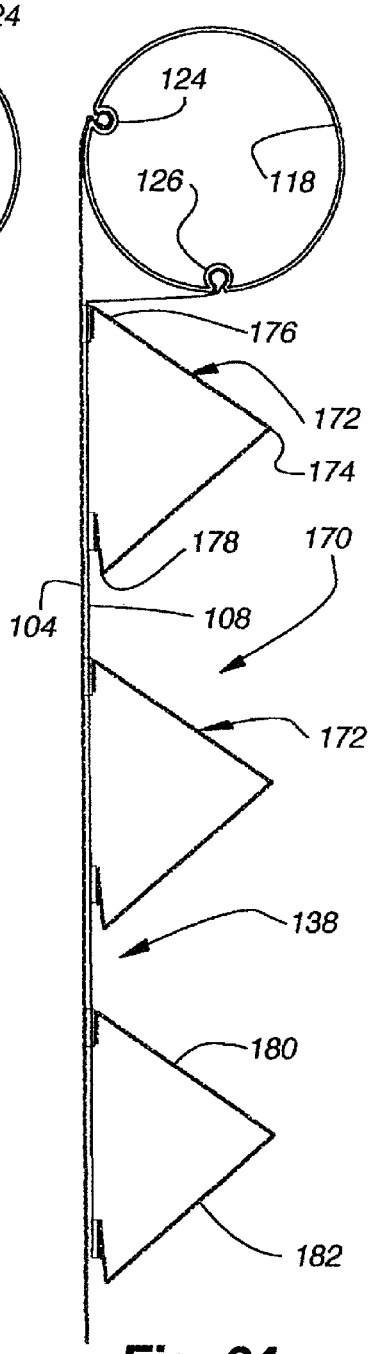
FIG. 24 is a side elevation similar to FIG. 23 with the vanes in a partially opened position.

In a fourth embodiment 170 of the covering as illustrated in FIGS. 23-24, a roller 118 is provided with circumferentially spaced attachment grooves 124 and 126 with a support sheet 104 attached in one groove 124 and the operating elements 108 in the other groove 126. In this embodiment, the vanes 172 are again connected to the support sheet and operating elements as described in the previous embodiments and the vanes are made of a semi-rigid material and shaped similarly to that of the first-described embodiment shown in FIGS. 1-16 except a horizontal, longitudinally extending fold or crease line 174 is closer to the top edge 176 of the vane than the bottom edge 178. Accordingly, the vanes are again divided into top 180 and bottom 182 rectangular segments but wherein the top segment is slightly smaller than the bottom segment.

Figure 25:
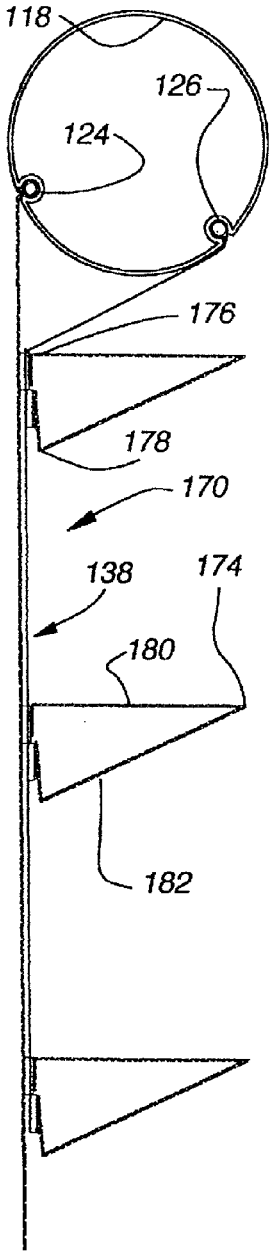
FIG. 25 is a side elevation similar to FIGS. 23 and 24 with the vanes fully opened.

When the vanes are moved from the closed position of FIG. 23 through the partially opened position of FIG. 24 to the fully opened position of FIG. 25, the vanes substantially define a right triangle in cross section as opposed to the isosceles triangle formed in the first-described embodiment.

Figures 26, 27, 28:
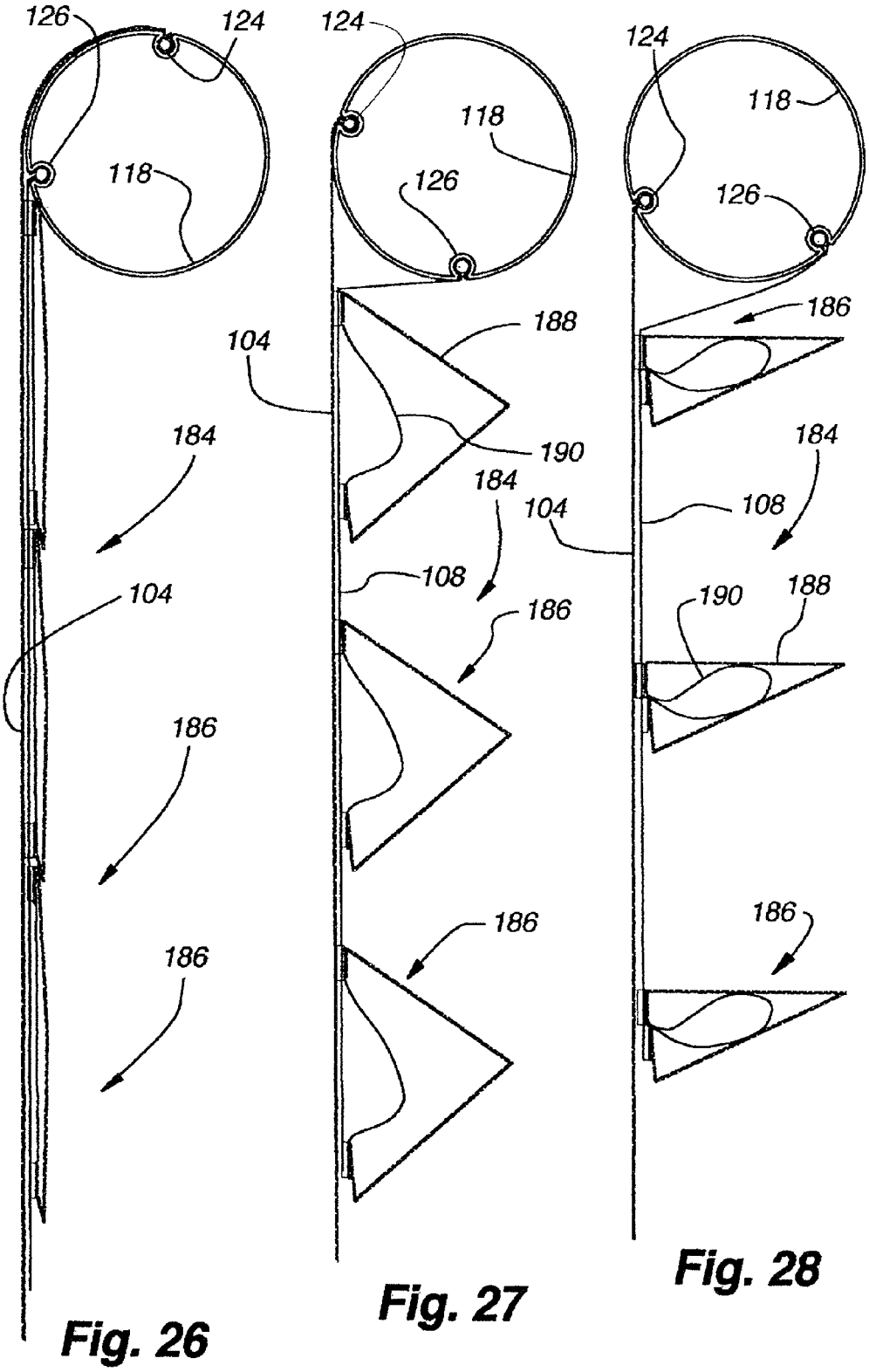
FIG. 26 is a side elevation of a fifth embodiment of the present invention with the vanes in a fully closed position.
FIG. 27 is a side elevation similar to FIG. 26 with the vanes in a partially opened position.
FIG. 28 is a side elevation similar to FIGS. 26 and 27 with the vanes in a fully opened position.

A fifth embodiment 184 of the covering of the present invention is illustrated in FIGS. 26-28. In this embodiment, again a roller 118 is provided with first 124 and second 126 grooves for attachment of the support sheet 104 and the operating elements 108 and vanes 186 are attached to the operating elements as described in the previous embodiments. In this embodiment, however, each vane 186 has an outer strip of material 188 and an inner strip of material 190 with the outer strip of material being a semi-rigid material such as in the fourth-described embodiment of FIGS. 23-25 and the inner strip of material being a flexible material such as in the third-described embodiment of FIGS. 20-22. The inner flexible strip of material 190 is secured to the outer semi-rigid strip of material 188 along the top and bottom edges with the combined strips being connected to the support sheet 104 identically to the prior described embodiments so that again the operating elements 108 slide past the line of attachment of the top edge of each vane to the support sheet but are secured to the operating elements along the bottom edge of each vane. Accordingly, when the covering is moved from the closed position of FIG. 26, where the vanes are flat in substantially coplanar relationship with the support sheet, they move through the partially opened position of FIG. 27 to the fully opened position of FIG. 28 where the flexible strip of material is confined within the outer semi-rigid strip of material used in the vanes establishing closed cells between the strips of material. The cells are of course open at their ends adjacent to opposite sides 114 and 116 of the support sheet. This embodiment allows for variation in functional characteristics and aesthetics of the covering and by way of example the inner flexible strip of material could be an opaque material while the outer semi-rigid material could be a translucent or clear material such that vision between the vanes is permitted in the fully open position of FIG. 28 but fully blocked by the opaque inner material when in the closed position of FIG. 26. Other variations will also be readily apparent and by way of example, the inner and outer layers can be of different colors or transparencies to create different effects.

Figures 29, 30, 31:
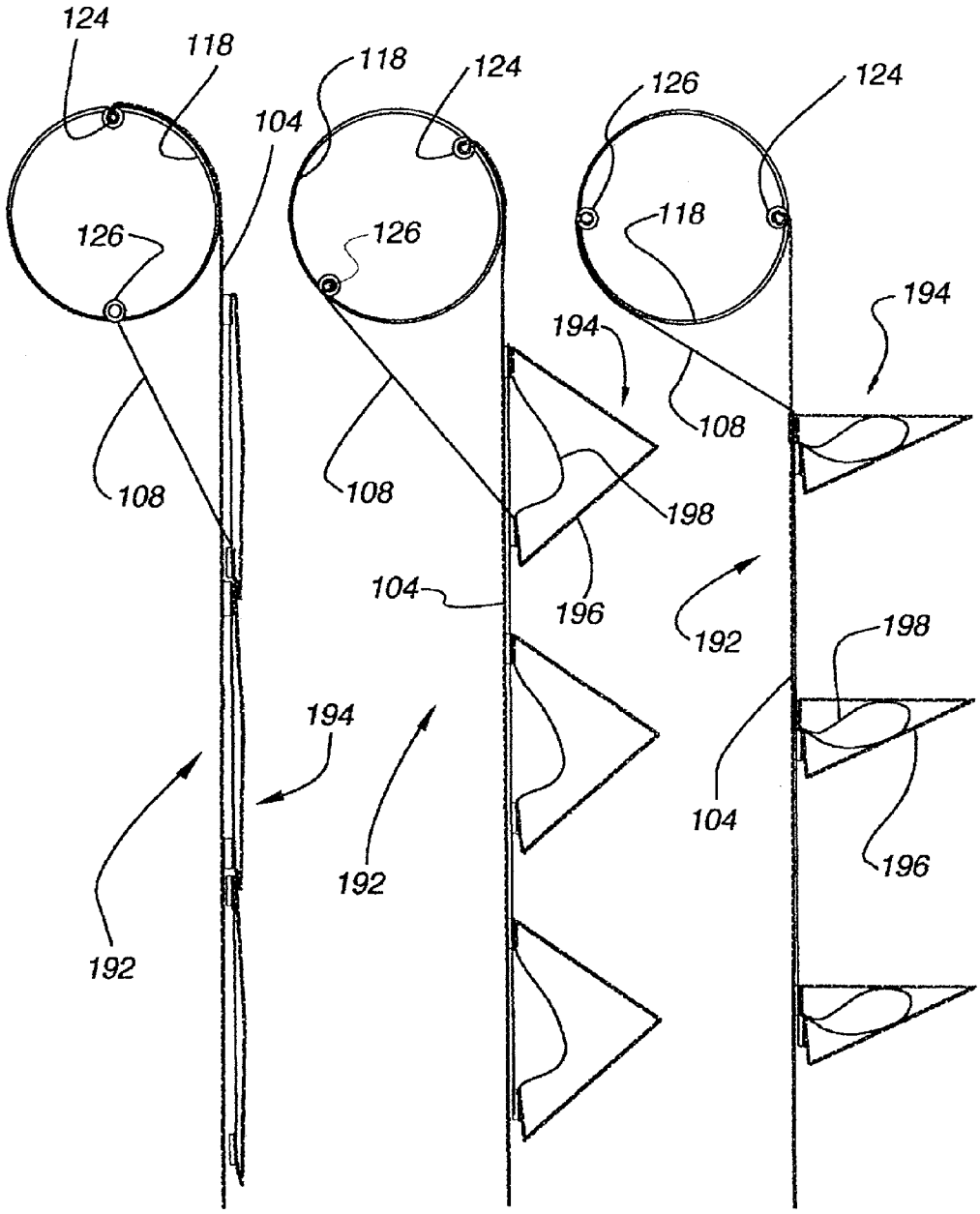
FIG. 29 is a side elevation of a sixth embodiment of the present invention with the vanes in a closed position.
FIG. 30 is a side elevation similar to FIG. 29 with the vanes in a partially opened position.
FIG. 31 is a side elevation of the embodiment of FIGS. 29 and 30 with the vanes in a fully opened position.

A sixth embodiment 192 of the invention is illustrated in FIGS. 29-30. This embodiment as will be appreciated is very similar to that of FIGS. 26-28 in that a roller 118 is again provided with first 124 and second 126 grooves, but the grooves are diametrically opposed and the support sheet 104 is suspended from the front of the roller as opposed to the back. Again, in this embodiment, the support sheet is secured to one groove 124 while the flexible operating elements 108 are supported in the other groove 126. The vanes 194 have an outer strip of material 196 which is semi-rigid and an inner strip of material 198 which is flexible and connected to the support sheet and operating elements identically to that of the embodiment of FIGS. 26-28. In this embodiment, the vanes are moved from the closed position of FIG. 29 where they are substantially coplanar with the support sheet through the partially open position of FIG. 30 to the fully opened position of FIG. 31 by clockwise rotation of the roller as opposed to counterclockwise.

Figure 32:
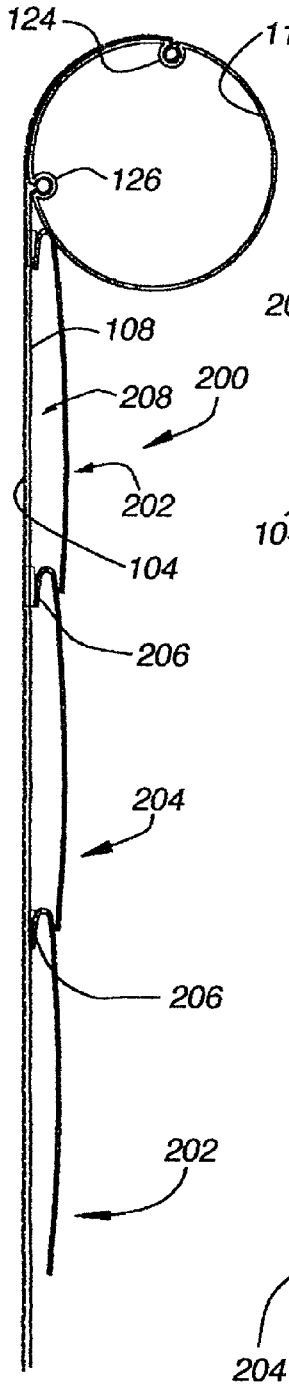
FIG. 32 is a side elevation of a seventh embodiment of the covering of the present invention with the vanes in a fully closed position.
Figure 33:
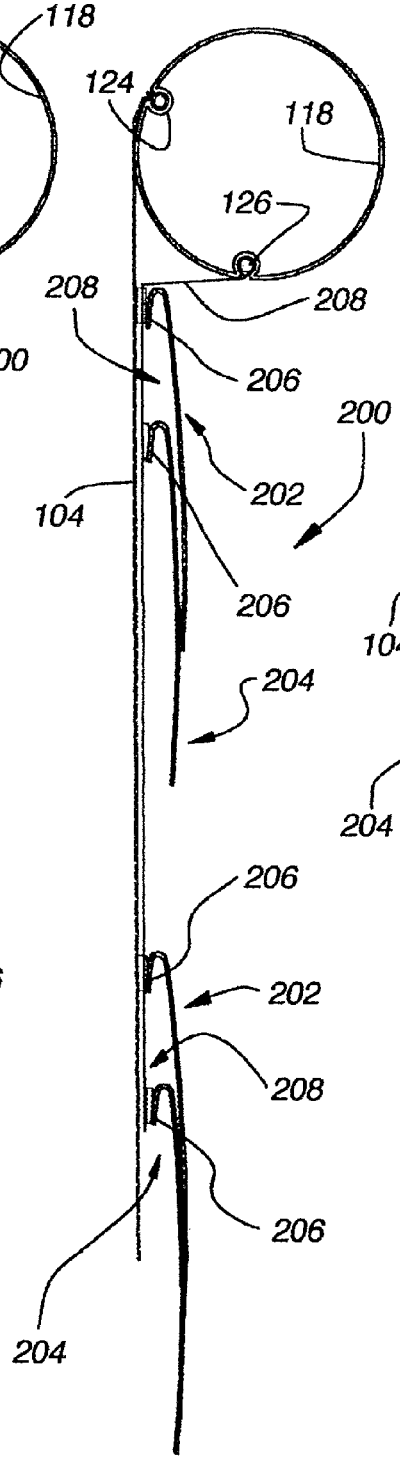
FIG. 33 is a side elevation similar to FIG. 32 with the vanes in a partially opened position.
Figure 34:
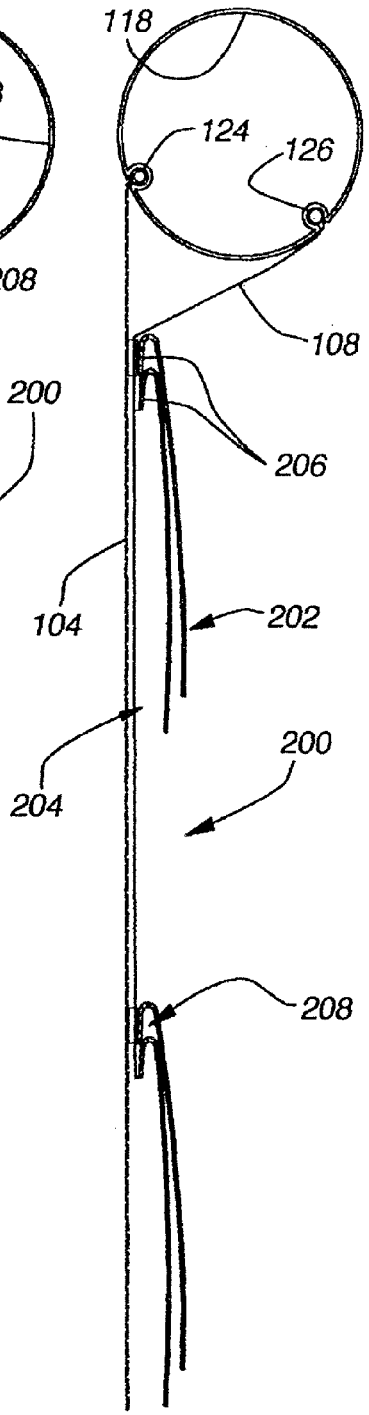
FIG. 34 is a side elevation similar to FIGS. 32 and 33 with the vanes in a fully opened position.

A seventh embodiment 200 of the invention is illustrated in FIGS. 32-34 and it will again be seen that a roller 118 having a pair of attachment grooves 124 and 126 supports the support sheet 104 from one groove 124 and operating elements 108 from the second groove 126. In this embodiment, the vanes 202 and 204 are simply strips of material having inwardly downturned tabs 206 along their upper edges and with the strips being slightly concave inwardly in transverse cross section. Beginning at the top of the panel for the covering and moving downwardly, every other vane 202 has the tab along its upper edge secured to the support sheet 104 as in the previously described embodiments so that the operating elements 108 are slidable through the interrupted line of connection. Beginning with the second vane 204 from the top, every other vane has its tab 206 along the top edge secured to the operating element 108 in the same manner as the bottom edges of the vanes in the prior described embodiments. In this manner, the covering can be moved from the completely closed position of FIG. 32 wherein each vane overlaps the next adjacent underlying vane through a partially opened position shown in FIG. 33, where every other vane commencing with the second vane from the top is lifted upwardly by the operating elements so that it slides into a pocket 208 defined between the next adjacent upper vane 202 and the support sheet 204. When the covering is fully opened as shown in FIG. 34, every other vane 204 commencing with the second to the top vane is substantially completely confined within the pocket 208 between the next adjacent upper vane 202 and the support sheet so as to define gaps or openings 138 between pairs of vanes 202 and 204 through which light and vision can pass.

Figures 35, 36, 37:
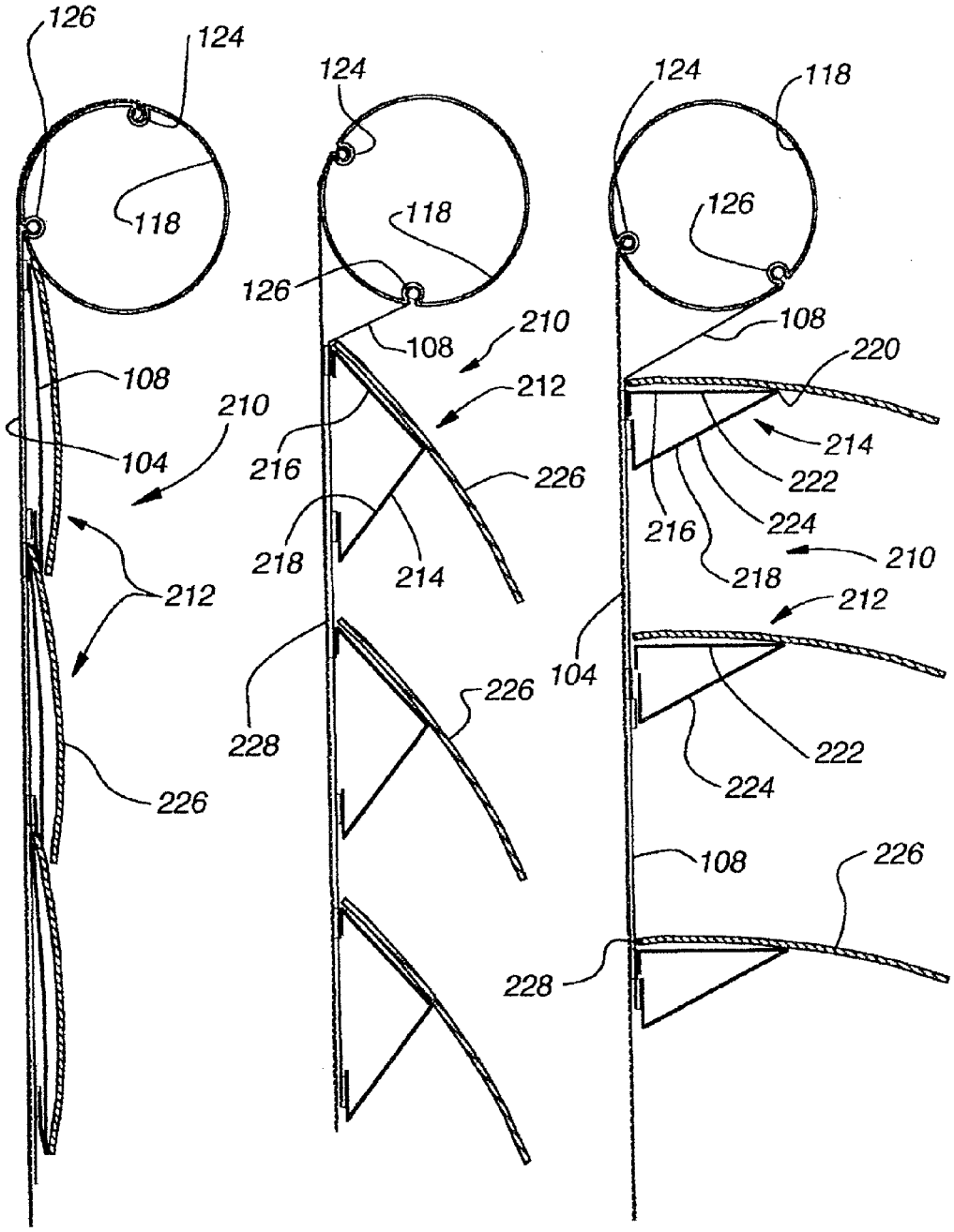
FIG. 35 is a side elevation of an eighth embodiment of the present invention with the vanes in a fully closed position.
FIG. 36 is a side elevation similar to FIG. 35 with the vanes in a partially opened position.
FIG. 37 is a side elevation similar to FIGS. 35 and 36 with the vanes in a fully opened position.

An eighth embodiment 210 of the covering of the present invention is illustrated in FIGS. 35-37 where again it will be appreciated that a roller 118 has two circumferentially spaced attachment grooves 124 and 126 with one groove 124 supporting the support sheet 104 and the other groove 126 a plurality of operating elements 108. In this embodiment, the vanes 212 are similar to the vanes of the embodiment illustrated in FIGS. 23-25 in that they include a semi-rigid strip 214 having upper 216 and lower 218 tabs connected to the support sheet and operating elements respectively and with a fold line 220 slightly above its longitudinal center forming upper 222 and lower 224 segments. The vanes can be moved between a closed position wherein they lie in a substantially coplanar relationship with the support sheet 104 and an extended position wherein they project forwardly away from the support sheet in a substantially right triangular configuration. In this embodiment, an arcuate rigid or semi-rigid rectangular slat 226 is secured to the upper segment 222 of the semi-rigid vane component so that an inner edge 228 of the rectangular slat is adjacent to the support sheet. The slat 226 has a height approximately twice as great as the upper segment 222 of the vane so that when the vanes are in the open position of FIG. 37, the slats project a greater distance away from the support sheet than the upper segment of the vane. When the vanes are closed as shown in FIG. 35, the slats overlie an immediately adjacent lower slat. FIG. 36 illustrates the vanes in a partially opened position. As will be appreciated, a gap or opening 138 begins to be formed between adjacent vanes until that gap or opening is maximized when the vanes are fully opened as shown in FIG. 37. The slats 226 are slightly concave inwardly or downwardly in transverse cross section giving the covering an appealing aesthetic whether opened or closed.

Figure 38:
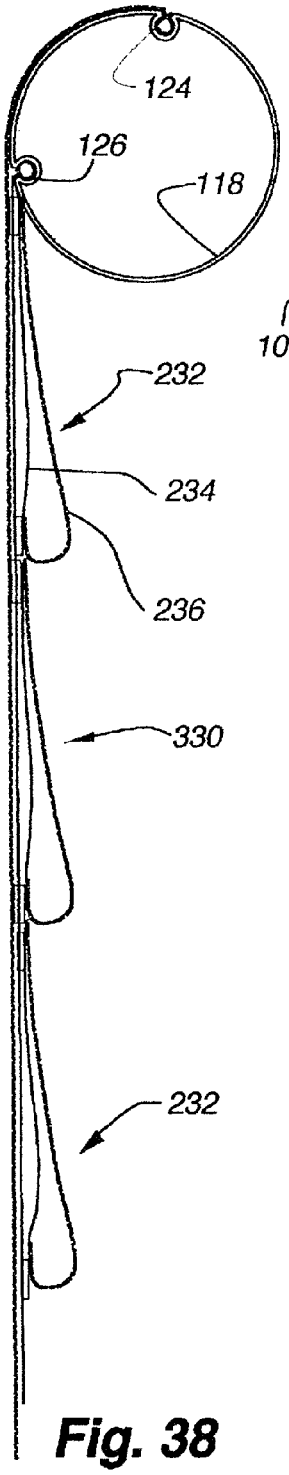
FIG. 38 is a side elevation of a ninth embodiment of the present invention with the vanes in a fully closed position.
Figure 39:
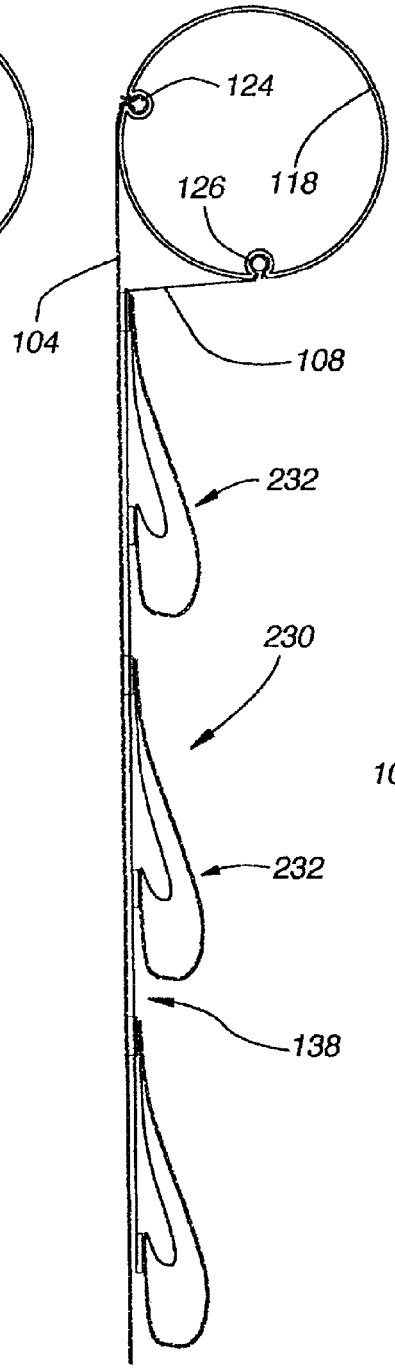
FIG. 39 is a side elevation similar to FIG. 38 with the vanes in a partially opened position.
Figure 40:
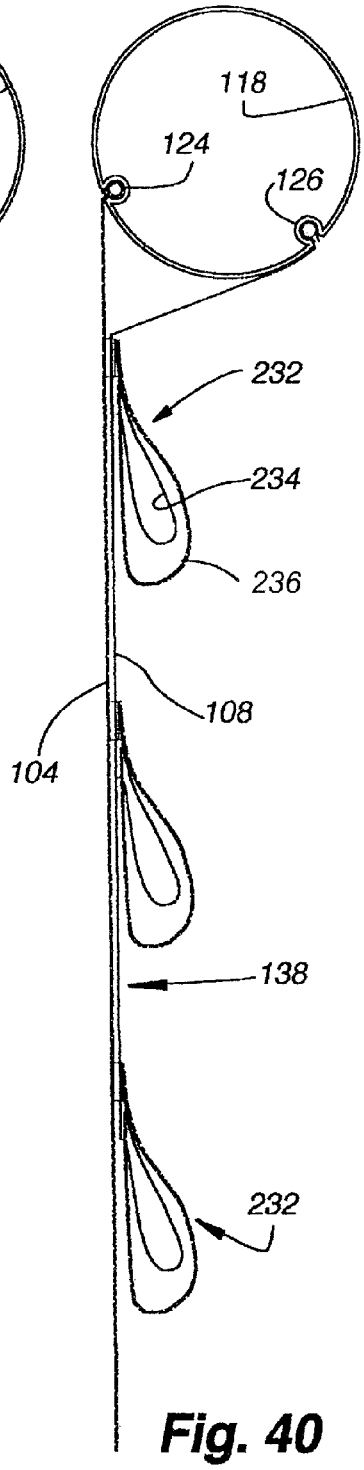
FIG. 40 is a side elevation of the covering of FIGS. 38 and 39 with the vanes in a fully opened position.

A ninth embodiment 230 of the invention is illustrated in FIGS. 38-40 with this embodiment again including a roller 118 having circumferentially spaced attachment grooves 124 and 126 with one groove 124 supporting the support sheet 104 and the other the flexible operating elements 108. Vanes 232 for the covering have inner 234 and outer 236 components with the outer component being a flexible strip of material similar to that disclosed in the embodiment of FIGS. 20-22. The upper edge of the outer strip of material is secured to the support sheet 104 so the operating elements are slidable through that connection with the lower edge of the outer strip being secured to the flexible elements 108 identically to the embodiment of FIGS. 20-22. The inner component 234 of the vanes is a second flexible strip of smaller height than the first flexible strip 236 so the second flexible strip will droop interiorly of the outer flexible strip when the covering is in the open position of FIG. 40, but with the inner flexible strip 234 lying substantially coplanar with the support sheet when the covering is closed as illustrated in FIG. 38. The outer strip 236 droops even in the closed condition of the covering for aesthetic purposes. FIG. 39, of course, illustrates the covering in a partially open position wherein relatively small gaps or openings 138 are defined between adjacent vanes with that opening being maximized when the covering is fully opened as in FIG. 40. The purposes for the inner and outer strips of material used in the vanes are numerous including but not limited to the fact that they define closed cellular air pockets, except along opposite sides 114 and 116 of the support sheet where they open through the ends of the panel, for improved insulation. Further, the inner and outer strips of material can have different transparencies and color schemes for variable aesthetics.

Figures 41, 42, 43:
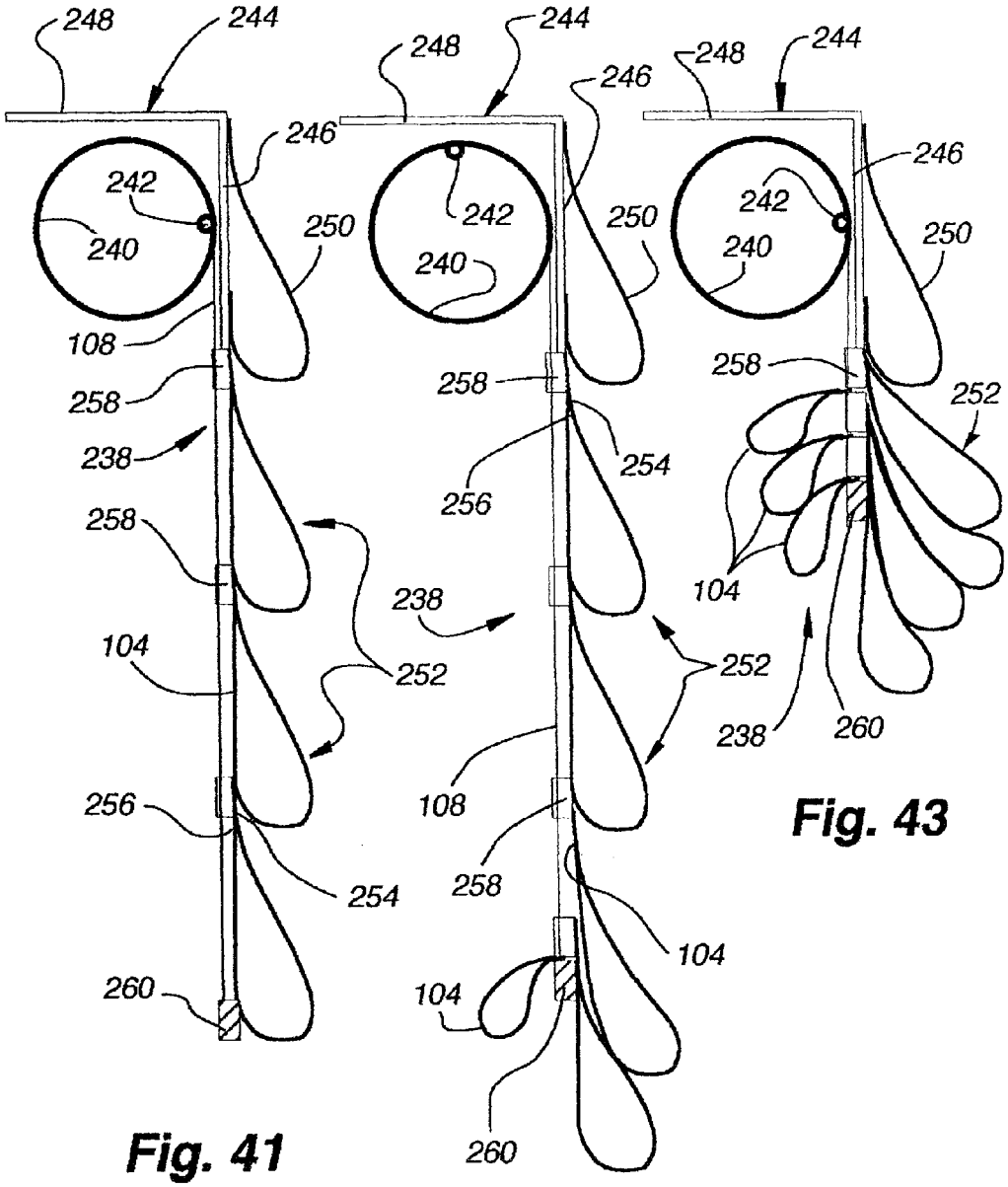
FIG. 41 is a side elevation of a tenth embodiment of the present invention with the vanes in a fully closed position.
FIG. 42 is a side elevation similar to FIG. 41 with the vanes in a partially opened position.
FIG. 43 is a side elevation similar to FIGS. 41 and 42 with the vanes in a fully opened position.

A tenth embodiment 238 of the present invention is illustrated in FIGS. 41-43 and in this embodiment a roller 240 is provided with a single groove 242 for attaching the upper ends of a plurality of operating elements 108. The roller is rotatably mounted within a headrail 244 of inverted L-shaped cross sectional configuration. The headrail therefore defines a front plate 246 and a top plate 248 with the front plate supporting a valance in the form of a drooping vane 250 preferably made of a somewhat flexible material so the lower edge of the loop in the vane extends beyond the lower edge of the front plate of the headrail. Successive horizontally extending vanes 252 of the same cross-sectional configuration are supported on a support sheet 104 which is suspended vertically from the front plate of the headrail. Each vane 252 has a top edge 254 and a bottom edge 256 but the top and bottom edges are coincidentally secured to the support sheet along a horizontal line with an interrupted line of adhesive 258 identically to the manner in which the top edge of each vane is connected to the support sheet in the embodiment of FIGS. 1-16. Each successively lower vane 252 is mounted on the support sheet in the same manner so that the lower edge of the loop in each vane slightly overlaps the top edge of the next adjacent lower vane. The operating elements 104 pass through the gaps or openings (not seen) in the lines of adhesive 258 connecting the vanes to the support sheet so that they are slidable through the lines of adhesive. The lower ends of each operating element 108 are secured to a lift bar 260 that could be most any rigid or semi-rigid bar such as a polyethylene plastic or the like. When the roller 240 is rotated in a counterclockwise direction with the covering fully extended as shown in FIG. 41, the operating elements are wrapped around the roller thereby lifting the lift bar which engages the lowest line of adhesive as shown in FIG. 42. As the roller continues to rotate in a clockwise direction, the lift bar accumulates the vanes with the lines of adhesive adjacent to the headrail as shown in FIG. 43 so that the looped vanes are attractively stacked.

Figure 44:
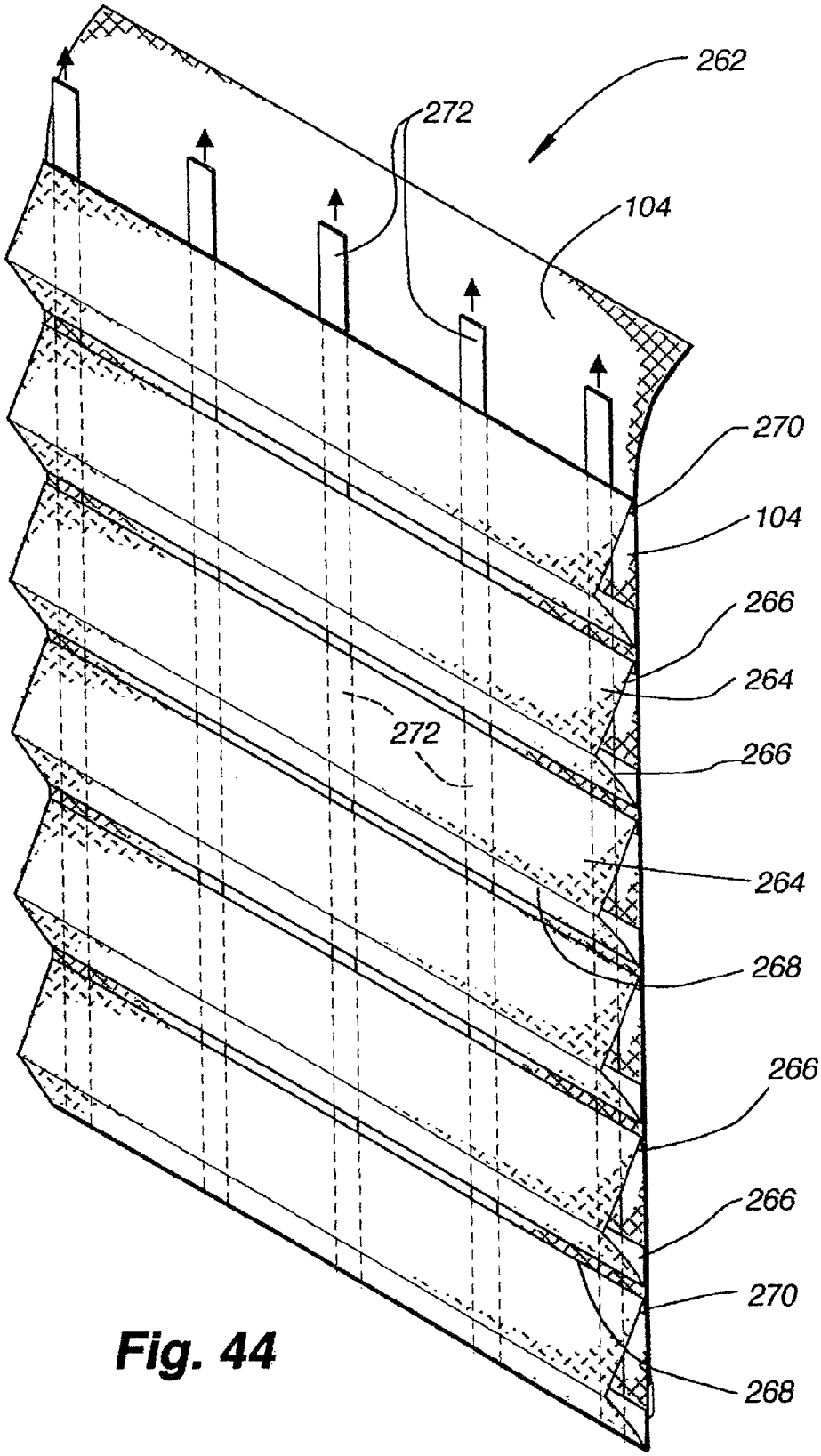
FIG. 44 is an isometric view of an eleventh embodiment of a panel in accordance with the present invention.
Figure 45:
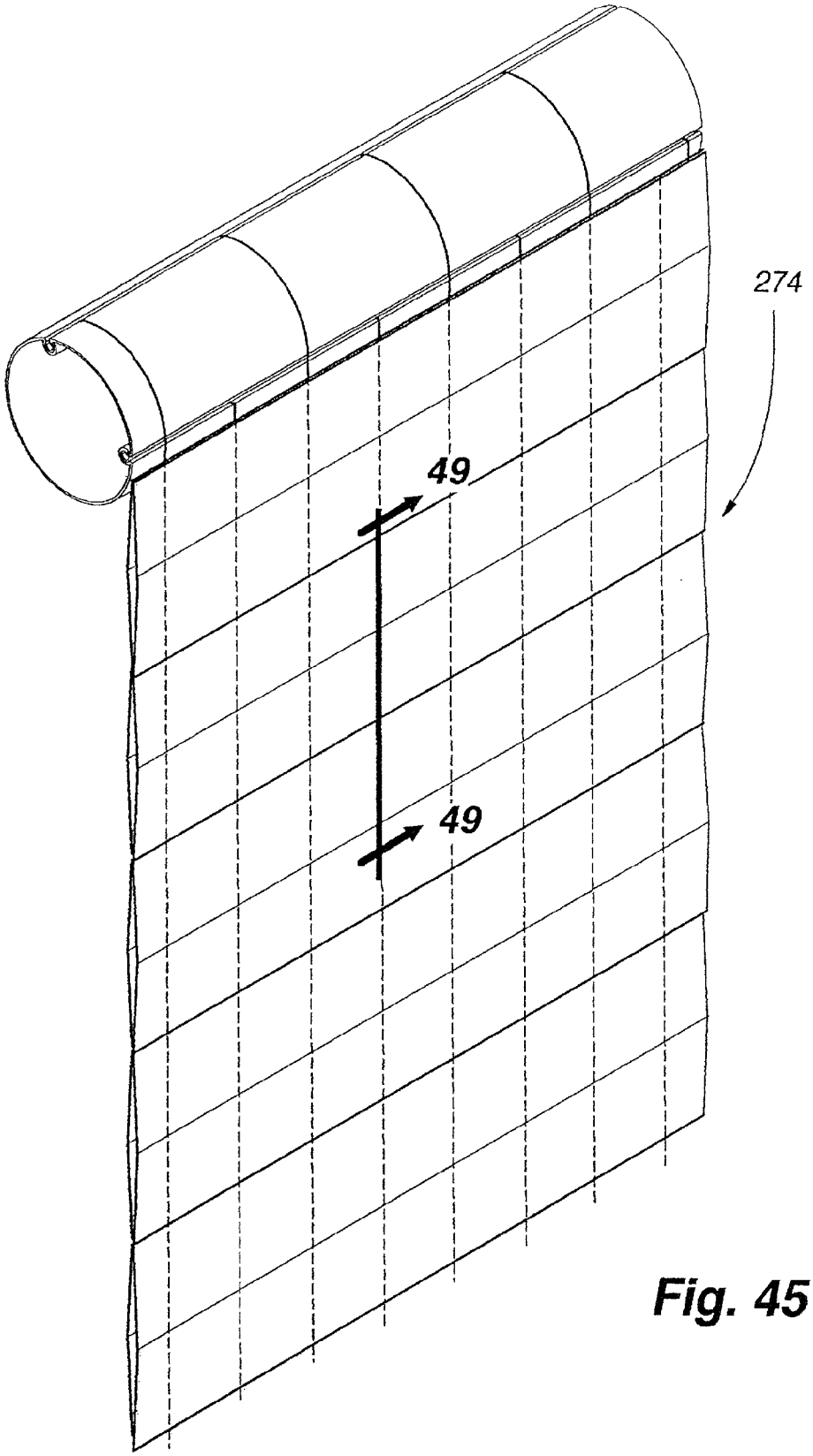
FIG. 45 is an isometric view looking at the rear of a twelfth embodiment of the present invention wherein lift cords and operating cords pass through the center of cellular vanes.
Figure 45A:
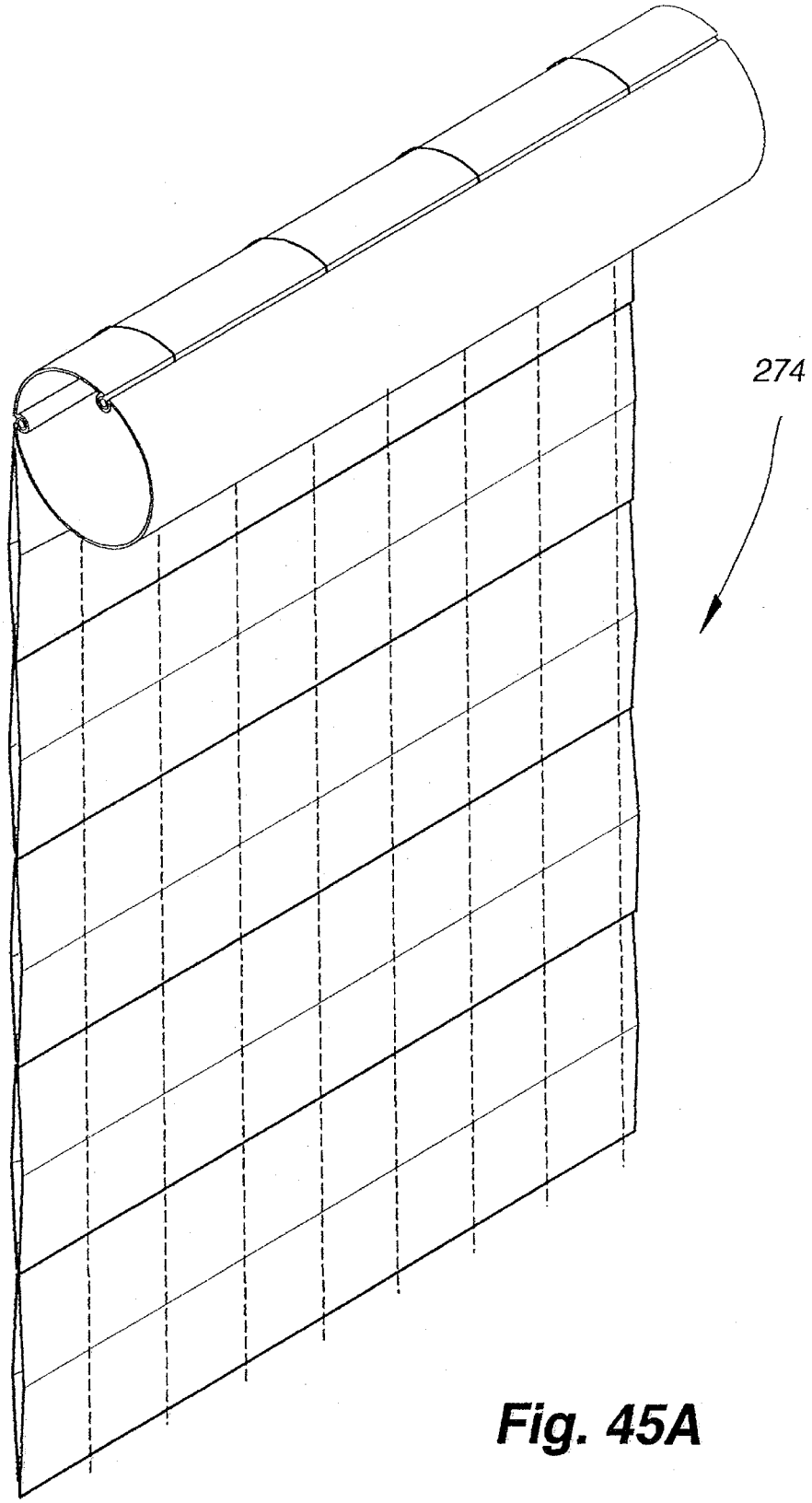
FIG. 45A is an isometric view similar to FIG. 45 looking at the front of the covering.

FIG. 44 illustrates another embodiment 262 of the covering of the present invention that is very similar to the embodiment of FIGS. 1-16. In this embodiment, a support sheet 104 that has been illustrated as a sheet of sheer fabric is connected to a roller (not seen) along one groove in the periphery of the roller. A plurality of semi-rigid vanes 264 having folded tabs 266 along upper and lower edges and a longitudinal fold line 268 along approximately its longitudinal center are supported on the support sheet. The vanes are supported on the support sheet by interrupted strips of adhesive 270 along a top edge so as to define gaps or spaces through which operating elements 272, which in the embodiment of FIG. 44, are ribbons or tapes of material in lieu of the monofilaments illustrated in the embodiment of FIGS. 1-16. The ribbons or tapes 272 have their upper ends secured in a second groove in the roller (not seen) which is circumferentially spaced from the first groove so the covering operates in the same manner as that of FIGS. 1-16 except the monofilaments have been replaced with the ribbons or tapes 272 which are secured to the lower edge of each vane 264 so that upward movement of the ribbons or tapes as caused by rotation of the roller lifts the lower edges of each vane relative to the upper edges.

FIGS. 45-52 illustrate a twelfth embodiment 274 of the covering of the present invention where again a roller 118 having circumferentially spaced attachment grooves 124 and 126 is provided. In this embodiment, the support structure, which has been illustrated as a sheet of sheer fabric in the previously described embodiments, is a plurality of vertically extending spaced parallel and flexible lift elements 278, which in this embodiment are monofilaments even though it will be appreciated other flexible elements could be used such as strings, strips or ribbons of material, natural or synthetic cords or the like. The lift elements have their upper ends secured in the first groove 124 of the roller. The operating elements 108 are the same as the previously described embodiments and again there are a plurality of the operating elements that are vertically suspended in spaced parallel relationship with the upper ends secured in the second groove 126 of the roller. The vanes 280 in this embodiment consist of front 282 and rear 284 components with both components being made of a semi-rigid material similarly to the embodiment of FIGS. 1-16 so that they have rectangular tabs 286 along their upper and lower edges and a longitudinally extending fold line 288 along their approximate longitudinal center. The vane components 282 and 284 are mounted in back-to-back opposing relationship on opposite sides of the lift elements 278 and operating elements 108. The vane component 282 on the front side of the panel is slightly larger than the vane component 284 on the rear side so it extends downwardly along the length of the lift elements a slightly greater distance for a purpose to be described later. The upper edges of the vane components are coincident at their location of attachment to the lift elements.

The upper edges of each vane component are secured to the lift elements with strips of adhesive 290 so as to define gaps therebetween through which the operating elements 108 are slidably passed. The vanes 280 are spaced a predetermined distance apart so that in the closed position of the covering, as illustrated in FIG. 46, the lower edge of the front component 282 of each vane overlaps the upper edge of the front component 282 of the next adjacent lower vane for complete closure.

The lower edges of each vane component are secured to the operating elements 108 at predetermined locations along the lengths of the operating elements so the lower edges of the vanes can be drawn toward the upper edges of the vanes in moving the covering to an open position by raising the operating elements relative to the lift elements.

Figure 46:
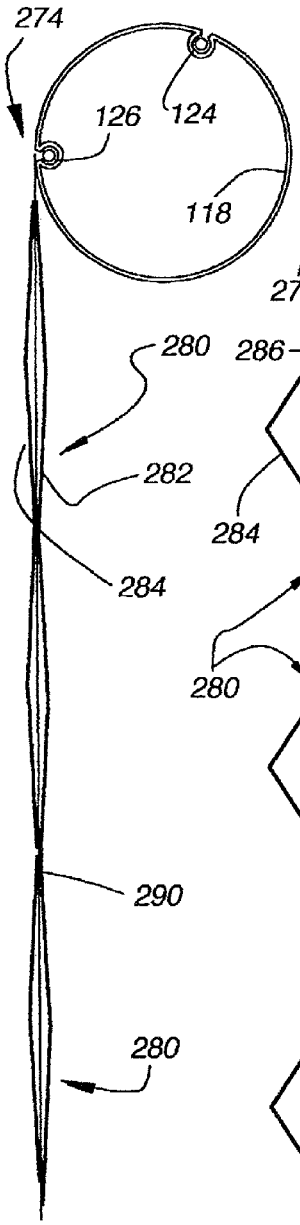
FIG. 46 is a side elevation of the covering of FIGS. 45 and 45A showing the covering in a fully extended but closed position.
Figure 47:
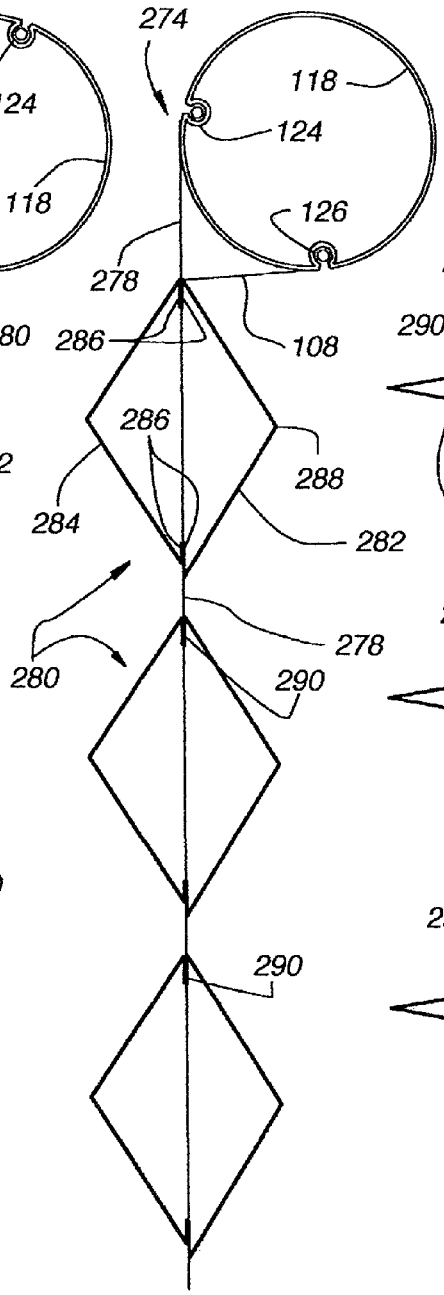
FIG. 47 is a side elevation similar to FIG. 46 showing the covering in a partially open position.
Figure 48:
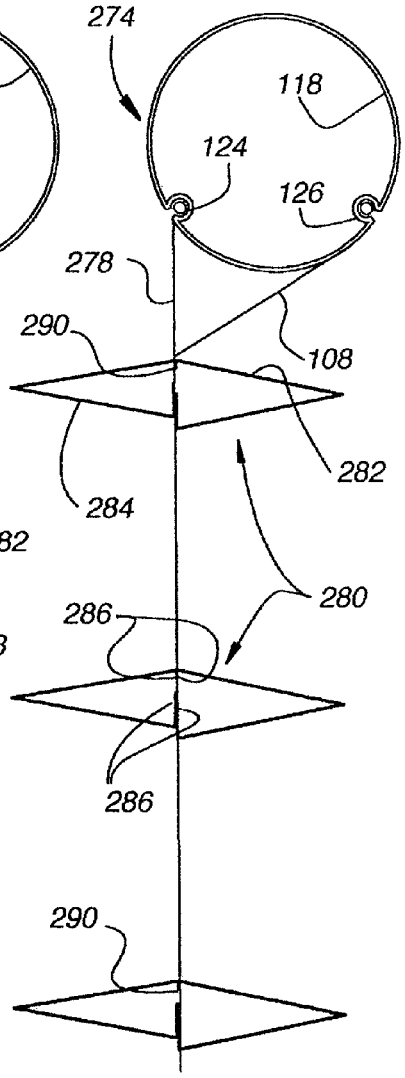
FIG. 48 is a side elevation similar to FIGS. 46 and 47 with the covering in a fully open position.
Figure 49:
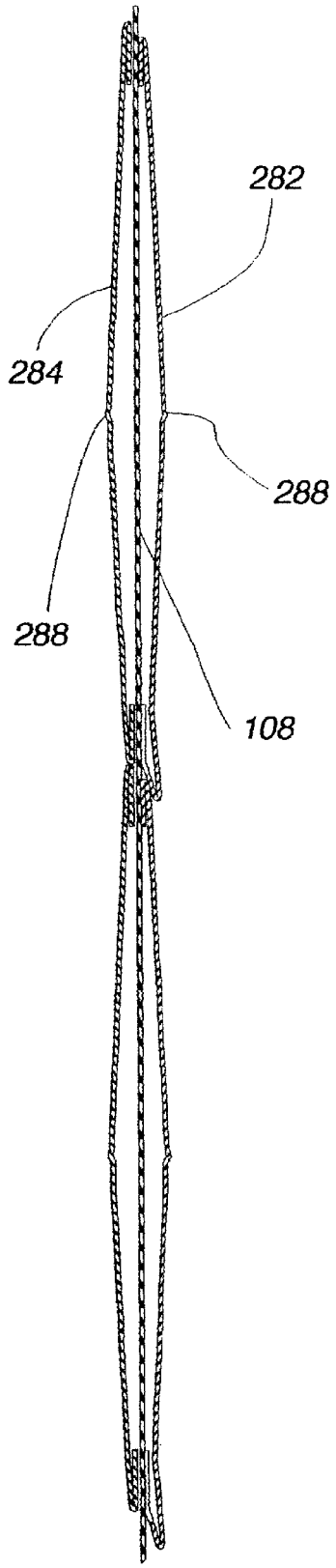
FIG. 49 is an enlarged fragmentary section taken along line 49-49 of FIG. 45.
Figure 50:
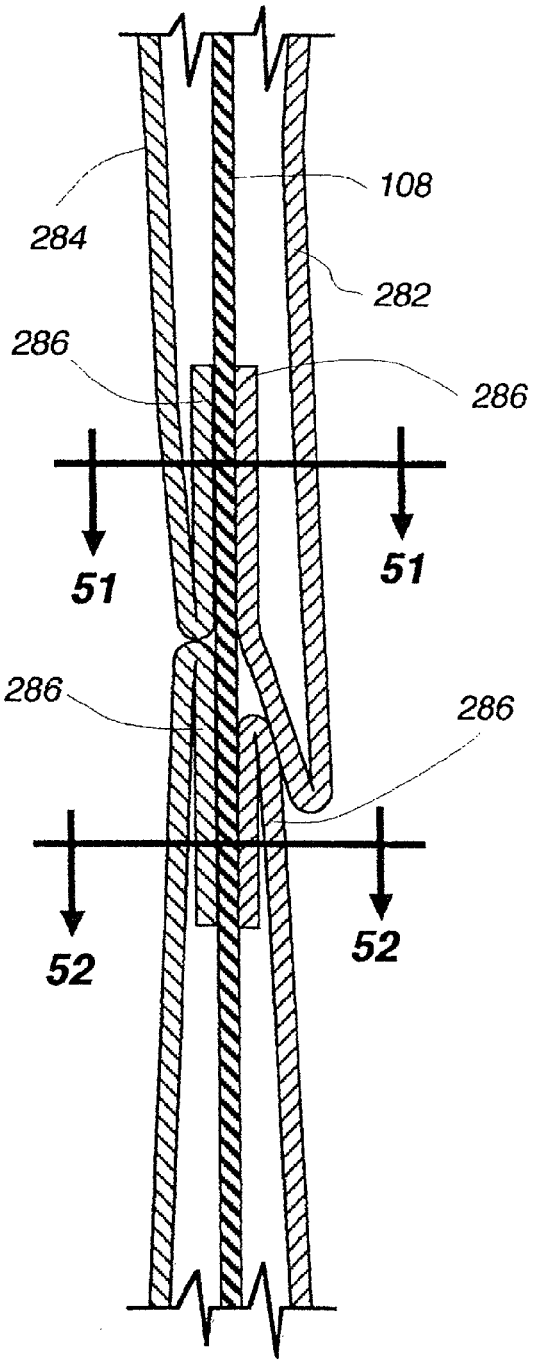
FIG. 50 is a further enlarged fragmentary section similar to FIG. 49 illustrating the edges of two adjacent vanes in the closed position of the covering.
Figure 51:
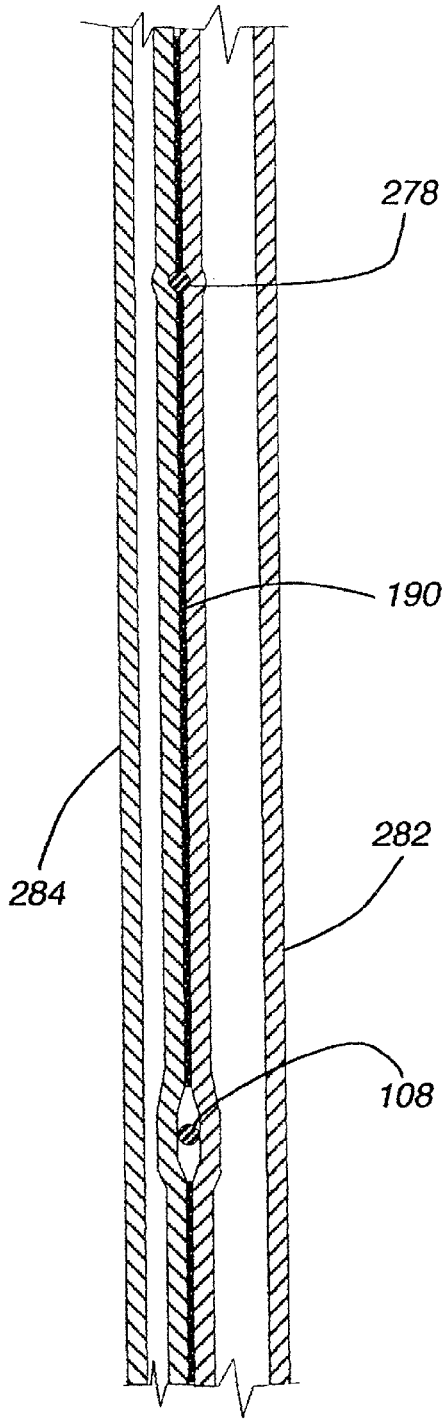
FIG. 51 is a section taken along line 51-51 of FIG. 50.
Figure 52:
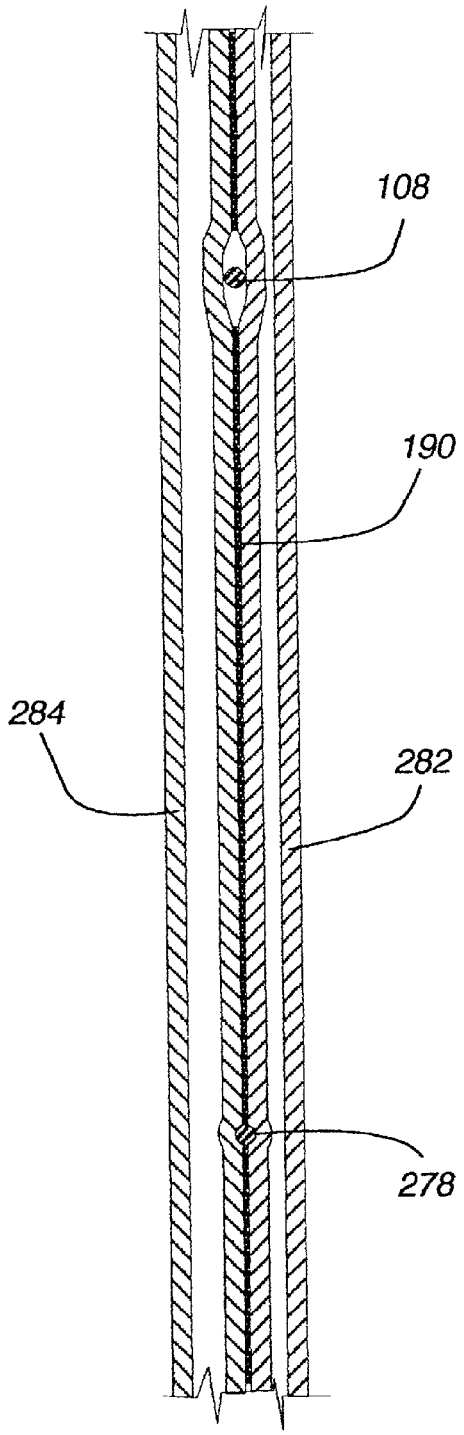
FIG. 52 is a section taken along line 52-52 of FIG. 50.

In operation of the covering, the panel of vanes 280 can be seen in FIG. 46 suspended from the rear side of the roller 118 with the groove 124 supporting the lift elements 278 being positioned approximately at the top of the roller and the groove 126 supporting the operating elements 108 at the rear of the roller. The panel is shown in a fully extended position with the vanes closed so each vane is flat and substantially parallel and coplanar with the lift elements and operating elements. In order to retract the covering, the roller is simply rotated in a clockwise direction causing the panel of vanes to wrap around the roller but to open the vanes from the fully extended closed position of FIG. 46, the roller is rotated in a counterclockwise direction so that in a partially open position, as illustrated in FIG. 47, the groove 124 affixing the lift elements is approximately at the rear of the roller while the groove 126 supporting the operating elements is positioned at approximately the bottom of the roller. As will be appreciated, the operating elements are pulled upwardly as the groove 126 is displaced from the lift elements causing the bottom edges of each vane to be lifted. Further counterclockwise rotation of the roller, moves the covering into the fully open position of FIG. 48 defining gaps or spaces 138 between the vanes through which vision and light can pass. As will be appreciated, in this embodiment of the invention, closed cells, which are open at opposite ends of the panel, are defined by the vanes with the cells extending in forward and rearward directions from the lift and operating elements. Cellular coverings of this type have utilitarian advantages in providing insulating properties not available with conventional roller shades for example.

Figure 53:
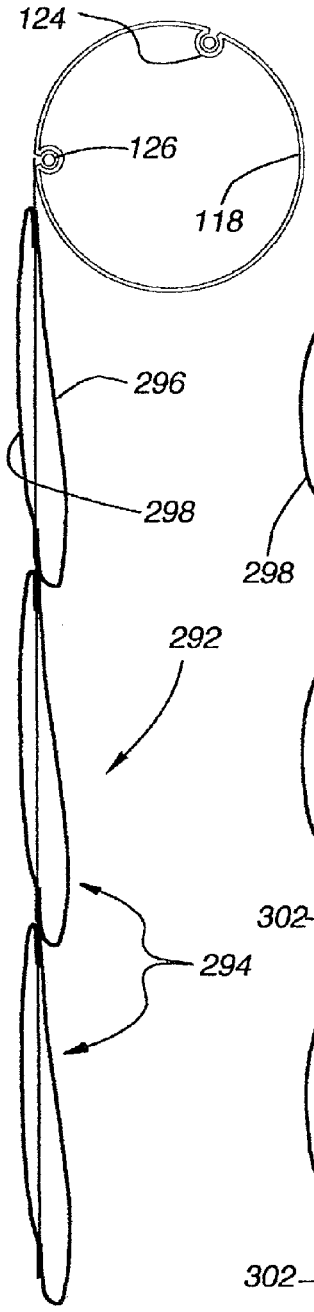
FIG. 53 is a side elevation of a thirteenth embodiment of a covering in accordance with the present invention with the covering in a fully closed position.
Figure 54:
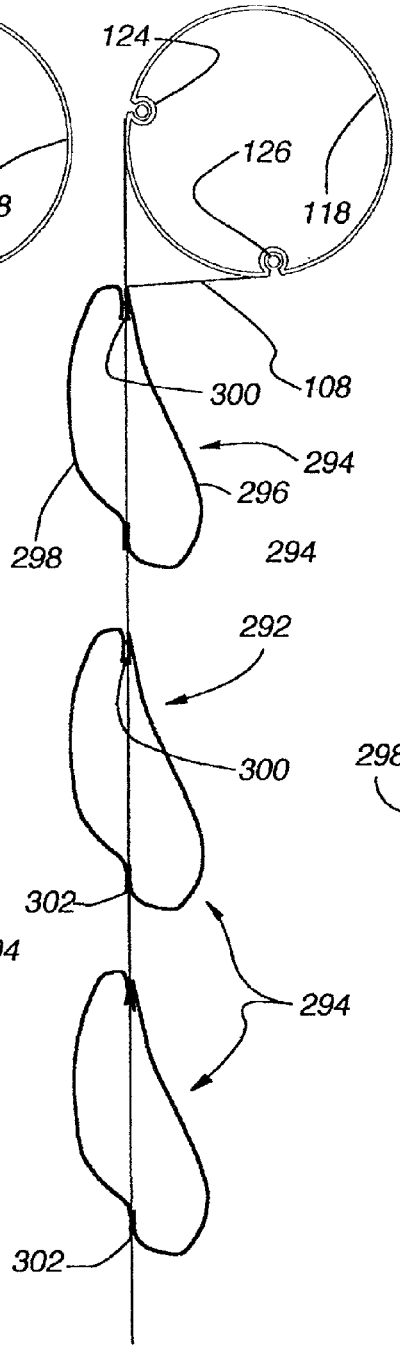
FIG. 54 is a side elevation similar to FIG. 53 with the covering in a partially open position.
Figure 55:
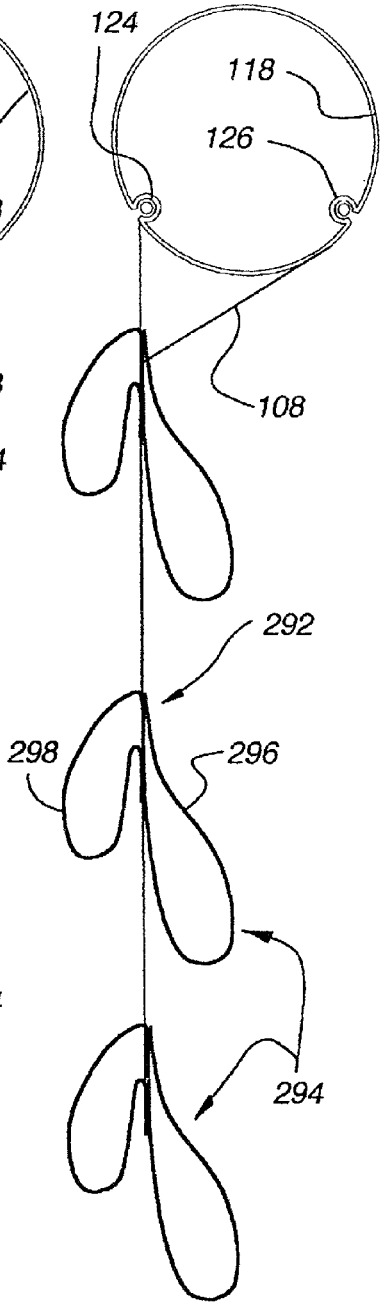
FIG. 55 is a side elevation similar to FIGS. 54 and 54 with the covering in a fully open position.

A thirteenth embodiment 292 of the present invention is illustrated in FIGS. 53-55 which again utilizes a cylindrical roller 118 having two circumferentially spaced grooves 124 and 126 with one of the grooves 124 used to anchor the top ends of a set of lift elements 278 and the other groove 126 used to anchor the top end of a set of operating elements 108. As with the embodiment of FIGS. 45-52, each vane 294 has a front component 296 and a rear component 298 with the vanes being of generally tear-drop cross-sectional configuration. The front vane component 296 has an inward downwardly extending tab 300 along its lower edge and the rear vane component 298 has an inward upwardly extending tab 302 along its upper edge with the vane components being of substantially the same configuration but inverted relative to each other. Again the upper edges of each vane are connected to the lift elements 278 with strips of adhesive in a manner to define spaces therebetween through which the operating elements 108 can slidably pass and be secured to the lower edges of the vane components. This embodiment of the invention operates in the same manner as the embodiment of FIGS. 45-52 and with reference initially to FIG. 53, the covering is shown in a fully extended but closed position so the front vane component of each vane slightly overlaps the next adjacent lower vane and the vanes form a closed cell with open ends at the sides of the panel. The lift and operating elements extend vertically through the center of the cells formed by the vanes. As the covering is moved toward an open position as shown in FIG. 54, the lower edges of each cell are lifted toward the upper edges causing the cells to expand in both forward and rearward directions until the covering is fully open as shown in FIG. 55 defining openings or spaces between adjacent cells through which vision and light can pass.

Figure 56A:
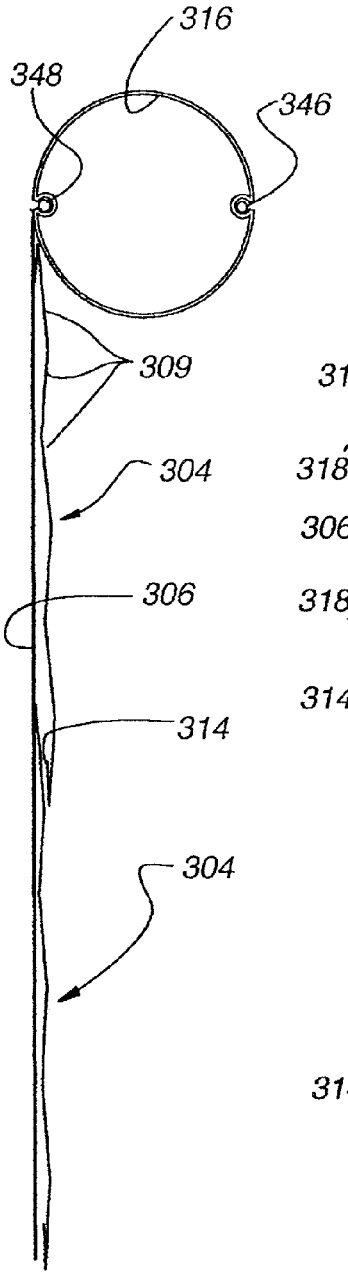
FIG. 56*a* is a side elevation of a fourteenth embodiment of a covering in accordance with the present invention in a fully extended position.
Figure 56B:
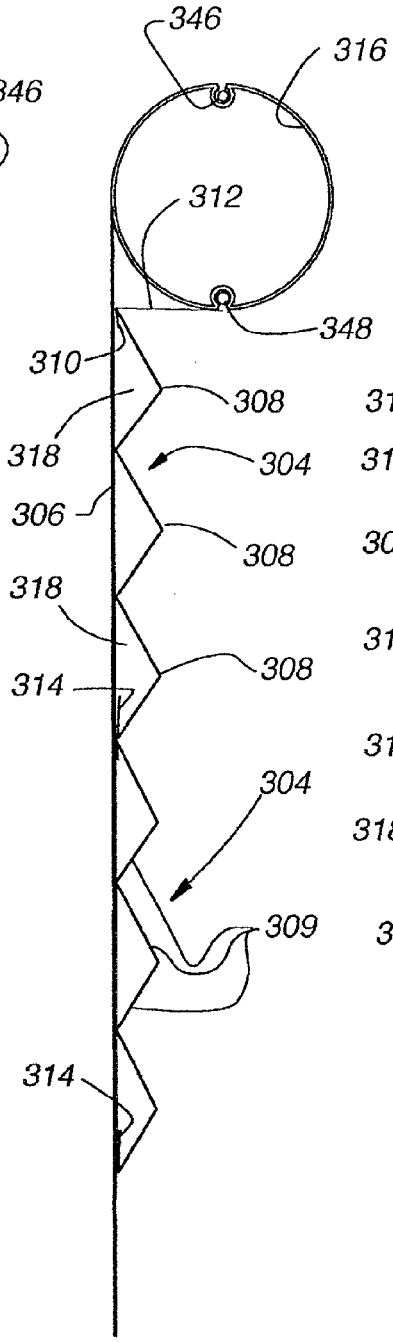
FIG. 56*b* is a side elevation of the covering of FIG. 56*a* in a partially retracted position.
Figure 56C:
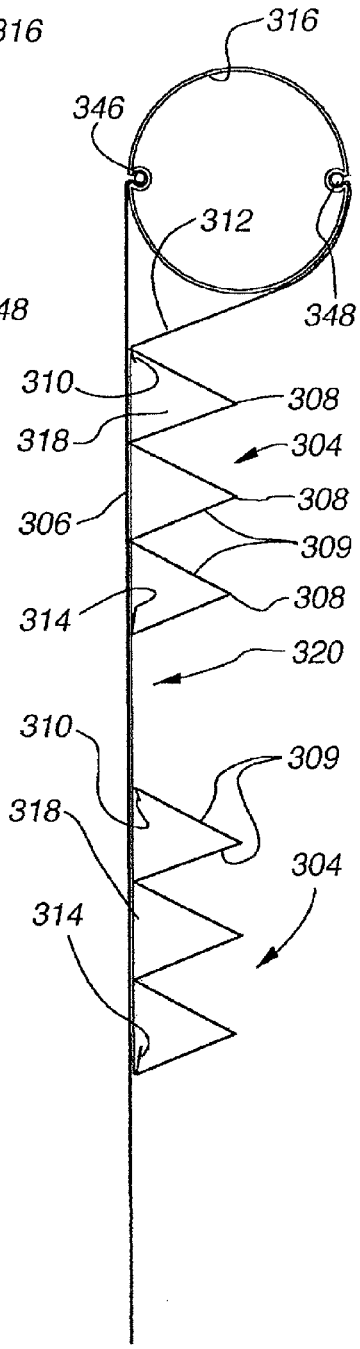
FIG. 56*c* is a side elevation of the covering of FIG. 56*a* in a fully retracted position.

A fourteenth embodiment of a panel in accordance with the present invention is illustrated in FIGS. 56*a*-56*c*. In this embodiment, a plurality of strips or vanes 304 are supported on a support structure 306 which again could be a sheet of material such as sheer fabric or a plurality of flexible support elements. The strips or vanes are made of a rigid or semi-rigid material which is alternately creased in opposite directions at equally spaced locations 308 so as to define lines of flexure along which generally flat component parts 309 of the strip can be pivoted relative to an adjacent component. Along the top edge or marginal zone of each strip is a downturned flap 310 which is secured, as by adhesive, to the support structure 306 as defined in previous embodiments in a manner to define gaps through which flexible control or operative elements 312 can slidably pass. The control elements are secured to the bottom edge or marginal zone of each strip or vane along an upturned flap 314 provided therealong. Accordingly, as the operative elements are moved up or down, the lower edge of each vane is moved up or down accordingly as the operative elements slide through the gaps in the connection of downturned flap 310 at the upper edge of the vane to the support structure.

FIG. 56*a* shows the fourteenth embodiment of the invention in a fully extended and closed condition wherein each strip or vane 304 hangs fully extended in a substantially flat orientation adjacent to the front face of the support structure 306. Movement of the operating elements 312 upwardly, which is caused by a counterclockwise rotation of a roll bar 316 from which the panel is suspended when the covering is fully extended lifts the lower edge of each vane relative to the support structure and due to the precreasing of the vanes, each vane is gathered upwardly causing the component parts 308 thereof to pivot relative to adjacent component parts so that triangular cells 318 having open opposite ends are formed. The cells being formed are illustrated in FIG. 56*b* with FIG. 56*c* showing the vanes in a fully retracted position defining gaps 320 therebetween.

With reference to FIGS. 57-64, a hardware system that could be associated with any one of the panels previously described is illustrated. For purposes of describing the hardware system, a panel 322 of the general type disclosed in FIGS. 38-40 is illustrated except wherein the vanes 324 are made of a slightly more rigid material than that of FIGS. 38-40 so that the vanes can project outwardly away from the support structure 326 rather than drooping therefrom.

Figure 57:
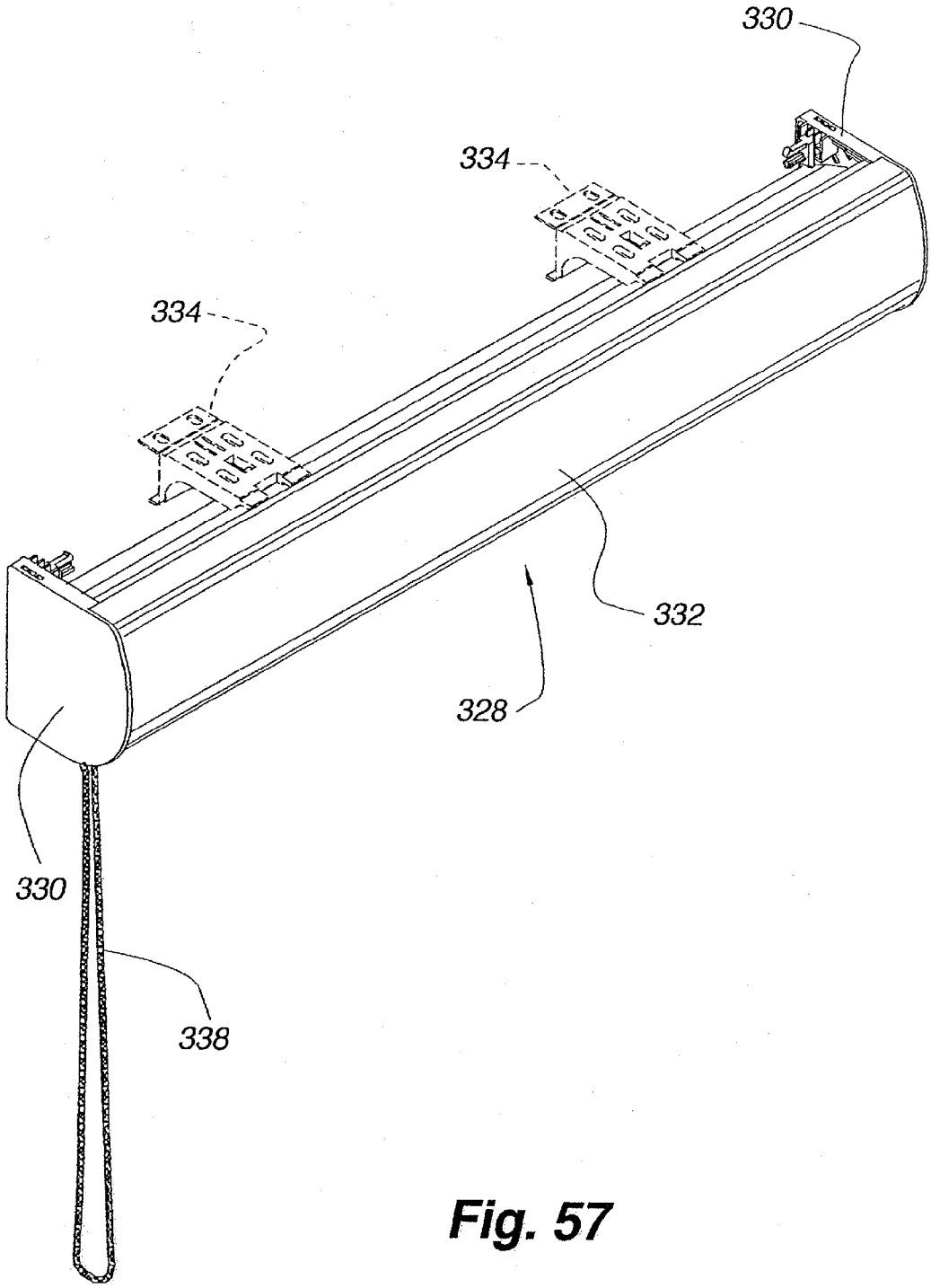
FIG. 57 is an isometric view of a covering in accordance with the present invention shown retracted in a headrail with mounting brackets shown in dashed lines.

With reference first to FIG. 57, a headrail 328 for supporting the panel 322 of covering material is shown to include a pair of end caps 330 supporting a front longitudinally extending fascia panel 332 that extends partially across the top of the headrail and is designed to be supported in a conventional manner with mounting brackets 334 (shown in dashed lines) that can be secured to the frame around an architectural opening. The headrail would typically be disposed adjacent to the top of the architectural opening and includes a roller or roll bar 336 as illustrated by way of example in FIG. 59*a* around which the panel 322 of material can be selectively wrapped in a retracted or partially retracted position of the covering. The roller is reversibly driven with an endless control cord 338 through an operating mechanism that may be of the type disclosed and described in U.S. Pat. No. 6,289,964, the disclosure of which is hereby incorporated by reference. It will be appreciated in the operating mechanism that the endless control cord 338 can be circulated in either direction thereby correspondingly rotating the roll bar 336 to move the panel of covering material between extended and retracted positions. In the extended position, the panel is extended away from but suspended from the roll bar as described in connection with the previously described embodiments of the panel and when retracted, the panel is wrapped around the roll bar. Such operation will be described in more detail hereafter.

With reference to FIGS. 59-62, the panel 322 of covering material can be seen to include a bottom rail 340 which has been disclosed previously in more general terms as element 117. The bottom rail is utilized to add weight along the bottom edge of the panel of material to encourage the panel to drop by gravity as permitted by operation of the roll bar on which the panel is supported. As will be described in detail hereafter, the bottom rail is a hinged two-segment rail designed to cooperate with the support structure 326 and operative elements 312 associated with the panel in a manner that provides a finished aesthetically appealing lower edge to the covering. The pivoted bottom rail is also designed to cooperate with an adjustable stop 344 provided in the headrail that limits rotation of the roller in a retracting direction. In other words, when the panel is fully retracted into the headrail, the bottom rail 340 engages the adjustable stop 344 to prevent further rotation of the roll bar in that direction. The cooperation of the adjustable stop with the bottom rail will be described in more detail hereafter.

Figure 59:
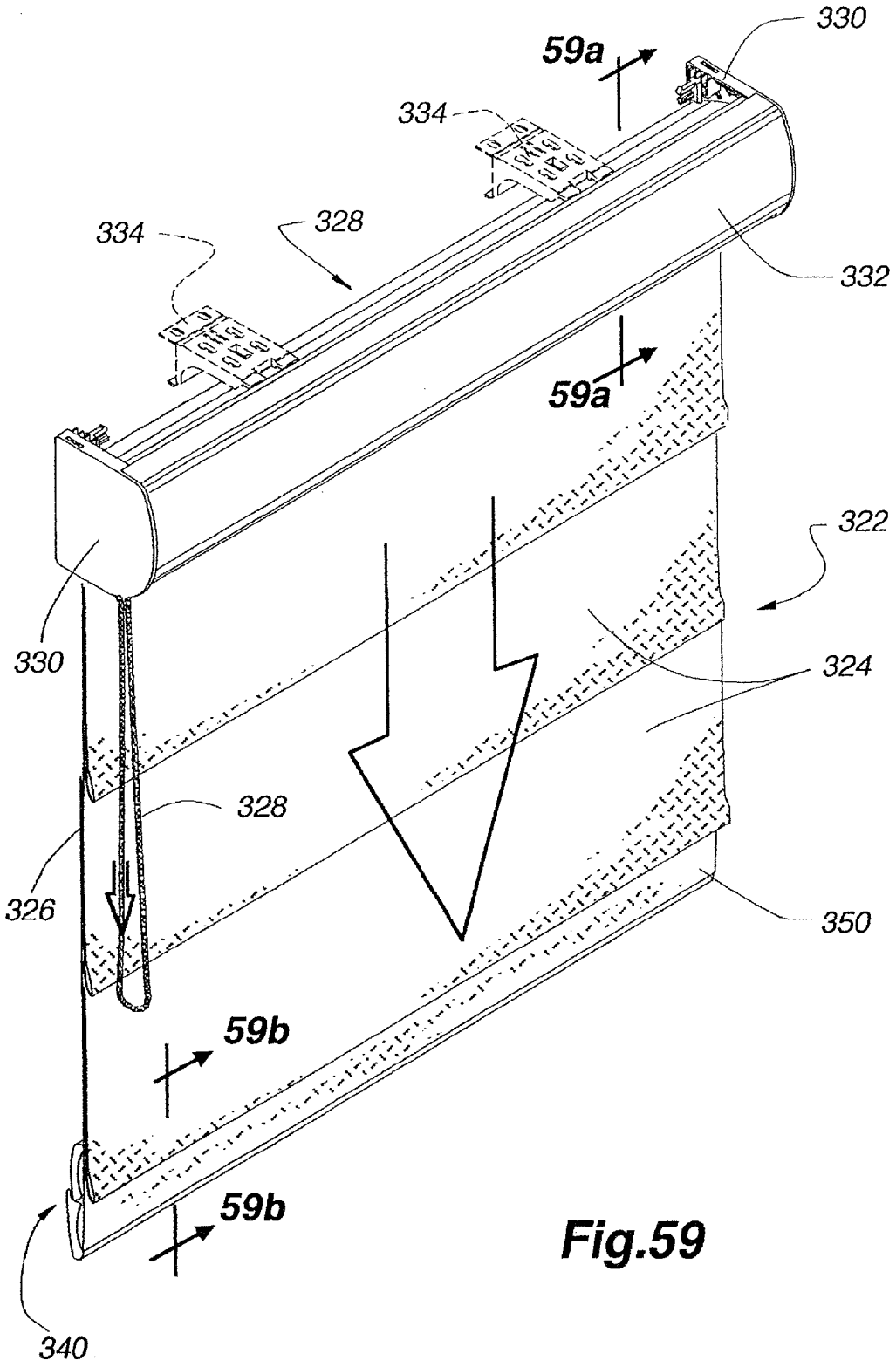
FIG. 59 is an isometric view of the covering of FIG. 57 in a partially extended position.
Figure 59A:
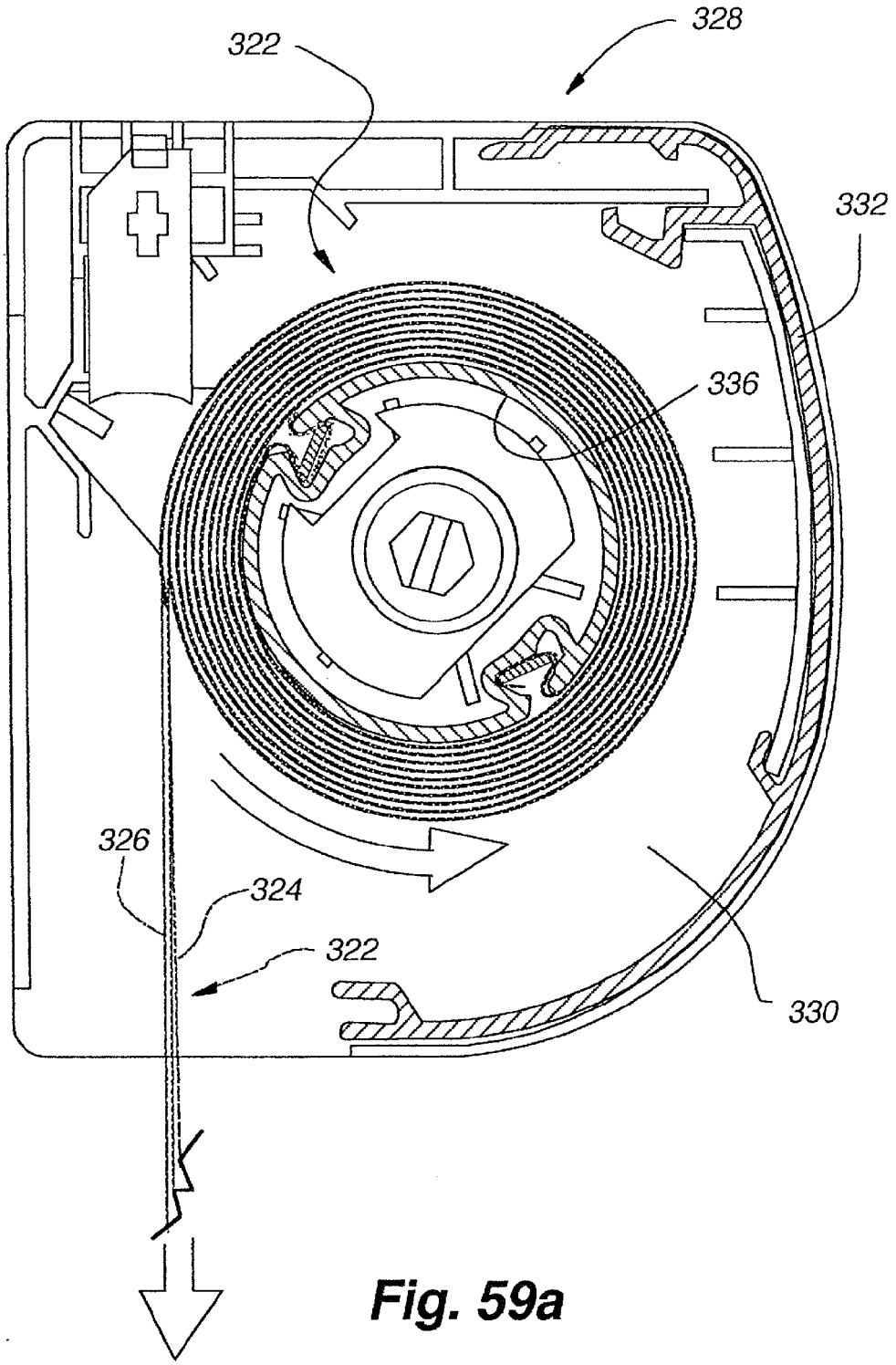
FIG. 59*a* is an enlarged section taken along line 59*a*-59*a* of FIG. 59.

With reference to FIG. 59*a*, and as described generically previously in connection with the various other embodiments of the panel, the roll bar 336 has diametrically opposed grooves 346 and 348 adapted to anchor the upper ends of the support structure 326 and the operating elements 312, respectively. The lower edge of the support structure and the lower edge of a dummy vane or strip 350 secured to the lower ends of the operative elements 312 are anchored in the bottom rail 340 as possibly best seen in FIGS. 59*b* and 59*c*. In those figures it will be seen that the bottom rail is comprised of a larger extruded segment 352 and a smaller extruded segment 354 with the larger segment being shown below the smaller segment. The segments are interconnected with a hinge element 356 wherein the hinge element is an elongated strip of rigid or semi-rigid material such as plastic having beaded edges 358. The dummy strip 350 is preferably a strip of the same material as used in the vanes or strips 324 of the panel. The dummy strip has an upper edge (not seen) secured to the lower edge of the lowermost vane or strip 324 in the panel and a lower edge 362 secured to the bottom rail as will be defined hereafter.

Figure 59C:
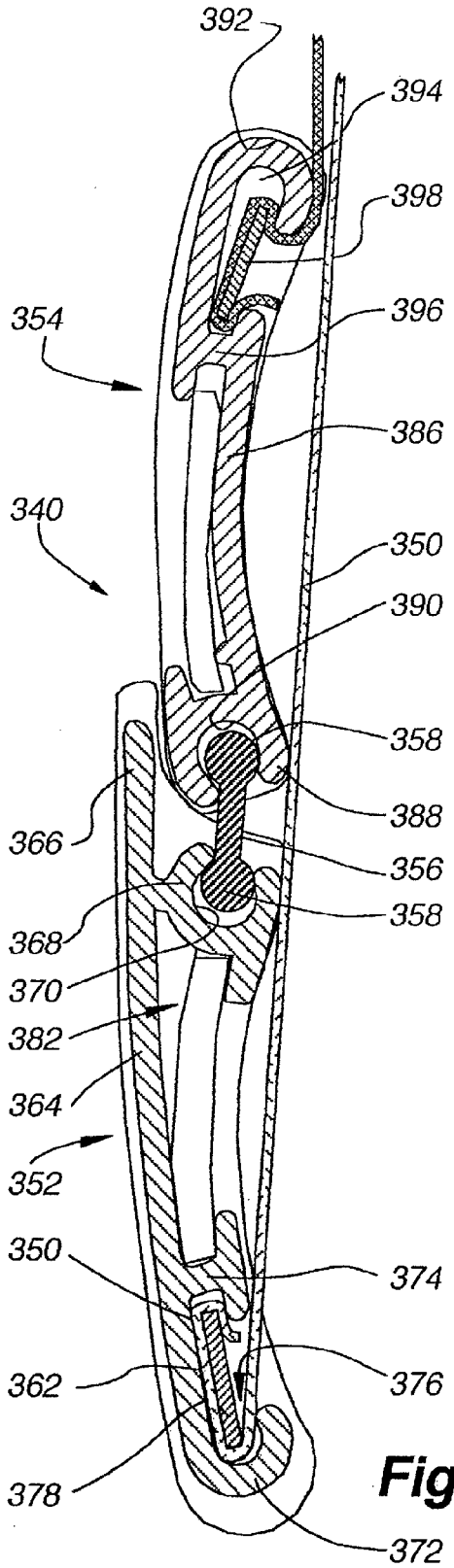
FIG. 59*c* is a section similar to FIG. 59*b* showing an alternative system for interconnecting a bottom rail with the panel of the covering.

The larger segment 352 of the bottom rail has a slightly arcuate body 364 with a protruding edge 366 at its upper end and adjacent thereto a raised attachment element 368 having an open groove 370 adapted to pivotally receive one beaded edge 358 of the hinge element 356. The opposite or lower end 372 of the large segment is curved and spaced from a raised element 374 of generally T-shaped cross section so as to define a pocket 376 therebetween in which the lower edge of the dummy strip 350 for the panel can be anchored as illustrated in FIG. 59*c*. The lower edge of the dummy strip is looped around an anchor strip 378 which is inserted into the pocket 376 defined between the curved end of the larger rail segment and the raised T-shaped element. The dummy strip in an alternate attachment shown in FIG. 59*b* can be wrapped around the curved end 372 of the large bottom rail segment so as to extend across the face of the arcuate body 364 and be adhesively secured thereto after having been wrapped around the upper edge 366 thereof. In either event, whether the support structure is anchored as shown in FIG. 59*c* or 59*b*, the structure is secured to a lower edge of the larger segment.

Figure 59B:
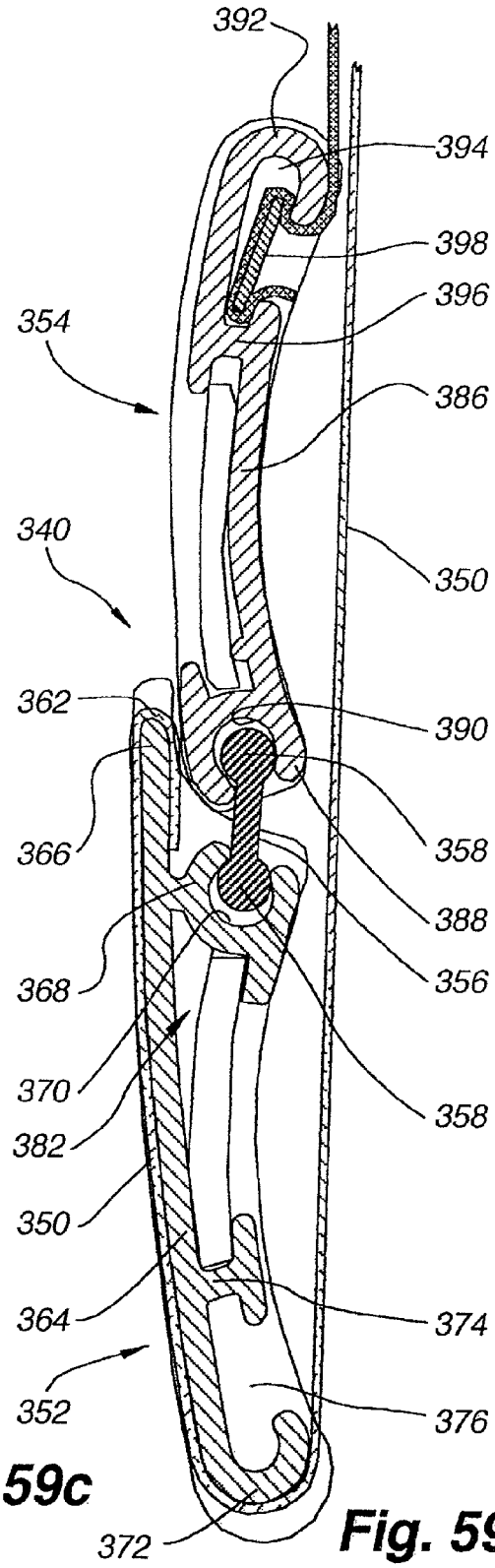
FIG. 59*b* is an enlarged section taken along line 59*b*-59*b* of FIG. 59.
Figure 59D:
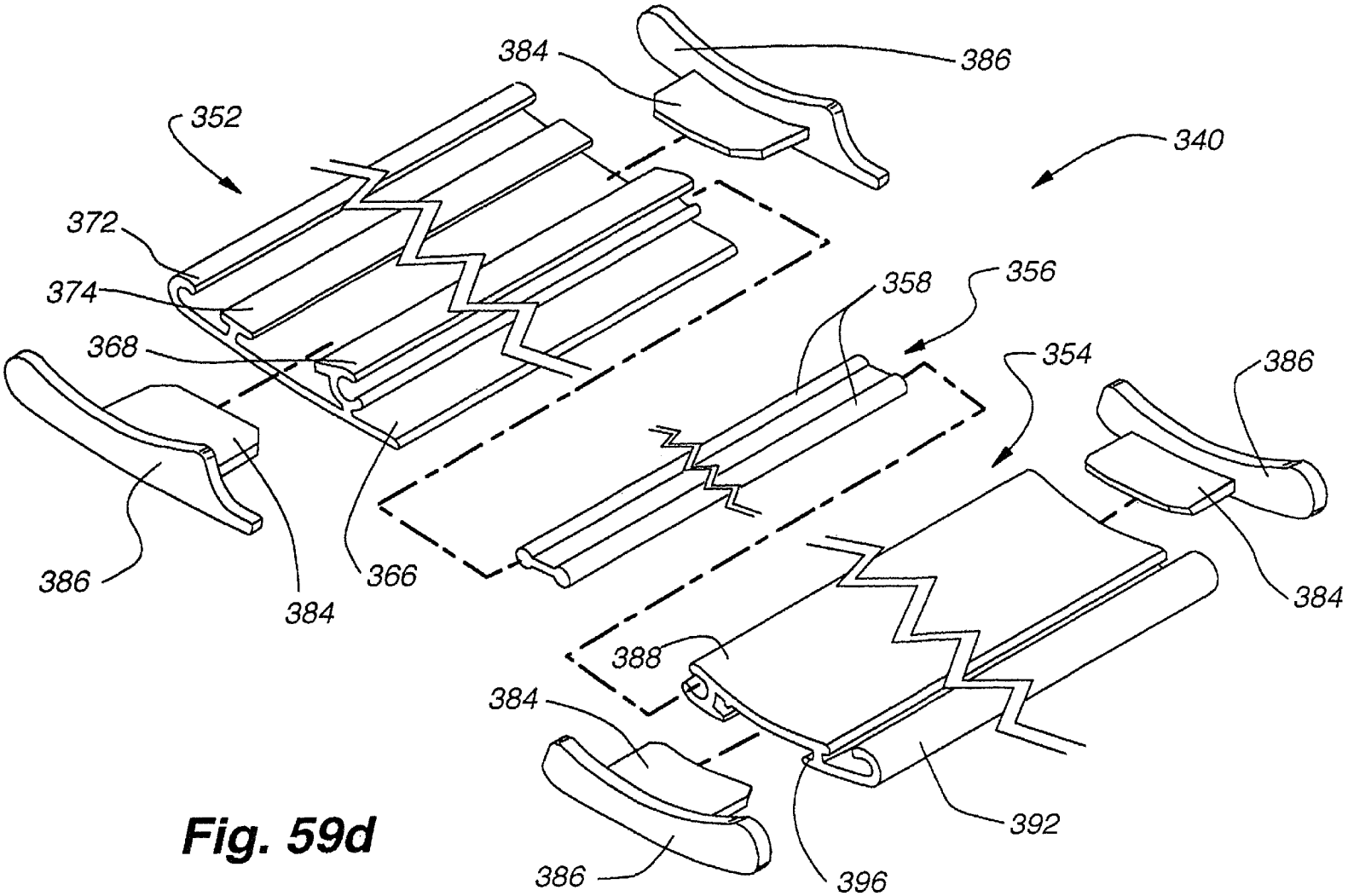
FIG. 59*d* is an exploded isometric showing the bottom rail of FIG. 59*b*.
Figure 60:
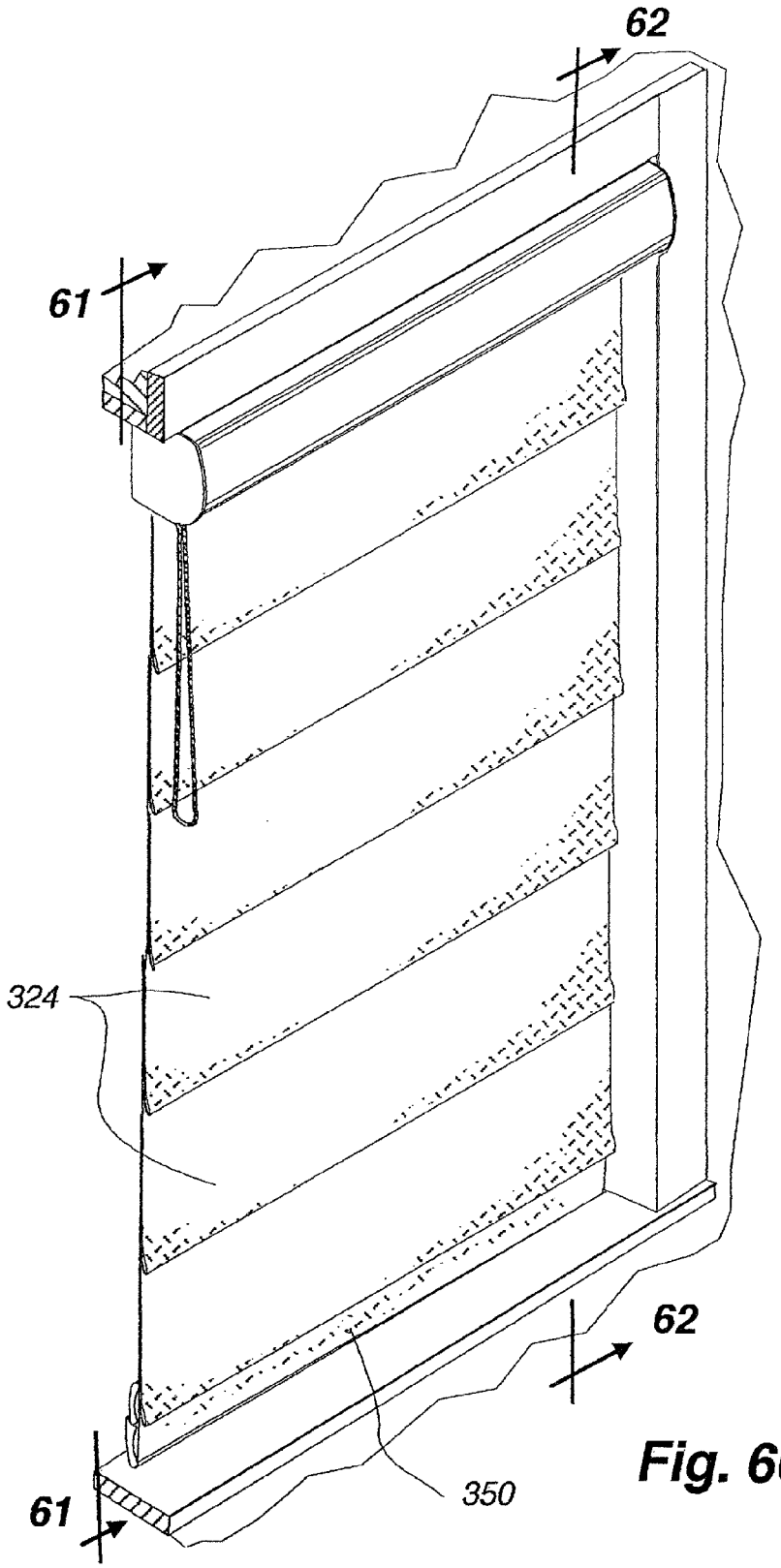
FIG. 60 is an isometric of the covering of FIG. 57 in a fully extended but closed position.

A second pocket 382 is defined between the T-shaped element 374 and the attachment element 368 to receive ribs 384 on end caps of the bottom rail 340 which are inserted into this pocket and are shown in FIG. 59*d*.

The smaller segment 354 of the bottom rail, which is illustrated above the larger segment 352 in FIGS. 59*b* and 59*c*, has a concave body 386 and a lower edge 388 that defines an open groove 390 adapted to pivotally receive and retain the bead 358 along the opposite edge of the hinge element 356 from that attached to the larger segment. The upper or opposite edge 392 of the smaller bottom rail segment is curved so as to define a pocket 394 between a raised rib 396 on the concave body and the curved edge 392 of the smaller segment. This pocket is adapted to receive and retain the lower edge of the support structure 326, which can be wrapped around a rigid or semi-rigid anchor strip 398 positioned in the pocket.

From the above, it will be appreciated that the operative elements 312 are operatively anchored to the lower edge of the larger segment of the bottom rail through the dummy vane 350 as illustrated in FIGS. 59*b* and 59*c* and the support structure 326 is anchored to the upper edge of the smaller or upper segment of the bottom rail as illustrated in FIGS. 59*b* and 59*c* with the two segments of the bottom rail being hingedly connected for pivotal movement relative to each other.

FIG. 59*d* illustrates the larger 352 and smaller 354 segments of the bottom rail in an exploded view with the hinge element 356 therebetween and the end caps 386 associated with each of the larger and smaller bottom rail segments which are provided for aesthetics and to confine the hinge element and the anchor strips used to secure the support structure and dummy vane to the extruded segments of the bottom rail.

Figure 61:
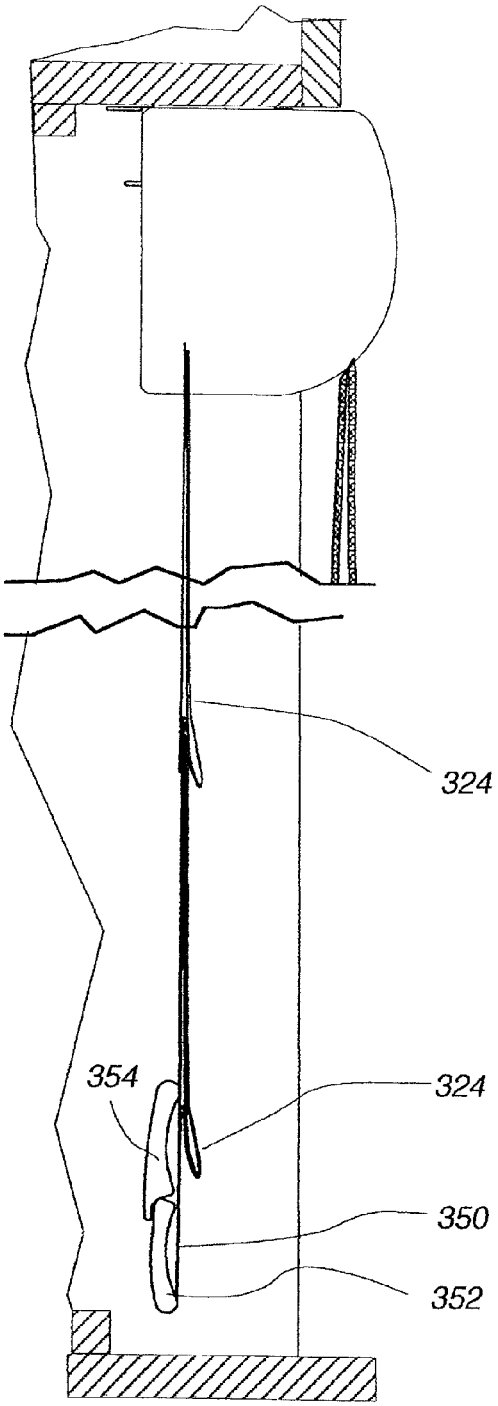
FIG. 61 is a side elevation taken along line 61-61 of FIG. 60.

FIG. 61 shows the bottom rail 340 suspended at the lower edge of the panel 322 just prior to the panel being fully extended from the roll bar 336. FIGS. 62, 62*a*, 62*b*, and 62*c* are operative views illustrating how the bottom rail cooperates with the support structure 326 and the dummy vane 350 as well as the roll bar when moving the panel from a retracted position wrapped around the roll bar to a fully extended position.

Figure 62A:
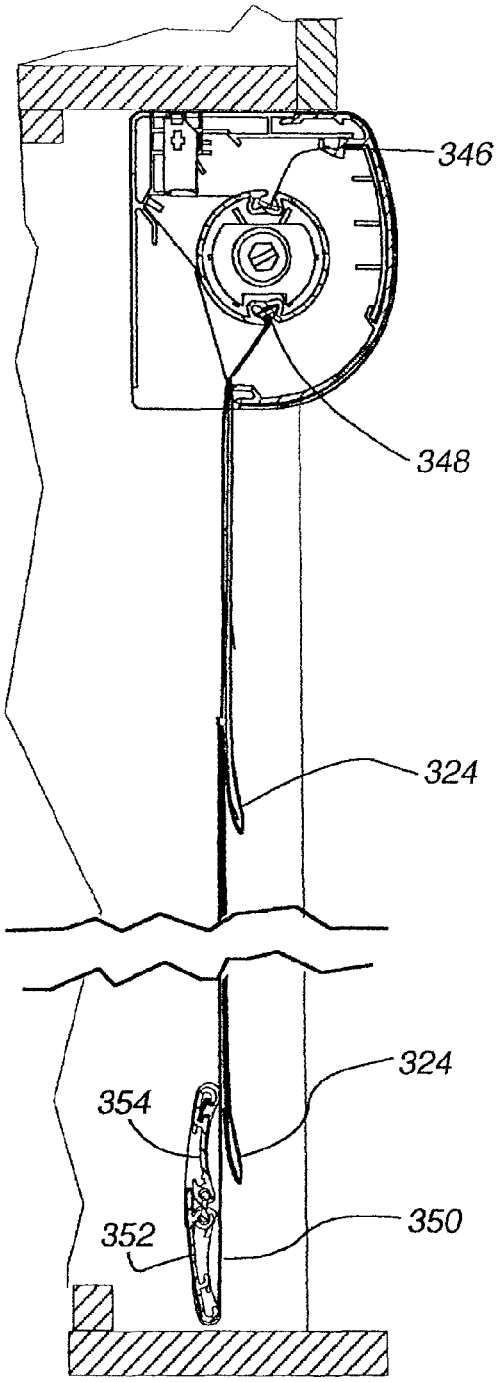
FIG. 62*a* is a section similar to FIG. 62 with the covering in a position immediately prior to being moved from a closed to an open position.
Figure 62:
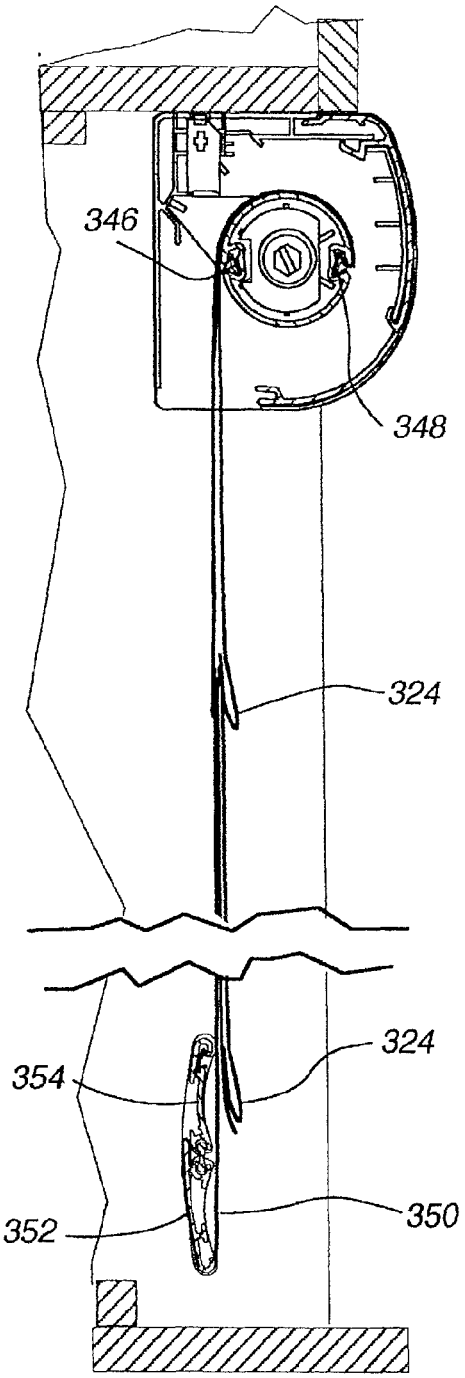
FIG. 62 is an enlarged section taken along line 62-62 of FIG. 60.
Figure 62C:
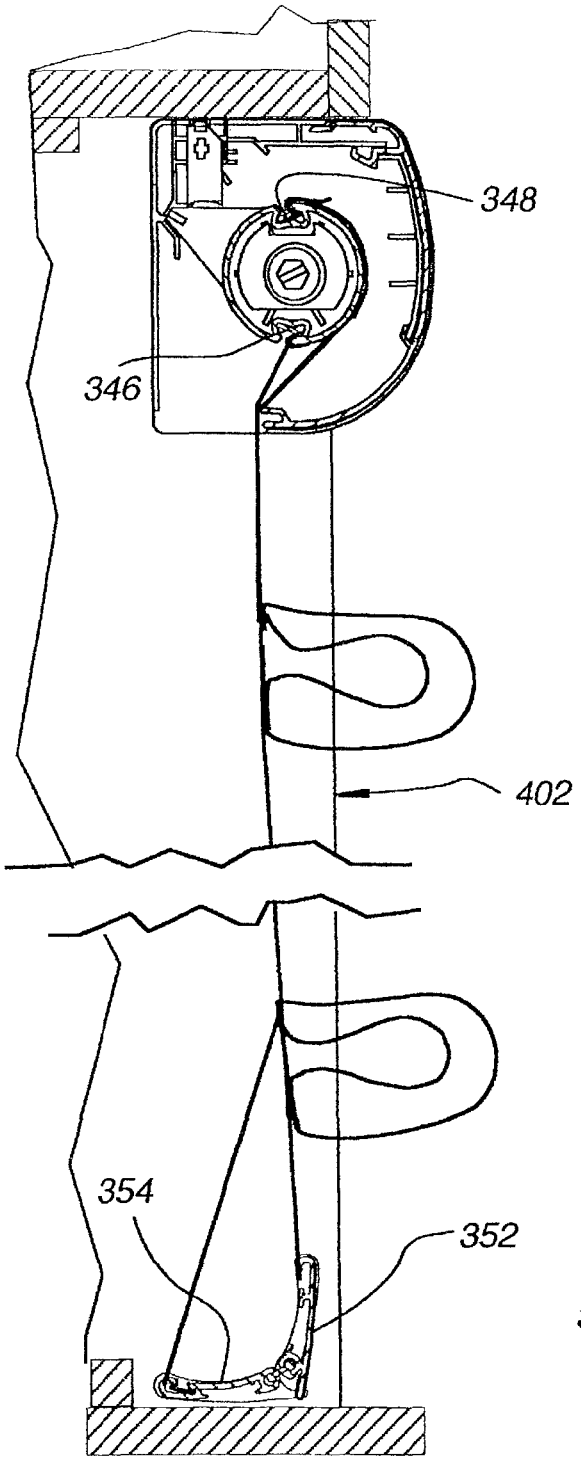
FIG. 62*c* is a section similar to FIG. 62*a* with the covering fully extended and fully open.
Figure 62B:
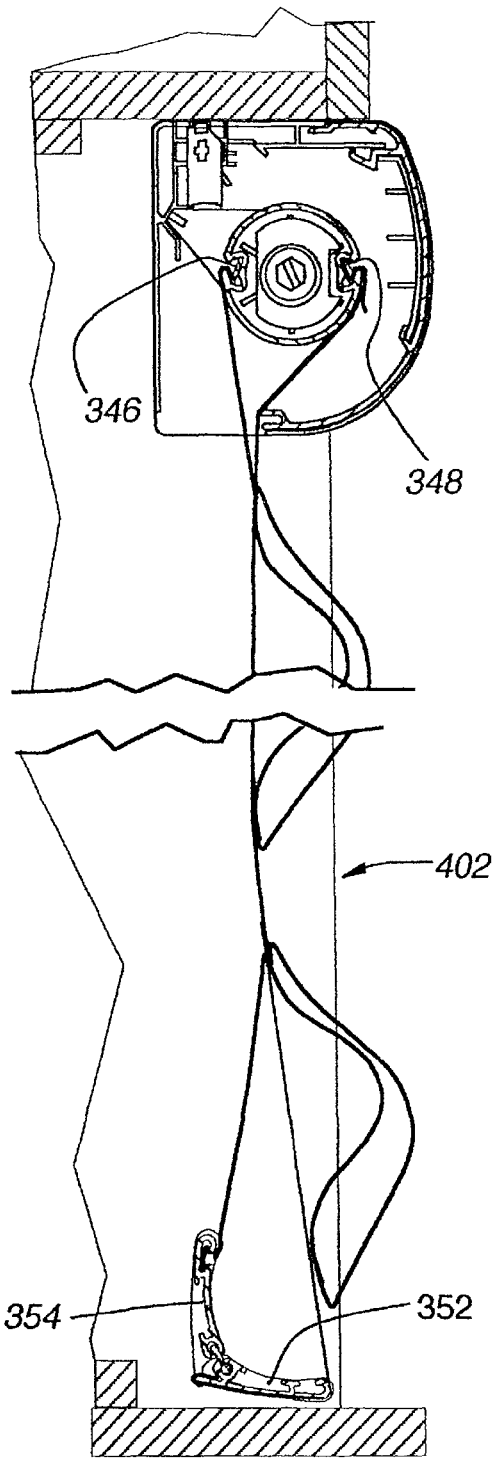
FIG. 62*b* is a section similar to FIG. 62*a* with the covering fully extended but partially opened.
Figure 62D:
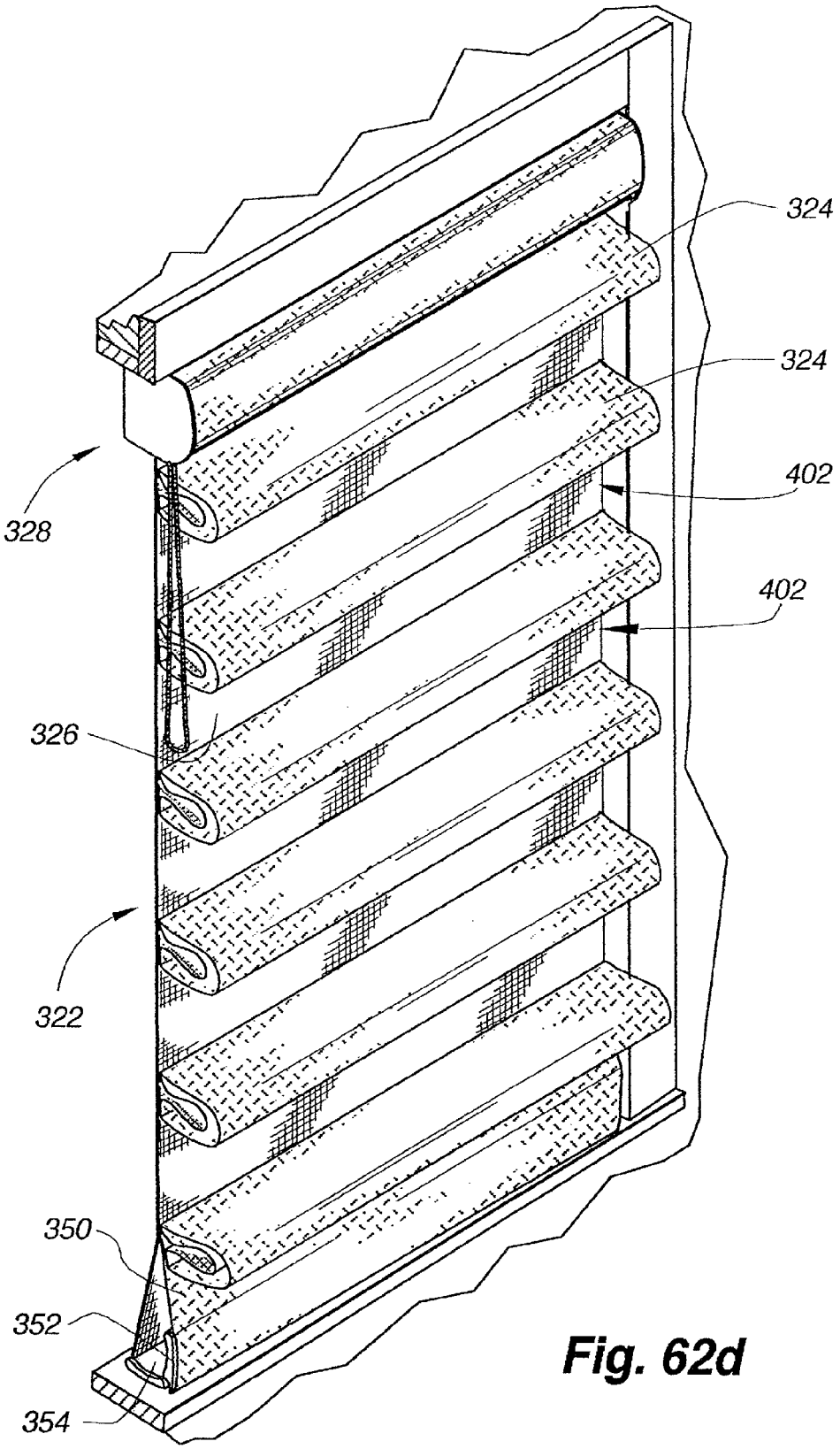
FIG. 62*d* is an isometric view of the covering as shown in FIG. 62*c*.

Looking first at FIG. 62, the panel 322 is shown substantially fully extended and as will be appreciated the larger 352 and smaller 354 segments of the bottom rail 340 are vertically oriented and aligned. It should also be noted that the groove 348 in the roll bar in which the operative elements 312 are secured is on the left-hand side of the roll bar or roller 336 while the groove 346 in which the support structure 326 is anchored is on the right side of the roller and wrapped over the top of the roller. FIG. 62*a* shows the roller having turned through a quarter turn in a counterclockwise direction so that the bottom rail has been lowered to its lowermost extent adjacent to the sill of the window or other architectural opening in which the covering is mounted. In FIG. 62*b*, the roller has rotated through another quarter turn in a counterclockwise direction and as will be appreciated the groove 348 in which the operative elements are anchored is now on the right side of the roller and has pulled upwardly on the operative elements which lifts the dummy vane 350 that is connected to the lower end of the operative elements so as to lift the lower edge of the bottom rail as the top edge of the bottom rail continues to move downwardly with the support structure 326. This movement forces the bottom edge of the bottom rail to shift forwardly as seen in FIG. 62*b*. As the roller continues to rotate in a counterclockwise direction, the groove 348 in which the operative elements are anchored moves to the top of the roller pulling the operative elements even further upwardly and with them the bottom edge of the bottom rail 340 and simultaneously the support structure is continuing to move downwardly as the groove 346 in the roller to which it is connected moves from the left-hand side of the roller to the bottom of the roller as shown in FIG. 62*c*. In this position, it will be appreciated that what was originally the top edge of the bottom rail has dropped into close proximity to the sill of the architectural opening and the bottom edge of the bottom rail has been raised while allowing the bottom rail in general to remain closely adjacent to the sill. During this process, each of the vanes 324 has moved into a raised or open position so that there are gaps 402 between the vanes through which light and vision can pass. The panel 322 is shown in FIG. 62*d* in an isometric view in the same position it occupies in FIG. 62*c*.

Figure 63:
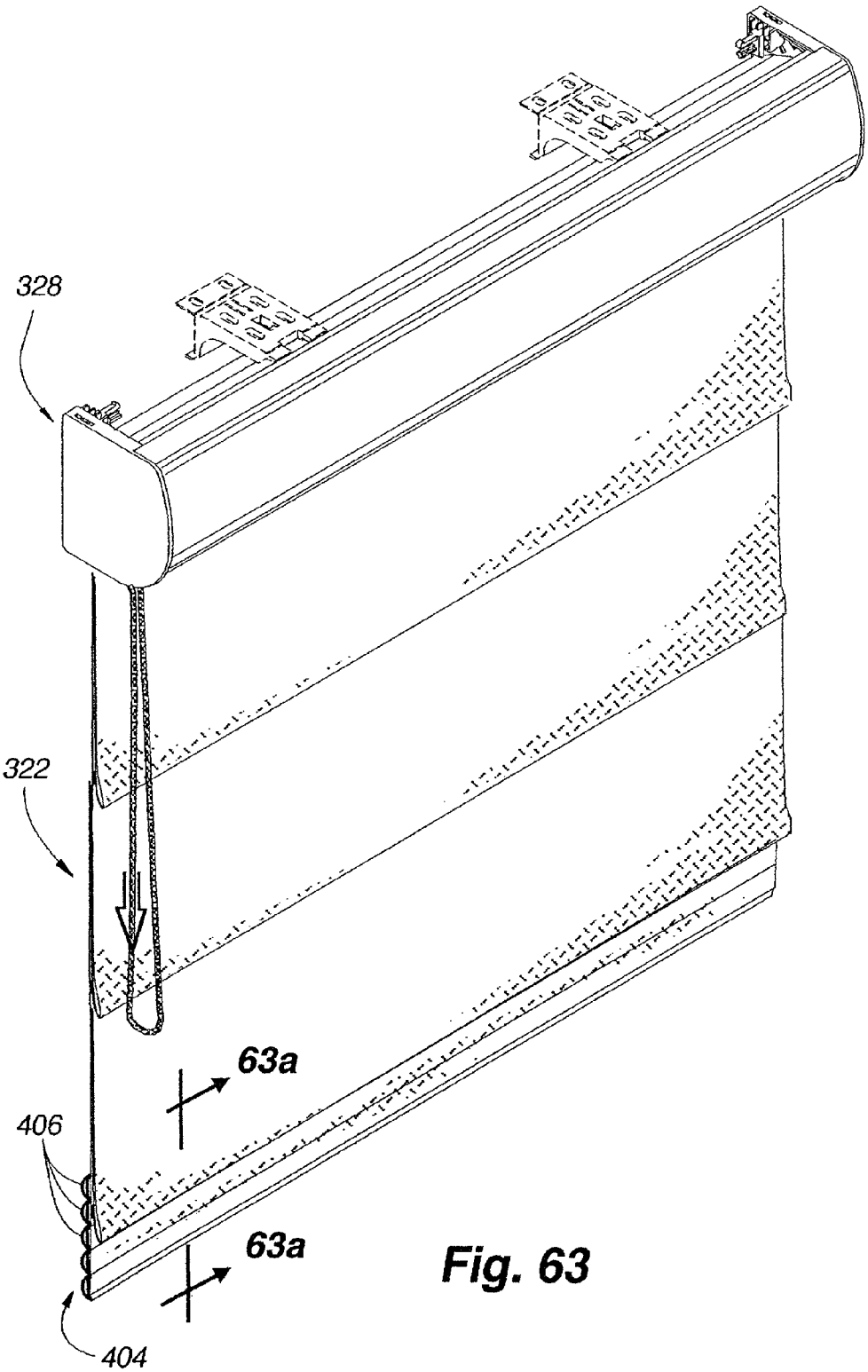
FIG. 63 is an isometric of a covering of the type shown in FIG. 62 utilizing a second embodiment of a bottom rail.
Figure 63B:
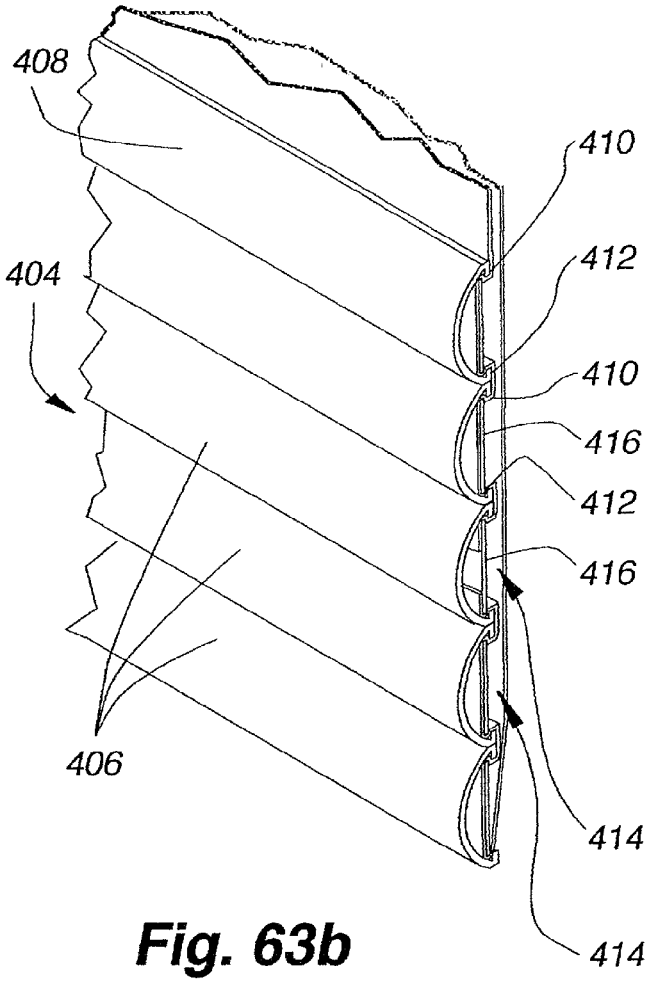
FIG. 63*b* is an isometric showing the bottom rail as illustrated in FIG. 63*a*.
Figure 63A:
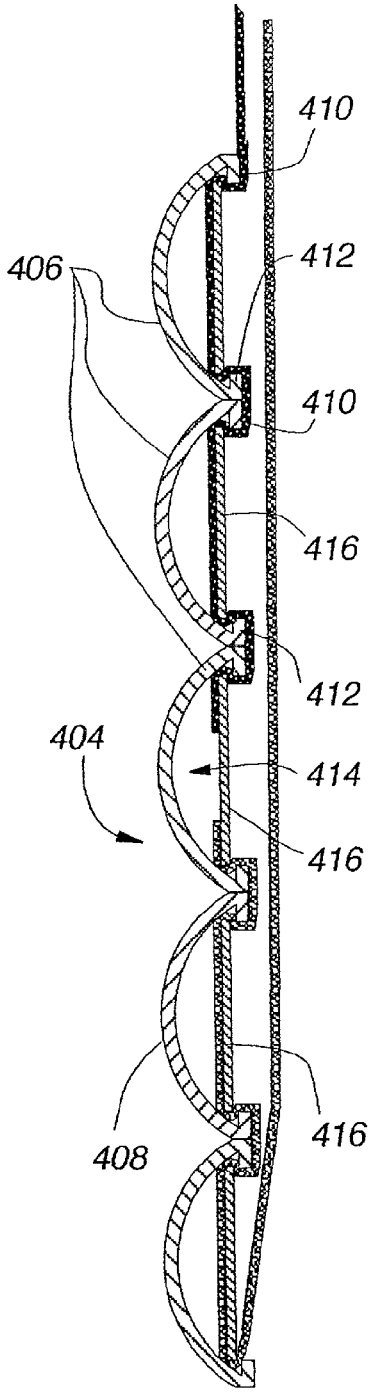
FIG. 63*a* is an enlarged fragmentary section taken along line 63*a*-63*a* of FIG. 63.
Figure 63D:
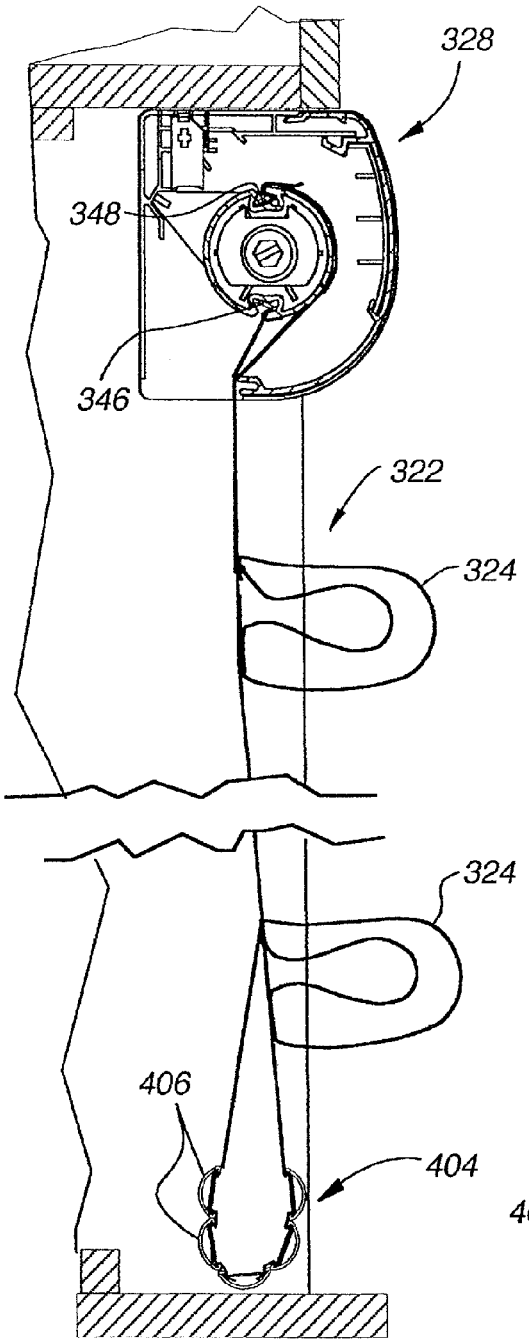
FIG. 63*d* is a section similar to FIG. 63*c* with the covering in a fully extended and fully open position.

FIGS. 63-63*d* illustrates an arrangement of the covering of the present invention wherein the bottom rail has been modified from a two-segment bottom rail to a bottom rail 404 having more than two segments and as illustrated five components 406. In this arrangement of the bottom rail, which is probably best seen in FIGS. 63*a* and 63*b*, it will be appreciated there are five identical pivotally interconnected bottom rail components 406 each having a body 408 of arcuate transverse cross-section and having inturned lips 410 and 412 on the concave side of the component along the top and bottom longitudinal edge, respectively. The components are of course elongated so as to extend the full width of the window covering. The lips on each component cooperate with the concave main body portion of the component to define a pocket 414 for receiving an anchor strip 416 that extends the full length of the component and serves to anchor either the dummy strip 350 that moves in synchronism with the operative elements 312 or the support structure 326 which is disclosed as being a sheet of sheer material.

The dummy strip 350, which moves in synchronism with the operative elements 312, has a lower portion thereof secured to the upper three components 406 of the bottom rail 404 as best illustrated in FIG. 63*a*. As will be appreciated, the dummy strip, which is flexible, extends downwardly from its connection to the lower edge of the lowermost vane 324 in the panel 322 of the covering and is looped around the upper lip 410 of the uppermost rail component then extends downwardly and is looped over the lower lip 412 of the uppermost rail component. The dummy strip is held in that position with a rigid or semi-rigid anchor strip 416 which is positioned in the pocket 414 defined in the concave side of the component. The dummy strip then extends downwardly wrapping around the upper lip 410 on the second highest rail component 406 and subsequently wrapping around the lower lip 412 on the second highest rail component and is held in place in this component with another anchor strip 416 positioned in the pocket 414 of the second highest rail component. The dummy strip extends around the upper lip 410 of the third highest component and is again held in place with an anchor strip 416 positioned in the pocket 414 of the third highest rail component.

The sheer material or support structure 326 for the covering extends downwardly to the bottom edge of the bottom rail where it is held within the bottommost rail component 406 with an anchor strip 416 positioned in the pocket 414 in the concave side of the bottommost rail component. The support structure then extends upwardly and wraps around the upper lip of the bottommost rail component and subsequently around the lower lip 412 of the second lowest rail component. Thereafter, it extends upwardly around the upper lip 410 of the second lowest component and again is held in position within the second lowest component with an anchor strip 416. The support sheet then wraps around the lower lip 412 of the third highest component mentioned previously and is held in position with the anchor strip 416 in the third highest component.

Figure 63C:
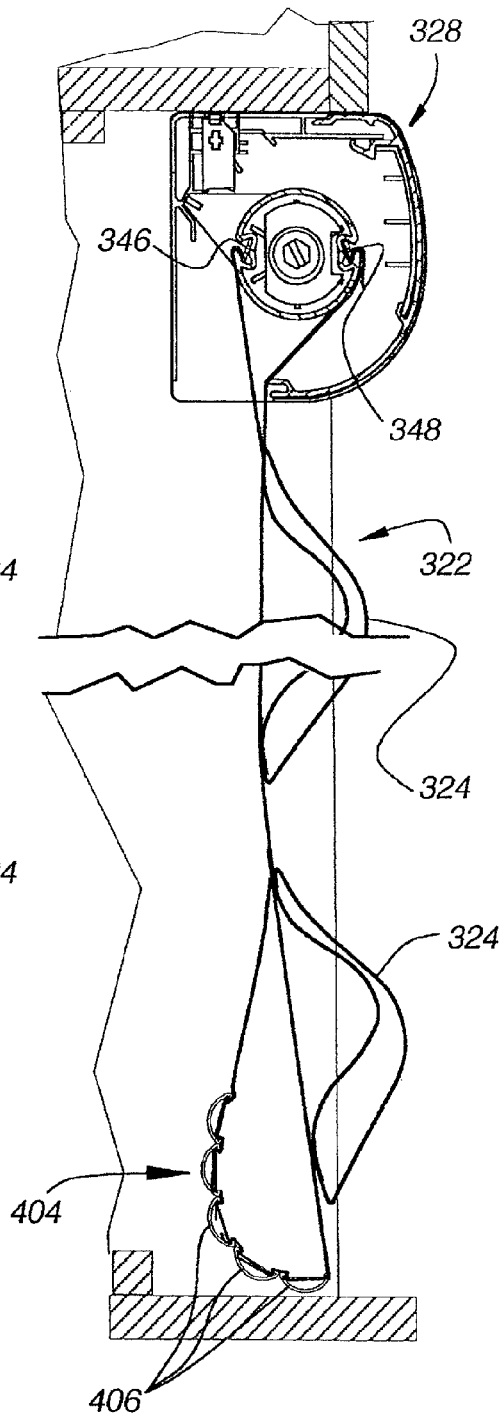
FIG. 63*c* is a vertical section through the covering of FIG. 63 in a fully extended but partially open position.

The operation of the covering with the bottom rail shown in FIGS. 63, 63*a*, and 63*b* is illustrated in FIGS. 63*c* and 63*d*. In FIG. 63*c*, the covering panel 322 is shown having been lowered to its lowermost extent with the groove 348 in the roller anchoring the operative components 312 and thus associated with the dummy strip 350 having been moved to the right side of the roller as the roller is rotating in a counterclockwise direction. This movement lifts the lower edge of the bottom rail 404 as the upper edge of the bottom rail continues to drop as it is connected to the support structure 326 and the groove 346 in which the support structure is anchored is on the left side of the roller. Continued counterclockwise rotation of the roller allows the support structure to drop even lower as its support groove 346 moves to the bottom of the roller while the groove 348 anchoring the operative elements moves from the right side of the roller to the top of the roller thereby lifting the bottom edge of the bottom rail even further so that the bottom rail becomes generally channel-shaped in transverse cross-section as seen in FIG. 63*d*. Also, during this process, the lower edges of the vanes 324 are lifted as previously described so as to create a gap 402 between the vanes as seen in FIG. 63*d*.

Figure 64:
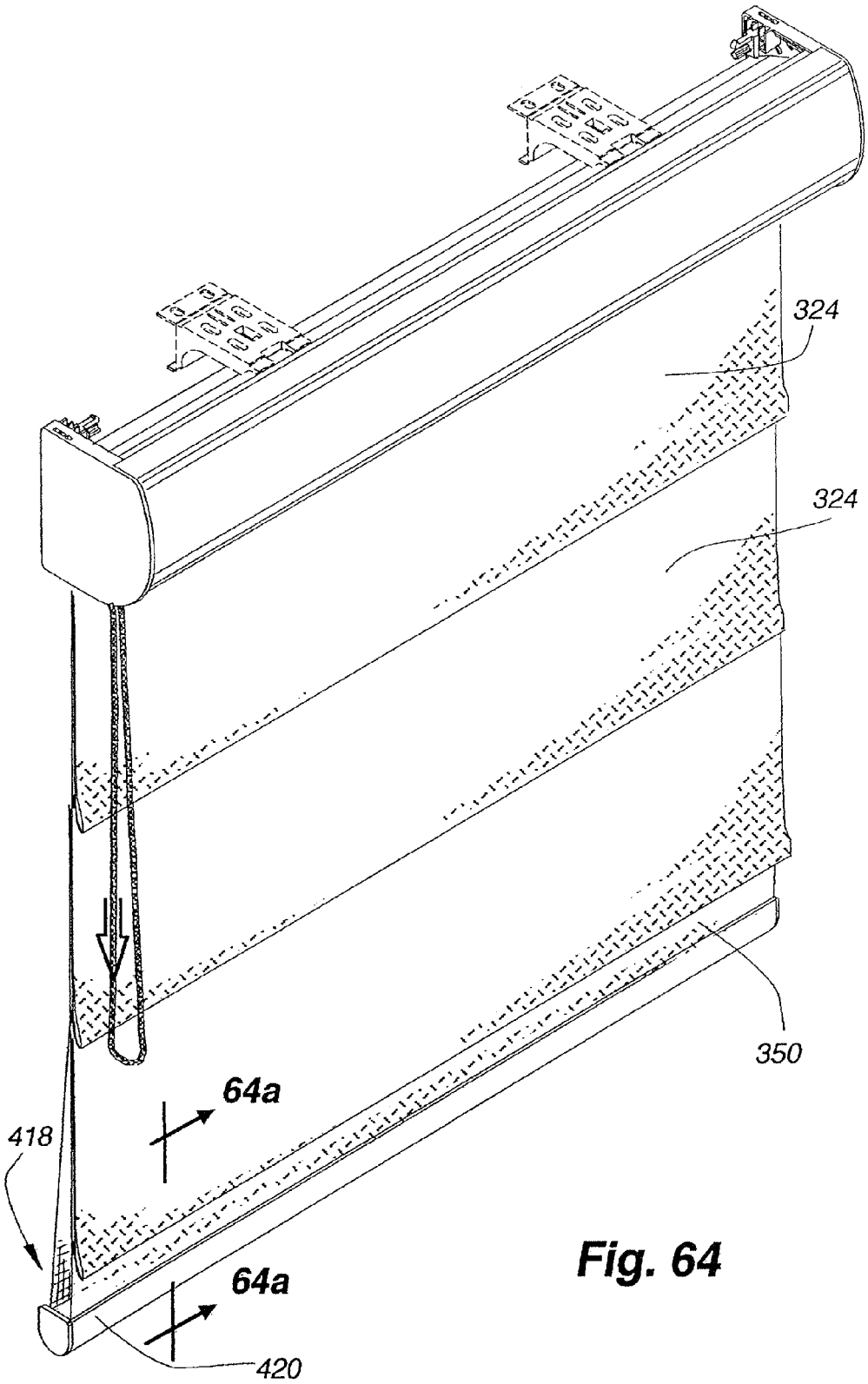
FIG. 64 is an isometric of a covering as shown in FIG. 63 with a third embodiment of a bottom rail.
Figure 64B:
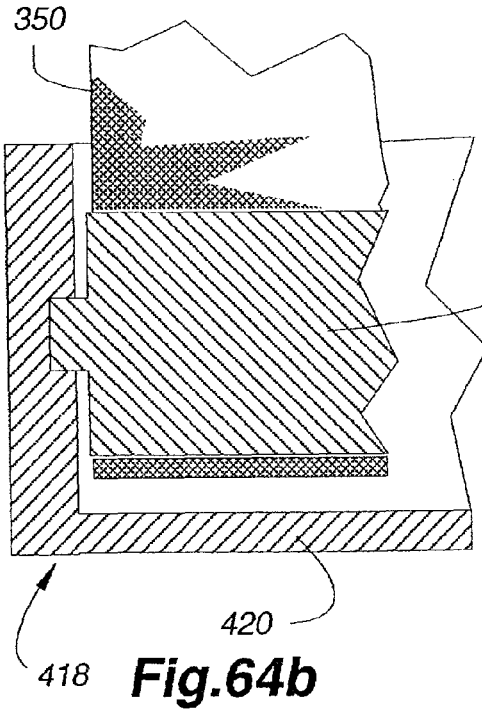
FIG. 64*b* is a section taken alone line 64*b*-64*b* of FIG. 64*a*.
Figure 64A:
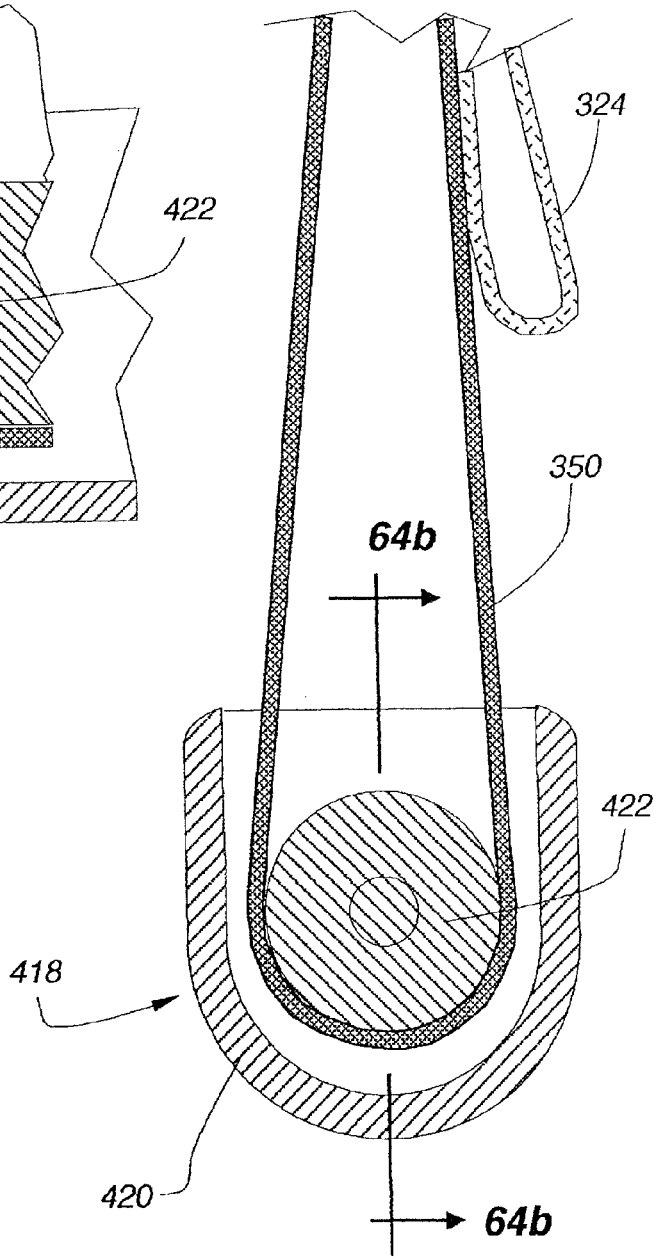
FIG. 64*a* is an enlarged fragmentary section taken alone line 64*a*-64*a* of FIG. 64.
Figure 64D:
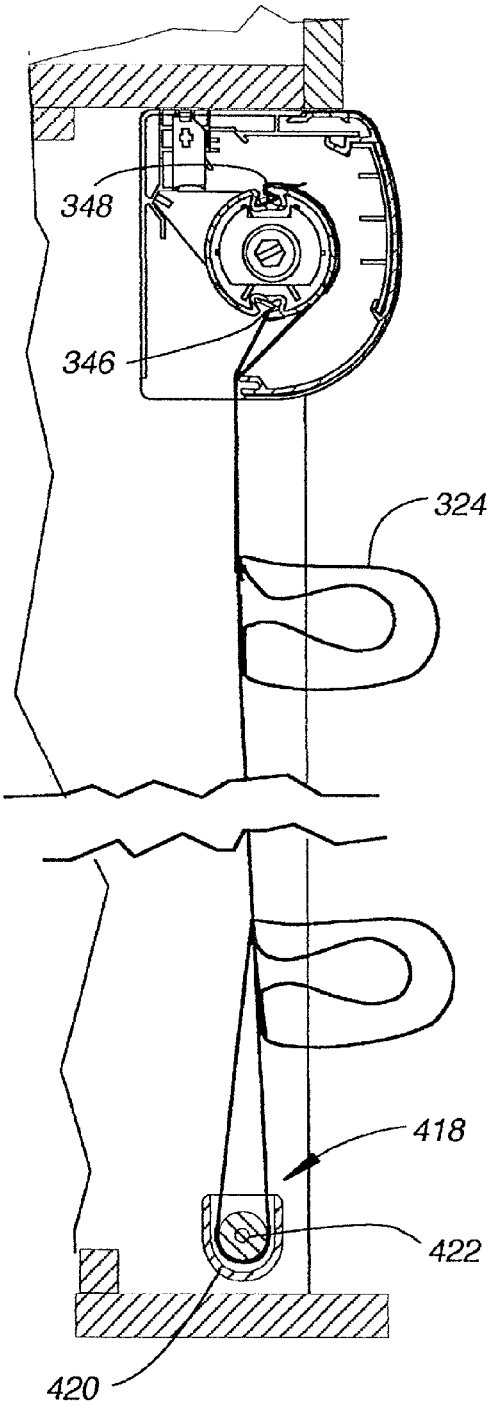
FIG. 64*d* is a section similar to FIG. 64*c* with the covering in a fully extended and fully open position.
Figure 64C:
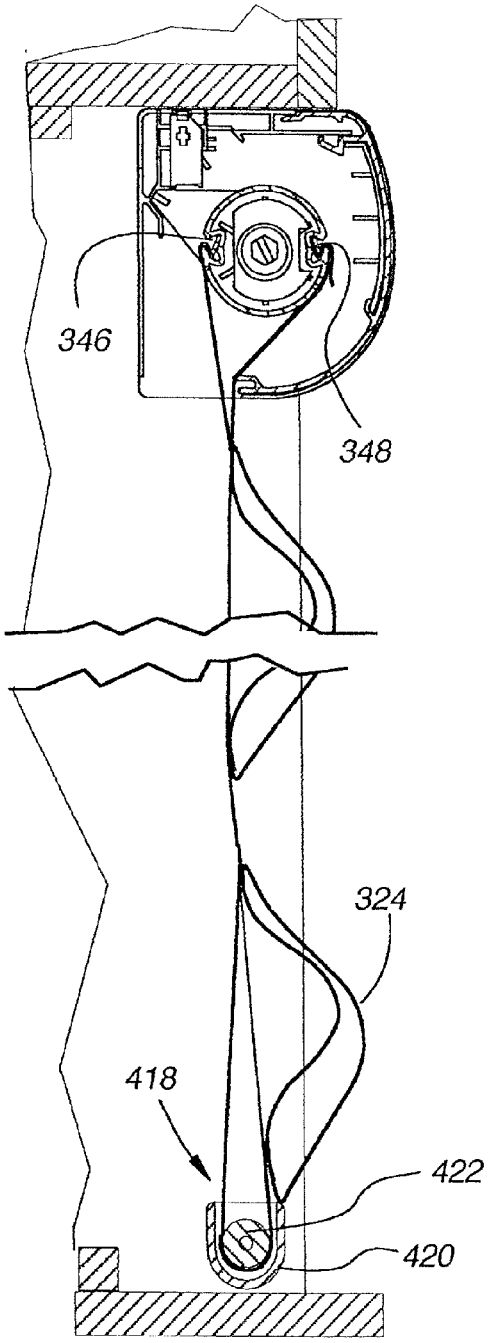
FIG. 64*c* is a vertical section of the covering shown in FIG. 64 in a fully extended but partially open position.

Still another embodiment of a bottom rail for use in a covering as described previously in FIGS. 62-62*d* is shown in FIGS. 64-64*d*. In FIG. 64, the panel 322 for the covering is shown fully extended but with the vanes 324 in a closed position and the bottom rail 418 which has an upwardly opening channel-shaped main body 420 is suspended beneath the panel. An elongated roller 422 is journaled in the channel-shaped main body for rotation therein and has the dummy strip material 350 wrapped therearound toward the rear face of the panel with the free end of the dummy strip material being attached to the rear face of the support structure 326 which in the disclosed embodiment is a sheet of sheer fabric. The operation of the covering having this embodiment of the bottom rail is illustrated in FIGS. 64*c* and 64*d*. With reference to FIG. 64*c*, the groove 348 in the roller 336 anchoring the operative elements 346 and thus operatively connected to the dummy strip has rotated in a counterclockwise direction until the groove is on the right side of the roller so the operative elements have begun to be lifted. As the operative elements are being lifted, the sheer support structure 326 continues to drop as its groove 346 of attachment to the roller 336 is on the left side of the roller and moving downwardly as the right side of the roller is moving upwardly. Accordingly, since the dummy strip material moves with the operative elements, as the operative elements are pulled upwardly, the front portion of the dummy strip is pulled upwardly while the back portion of the dummy strip material where it is connected to the support structure moves downwardly with the support structure. With reference to FIG. 64*d*, the groove 348 anchoring the operative elements has moved to the top of the roller and lifted the bottom edges of the vanes 324 to their fullest extent so as to create gaps 402 between the vanes. The dummy strip material, which is wrapped around the roller 422 in the bottom rail, merely rotates with the roller within the main body 420 of the bottom rail so that the bottom rail remains at a lowermost position adjacent to the sill of the architectural opening in which the covering is mounted. It will be appreciated by those skilled in the art that the bottom rail would not necessarily need to be a roller, as a fixed surface that was preferably curvilinear to provide a smooth sliding surface for the dummy strip material would also work.

Figure 65:
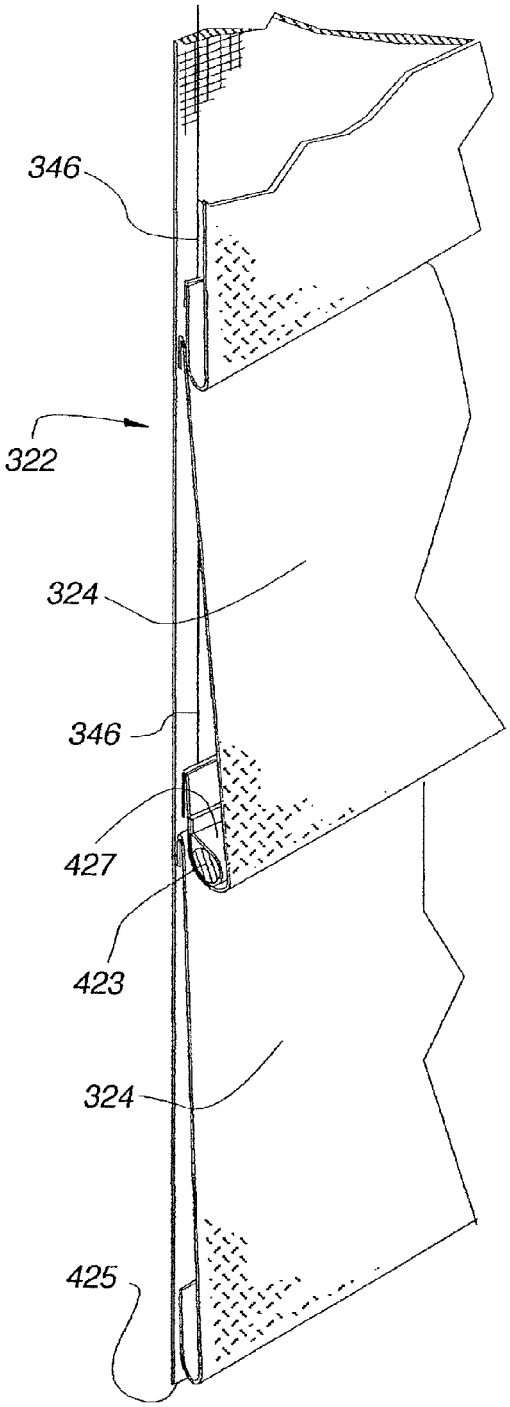
FIG. 65 is a fragmentary isometric of a covering without a bottom rail but with a hidden weighted rod at a location above the bottom edge of the covering.

With reference to FIG. 65, it will be noted that a bottom rail would not always be necessary inasmuch as a weighted rod or other element 423 could be affixed to the panel 322 at a location spaced, for example, above the bottom edge 425 of the panel with the weight of the rod or other element being sufficient to encourage the panel to hang desirably from a headrail (not seen) while also giving some resistance to the lifting of the lower edges of the vanes 324 with the operative elements 346. By way of example, and as illustrated, a pocket 427 is formed in the interior of a vane spaced upwardly from the bottom edge of the panel wherein the pocket could be formed from the same material as the vane itself. The pocket would be positioned interiorly of the vane so as not to be visible and the elongated rod 423 of a modest amount of weight could be confined in the pocket. In this manner, as the panel is unrolled from a roll bar, the weight of the rod would encourage the panel to hang in a vertical orientation and since the rod is confined within a vane adjacent to the bottom edge of the vane, when the operative elements are raised to open the vanes by lifting the lower edges of the vanes, the rod would give some resistance to opening the vanes and would also assist in allowing the bottom edge of the vanes to drop when the operative elements were lowered as when the vanes were moving toward a closed position. The precise weight of such a rod or element 423 would be well within the skill of those in the art and would of course be chosen to permit operation of the covering as described. It should be appreciated that since the weighted rod is positioned near the bottom of the panel 322, there would be a short length of panel material suspended beneath the weighted rod and this short amount of material would not need a weighted element to retain its vertical suspension.

As mentioned previously, the hardware for the covering of the present invention includes a headrail 328 that has end caps 330 for supporting a fascia panel 332. The end caps also support the roller or roll bar 336 in a conventional manner for reversible rotation about its longitudinal axis with the endless control cord 338. The previously mentioned adjustable stops 344 are mountable on the end caps in any one of a plurality of different positions so as to engage the bottom rail 340 of the covering when the covering is being retracted to arrest rotation of the roll bar 336 at a fully retracted position of the covering. Since the panel 322 for the covering can assume any of various lengths depending upon the size of the architectural opening in which the covering is mounted, the accumulation length of panel on the roller will vary thereby directly varying the effective diameter of the roller within the headrail when the covering is fully retracted. In other words, the longer the panel, the greater the effective diameter of the roller with the panel wrapped therearound in the fully retracted position of the covering.

Figure 58:
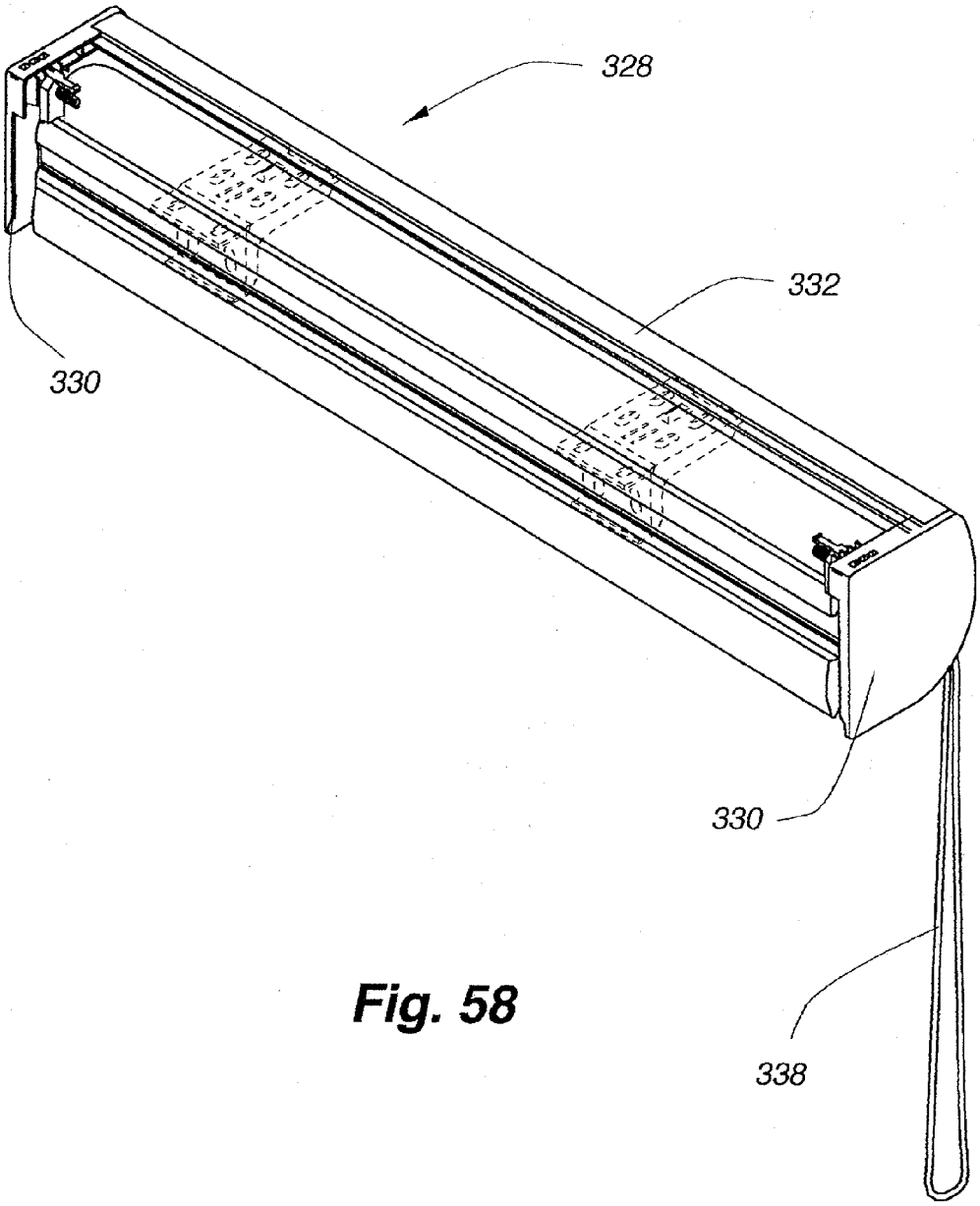
FIG. 58 is an isometric looking at the rear of the covering shown in FIG. 57, again with mounting brackets shown in dashed lines.
Figure 58A:
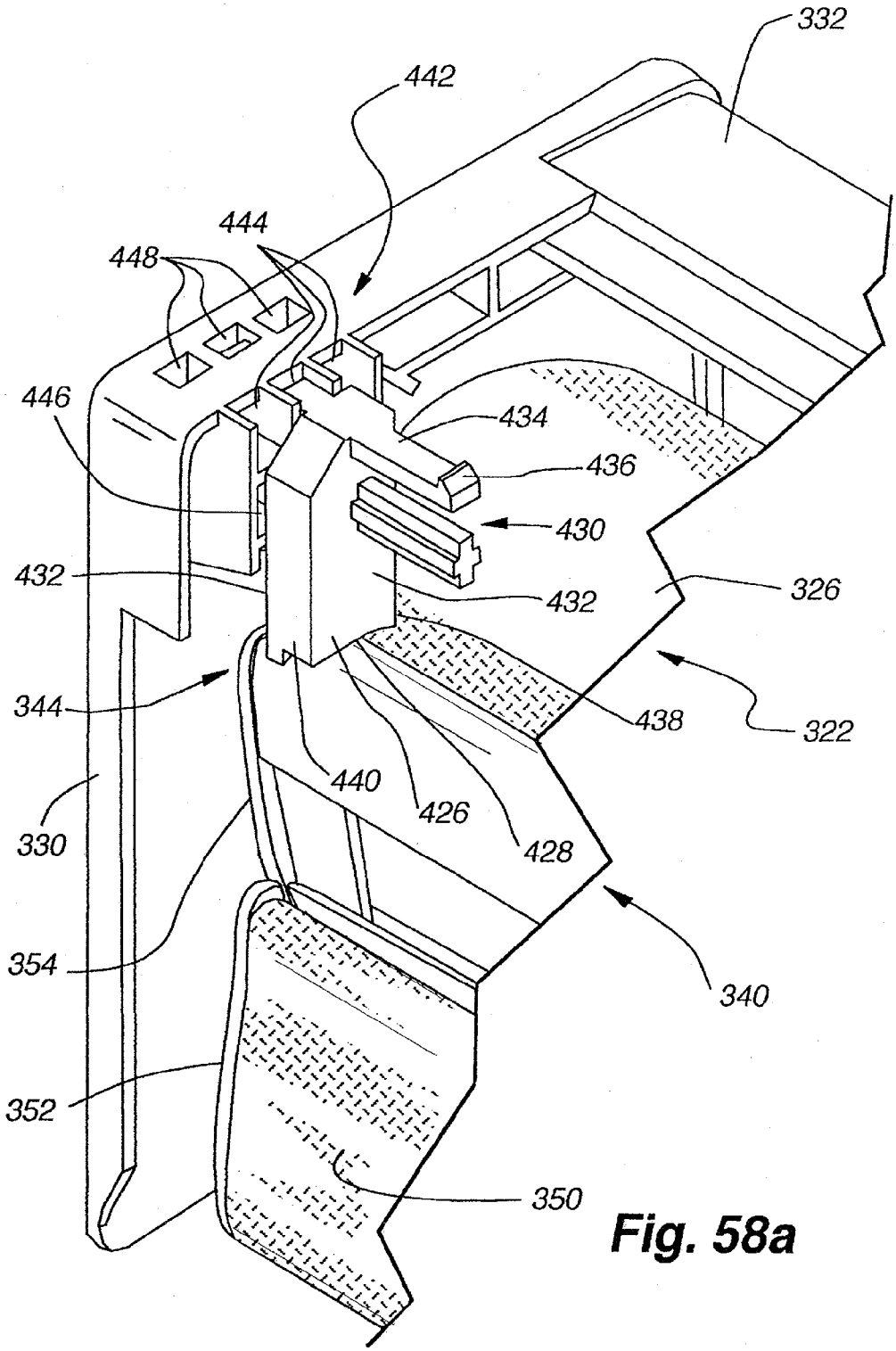
FIG. 58*a* is a fragmentary enlarged view looking at an end of the headrail and an adjustable stop provided therein.

The stop 344 utilized in the covering of the present invention to limit the retracting rotation of the roller 336 in a clockwise direction as viewed in the drawings is adapted to engage the bottom rail 340 along the bottom of the panel 322 and since the radius of the accumulated panel material on the roller will vary depending upon the length of the panel, so will the position of the bottom rail 340 when it enters the headrail 328 in the fully retracted position of the covering. Accordingly, it is necessary to be able to position the stop 344 at different radial distances from the rotational axis of the roller 336. To accommodate the variable position of the bottom rail as it enters the headrail, the adjustable stop 344, which is seen best in FIGS. 58*a* and 58*b*, can be positioned in any one of three different sets of openings or seats 424 provided in each end cap 330 of the headrail. The stop is also reversible so as to be accommodated in any one of the pairs of openings in either one of two positions so that there are six different positions for the stop accommodated by the system of the present invention.

Figure 58B:
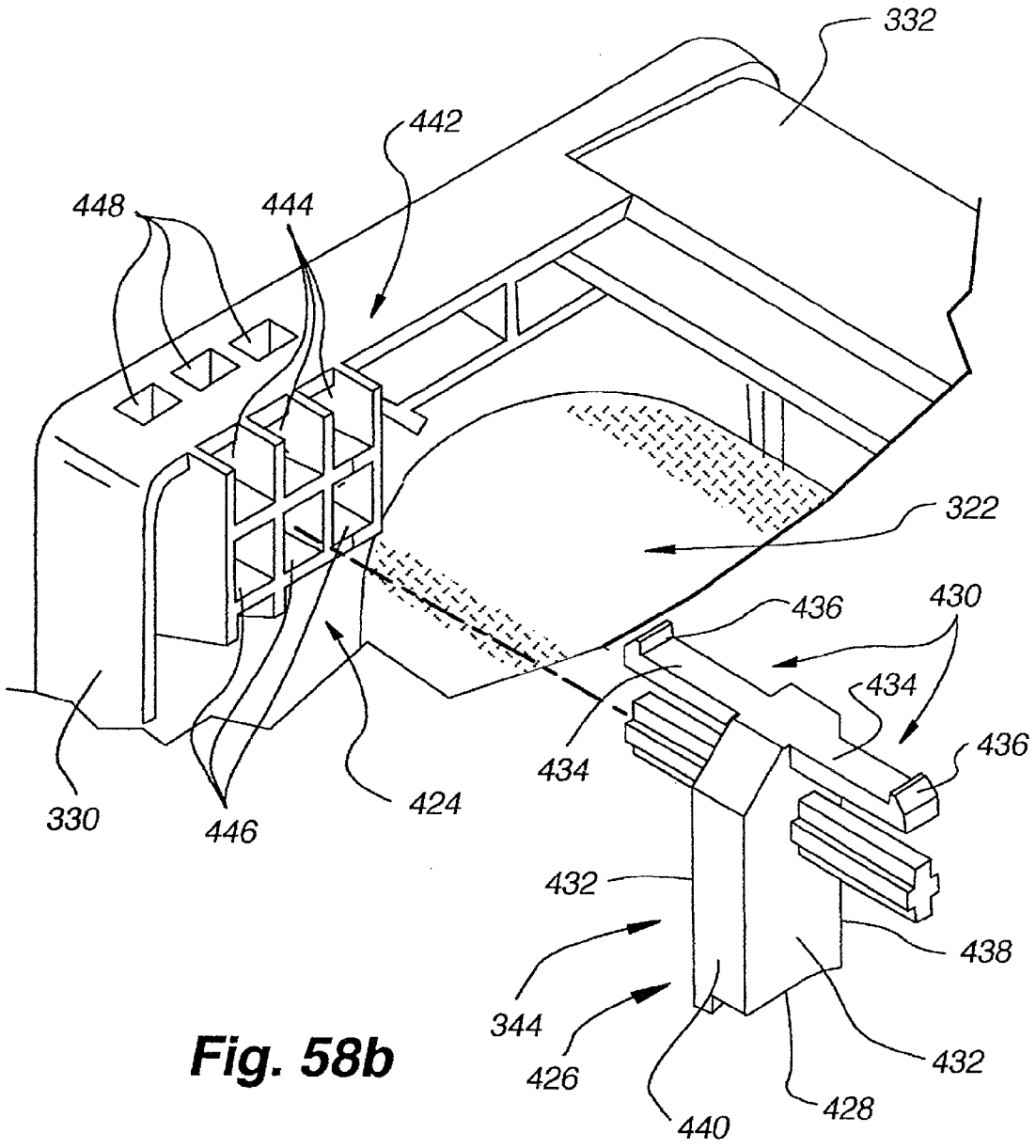
FIG. 58*b* is a fragmentary isometric similar to FIG. 58*a* with the stop having been removed for placement at a different location in the headrail.

With reference first to FIG. 58*b*, the stop 344 can be seen to include a block-shaped main body 426 having a somewhat concave bottom edge 428 and with two pair of vertically spaced and aligned arms 430 extending in opposite directions from opposite sides 432 of the body. The upper arm 434 of each pair has a catch 436 on its terminal end. It is also important to note that each pair of arms 430 is disposed closer to one edge 438 of the body 426 than the opposite edge 440 which will vary the positioning of the stop in a manner to be described hereafter.

Each end cap 330 has a receptacle 442 for the stop element that includes the three sets of openings or seats 424. Each set of openings has an upper 444 and lower 446 vertically aligned passage with the upper passage of each pair communicating with a vertical opening 448 through the top of the end cap 330. Each pair of passages is adapted to receive a pair of the arms 430 on the stop and the catch 436 on the upper arm is adapted to be releasably caught in the vertical opening 448 associated with the pair of passages in which the stop is disposed.

It will therefore be appreciated that with the stop 344 oriented in one orientation, for example as seen in FIG. 58*b*, the pair of arms 430 on the left side of the stop can be inserted into any one of the three sets of openings 424 and releasably retained therein with the catch 436 on the upper arm. Each set of openings disposes the concave bottom edge 428 of the main body 426 of the stop at a different radial distance from the rotational axis of the roller 336 to accommodate panels of different lengths that have been accumulated on the roller. By reversing the stop, the pair of arms on the stop protruding from the opposite face can be inserted into one of the three sets of openings but since both pair of arms are disposed closer to one edge 438 of the main body than the other edge 440, this will position the concave lower edge of the body at different positions than if the other set of arms was positioned in one of the passages. Accordingly, by orienting the stop element in one of two orientations and inserting it into one of the three sets of passages in the end cap, six different locations for the concave bottom edge 428 of the stop element are achievable for engaging the bottom rail of the covering in the fully retracted position of the covering. Of course, since the concave bottom edge of the stop element is relatively broad, each position in and of itself accommodates various effective radii of the roller with a panel wrapped therearound and obviously panels of lengths within a given range.

It will be apparent to those skilled in the art that many variations of a covering in accordance with the present invention are possible with some of those variations relating to the replacement of a support sheet as the support structure with a plurality of vertically extending monofilaments, tapes or ribbons, natural or synthetic cords, or the like. Similarly, the operating elements can be varied between monofilaments, strips or ribbons of material, natural or synthetic fibrous cords or the like. Also, the cross-sectional configuration of the vanes can vary for different aesthetics and further cellular vanes that are formed on opposite sides of the lift elements and operating elements can be symmetric in various configurations or asymmetric having different configurations on a front element and rear element thereof. Also, the flexibility of the material from which the vanes are made can be varied to achieve different aesthetics and where rigid or semi-rigid materials are used, creases defining fold lines can be formed in the material to obtain the desired functionality. The transparency of the vanes can also be regulated as well as the color through use of selected materials.

Further, while the vanes have been disclosed as being connected to the support structure along an upper edge with the lower edge being movable to shift the covering between open and closed positions, the reverse could be applied. That is, the bottom edge of the vanes could be secured to the support structure and the top edge moved or, of course, the vanes could be mounted vertically with one edge being secured to the support structure and the other being movable toward and away from the one edge to move the vanes between open and closed positions.

Although the present invention has been described with a certain degree of particularity, it is understood the disclosure has been made by way of example, and changes in detail or structure may be made without departing from the spirit of the invention as defined in the appended claims.

What is claimed is:

1. A covering for an architectural opening, the covering movable between open and closed positions, the covering comprising:

a rotatable roller;

a support sheet attached to and wrappable about the roller;

an operating element attached to and wrappable about the roller; and a strip of material having a first edge portion and a second edge portion, the first edge portion attached to the support sheet and the second edge portion attached to the operating element, the second edge portion movable along a face of the support sheet relative to the first edge portion;

wherein, when the covering is in the open position, the support sheet is planar and is disposed in a first vertical plane offset from a second vertical plane bisecting the roller, and the operating element is wrapped about a portion of the roller and extends toward the support sheet.

2. The covering of claim 1, wherein rotation of the roller in a first direction moves the second edge portion away from the first edge portion, and wherein rotation of the roller in a second direction opposite the first direction moves the second edge portion toward the first edge portion.

3. The covering of claim 1, wherein the first edge portion of the strip of material is an upper edge portion, and wherein the second edge portion of the strip of material is a lower edge portion.

4. The covering of claim 1, wherein the operating element extends vertically, and wherein the strip of material extends horizontally.

5. The covering of claim 1, wherein the first and second edge portions of the strip of material are parallel.

6. The covering of claim 1, wherein the strip of material is flexible.

7. The covering of claim 1, wherein the strip of material is semi-rigid.

8. The covering of claim 1, wherein the first edge portion of the strip of material is bonded to the support sheet.

9. The covering of claim 1, wherein the first edge portion of the strip of material is bonded to the support sheet with adhesive.

10. A covering for an architectural opening, comprising:

a rotatable roller;

a support sheet attached to and wrappable about the roller;

multiple operating elements attached to and wrappable about the roller; and multiple strips of material each having a first edge portion and a second edge portion, the first edge portion attached to the support sheet and the second edge portion attached to the operating elements, the second edge portion movable along a face of the support sheet relative to the first edge portion;

wherein, when the covering is in an open position, the support sheet defines a first vertical plane offset from and oriented substantially parallel to a second vertical plane bisecting the roller, and the operating elements extend from the roller toward the support sheet.

11. The covering of claim 10, wherein rotation of the roller in a first direction moves the second edge portion away from the first edge portion, and wherein rotation of the roller in a second direction opposite the first direction moves the second edge portion toward the first edge portion.

12. The covering of claim 10, wherein the first edge portion is an upper edge portion, and wherein the second edge portion is a lower edge portion.

13. The covering of claim 10, wherein the operating elements extend vertically, and wherein the strips of material extend horizontally.

14. The covering of claim 10, wherein the first and second edge portions are parallel.

15. The covering of claim 10, wherein the strips of material are flexible.

16. The covering of claim 10, wherein the strips of material are semi-rigid.

17. The covering of claim 10, wherein the first edge portion is bonded to the support sheet.

18. The covering of claim 10, wherein the first edge portion is bonded to the support sheet with adhesive.

19. A covering for an architectural opening, comprising:

a rotatable roller;

a support sheet attached to and wrappable about the roller, the support sheet extending from the roller in a first vertical plane offset from a second vertical plane bisecting the roller;

at least one operating element attached to and wrappable about the roller; and at least one strip of material having an upper edge portion and a lower edge portion, one of the upper edge portion or the lower edge portion attached to the support sheet, the other of the upper edge portion or the lower edge portion attached to the at least one operating element and movable along a face of the support sheet relative to the one of the upper edge portion or the lower edge portion;

wherein, when the covering is in an open position, the at least one operating element extends from the roller toward the support sheet.

20. The covering of claim 1, wherein the first vertical plane is offset rearwardly from the second vertical plane.

21. The covering of claim 10, wherein the first vertical plane is offset rearwardly from the second vertical plane.

22. The covering of claim 19, wherein the first vertical plane is offset rearwardly from the second vertical plane.

* * * * *